US010916874B2

(12) United States Patent
Maesoba et al.

(10) Patent No.: US 10,916,874 B2
(45) Date of Patent: Feb. 9, 2021

(54) CONNECTOR WITH DISPLACEMENT RESTRICTING MEMBER FOR LOCKING TO THE CONNECTOR HOUSING AND TO RESTRICT DISPLACEMENT OF THE TERMINAL UNIT

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/783,610

(22) Filed: Feb. 6, 2020

(65) Prior Publication Data

US 2020/0176908 A1 Jun. 4, 2020

Related U.S. Application Data

(62) Division of application No. 16/216,224, filed on Dec. 11, 2018, now Pat. No. 10,797,420.

(30) Foreign Application Priority Data

Dec. 21, 2017 (JP) ..... 2017-244646

(51) Int. Cl.
*H01R 13/11* (2006.01)
*H01R 13/422* (2006.01)
(Continued)

(52) U.S. Cl.
CPC ..... *H01R 13/113* (2013.01); *H01R 4/18* (2013.01); *H01R 12/58* (2013.01); *H01R 13/405* (2013.01);
(Continued)

(58) Field of Classification Search
CPC .. H01R 13/113; H01R 13/405; H01R 13/422; H01R 13/5812; H01R 13/642; H01R 13/506; H01R 12/58; H01R 4/18
(Continued)

(56) References Cited

U.S. PATENT DOCUMENTS 5,643,015 A * 7/1997 Wakata ..... H01R 13/4361 439/701
5,913,703 A * 6/1999 Suzuki ..... H01R 13/518 439/489
(Continued)

FOREIGN PATENT DOCUMENTS

JP 2004-55470 2/2004

*Primary Examiner* — Peter G Leigh
(74) *Attorney, Agent, or Firm* — Gerald E. Hespos; Michael J. Porco; Matthew T. Hespos

(57) ABSTRACT

When a terminal unit (U) is mounted into an accommodation recess (8 of a connector housing (1), a rear part thereof projects from the connector housing (1). A displacement restricting member (2) including positioning portions (16) is mounted on the projecting part. Since the positioning portions (16) are fit into receiving portions (15) of the connector housing (1) while being position in a direction intersecting with an inserting direction, a situation where the projecting part of the terminal holding member (H) is deformed is avoided even if a second wire (25) is swung.

8 Claims, 50 Drawing Sheets

(51) Int. Cl.

| | |
|---|---|
| ***H01R 4/18*** | (2006.01) |
| ***H01R 13/405*** | (2006.01) |
| ***H01R 13/642*** | (2006.01) |
| ***H01R 12/58*** | (2011.01) |
| ***H01R 13/58*** | (2006.01) |
| *H01R 13/506* | (2006.01) |

(52) U.S. Cl.
CPC ..... *H01R 13/422* (2013.01); *H01R 13/5812* (2013.01); *H01R 13/642* (2013.01); *H01R 13/506* (2013.01); *H01R 2201/26* (2013.01)

(58) Field of Classification Search
USPC ..... 439/851
See application file for complete search history.

(56) References Cited

U.S. PATENT DOCUMENTS 6,059,612 A 5/2000 Aoyama
6,129,593 A * 10/2000 Aoyama ..... H01R 13/514 439/354
6,149,447 A * 11/2000 Maeda ..... B63B 22/04 439/157
6,336,831 B1 * 1/2002 Abe ..... H01R 13/506 439/701
6,582,256 B2 6/2003 Sakurai
6,666,730 B2 * 12/2003 Canuto ..... H01R 13/4361 439/598
7,108,566 B2 9/2006 Kressmann
7,297,032 B2 * 11/2007 Kobayashi ..... H01R 13/4361 439/595
8,187,041 B2 * 5/2012 Ito ..... H01R 13/4361 439/701
8,915,758 B2 12/2014 Shishikura
9,160,095 B2 * 10/2015 Littek ..... H01R 13/422
9,246,286 B2 * 1/2016 Stowers ..... H01R 13/502
9,281,605 B2 * 3/2016 Boemmel ..... H01R 13/516
9,379,492 B2 * 6/2016 Zebhauser ..... H01R 12/724
9,647,378 B1 5/2017 Mingo
9,673,560 B2 * 6/2017 Iihoshi ..... H01R 13/514
9,979,123 B2 * 5/2018 Sekino ..... H01R 13/62
2010/0136847 A1 6/2010 Hung
2017/0040741 A1 * 2/2017 Droesbeke ..... H01R 13/426

* cited by examiner

CONNECTOR WITH DISPLACEMENT RESTRICTING MEMBER FOR LOCKING TO THE CONNECTOR HOUSING AND TO RESTRICT DISPLACEMENT OF THE TERMINAL UNIT

The present application is a divisional application of U.S. patent application Ser. No. 16/216,224, filed Dec. 11, 2018, the contents of which are hereby incorporated by reference in their entirety.

BACKGROUND

Field of the Invention

The invention relates to a connector.

Related Art

Japanese Unexamined Patent Publication No. 2004-55470 discloses a connector used in an in-vehicle LAN (Local Area Network). A wiring harness for in-vehicle LAN is configured by bundling a communication wire having a noise countermeasure taken therefor such as a twisted pair cable and a power supply wire for supplying power to a device such as a car navigation system.

Terminal fittings are mounted on end parts of these wires. Generally, a terminal fitting to be mounted on a communication wire and a terminal fitting to be mounted on a power supply wire are different. The terminal fitting of the communication wire is often longer than that of the power supply wire. Further, the terminal fitting of the communication wire is accommodated in a terminal holding member made of resin to form a terminal unit that is inserted and mounted into a connector housing from behind.

The above-described terminal holding member is configured by vertically uniting and assembling a lower case and an upper case. With the terminal unit mounted in the connector housing, a rear side of the terminal unit projects rearward from the rear wall of the connector housing. Thus, for example, if the communication wire is pulled up, the upper case receives a lifting force and may be detached from the lower case. Further, if the upper case is not detached, the rear side of the terminal holding member may be deformed upward.

The invention was completed on the basis of the above situation and aims to avoid the deformation of a terminal holding member even if a pull-up force acts on a wire.

SUMMARY

One aspect of the invention relates to a connector, comprising: a connector housing including at least one terminal accommodation chamber and at least one accommodation recess. A first terminal fitting is to be inserted into the terminal accommodation chamber. One or more second terminal fittings are to be connected to wires of a twisted pair cable. The connector further includes a terminal holding member that is capable of accommodating the second terminal fittings. A terminal unit includes the second terminal fitting(s) connected to the wire and the terminal holding member that accommodates the second terminal fitting(s). A rear part of the terminal holding member projects rearward from the connector housing when the terminal unit is mounted into the accommodation recess. A displacement restricting member is provided at least on one of the connector housing and the terminal holding member. The displacement restricting member is locked to the other of the connector housing and the terminal holding member to restrict a displacement of the terminal unit when the terminal unit is mounted into the accommodation recess.

The terminal holding member may comprise a body and a cover. The terminal holding member is capable of accommodating the second terminal fitting(s) with the body and the cover united.

The displacement restricting member may include a base to be mounted on a part of the terminal holding member projecting from the connector housing and a positioning portion provided on the base and configured to restrict a displacement of the terminal unit. The positioning portion may be positioned and fit into a receiving portion provided in the connector housing when the terminal unit is accommodated into the accommodation recess with the displacement restricting member mounted. Accordingly, the displacement restricting member can be mounted on the terminal holding member, and the terminal unit can be fit into the accommodation recess with the displacement restricting member mounted. Thus, if the displacement restricting member is newly provided, there is an effect that the exiting terminal unit can be utilized as it is.

The connector housing may be formed with at least one deflectable lock arm, and the accommodation recess is open and communicates with a deflection space for the lock arm. Thus, the accommodation recess is positioned so that the terminal unit is not displaced toward the deflection space even without providing a partition wall for the deflection space for the lock arm. Thus, a dimension of the connector can be made smaller by as much as a thickness of the partition wall. This is particularly effective when an installation space for the connector is restricted in a deflecting direction of the lock arm.

The base may include two side walls deflectable in expanding directions and mountable to straddle the terminal holding member with the side walls at least partly restored after being deflected and deformed with respect to the terminal holding member. Locking projections may be formed on inner surfaces of the side surface wall and are configured to restrict detachment of the displacement restricting member from the terminal holding member by locking the terminal holding member.

At least parts of the side walls may contact an inner wall of the accommodation recess to prevent the opening of the side walls when the terminal unit is fit into the accommodation recess. More particularly, when the terminal unit is fit into the accommodation recess, at least parts of the side walls face and contact the inner wall of the accommodation recess, i.e. the side walls can be held with the opening thereof prevented. Thus, the locking projections may be kept locking the terminal holding member, and the displacement restricting member can be retained reliably on the terminal holding member.

The displacement restricting member may include a lock configured to retain the terminal unit by locking the connector housing when the terminal unit is mounted into the accommodation recess. Accordingly, when the terminal unit is mounted into the accommodation recess, the lock of the displacement restricting member locks the connector housing to help retain the displacement restricting member.

The lock may include a claw on or near a tip. The lock may be formed integrally or unitarily to deflect in the displacement restricting member. The claw resiliently locks a lock receiving portion provided in the connector housing as the terminal unit is mounted into the accommodation recess. Thus, when the terminal unit is mounted into the accommodation recess, the claw resiliently locks the lock receiving portion. Therefore, a tactile feeling of locking is obtained and the completion of an operation can be known.

The displacement restricting member may include at least one swing preventing portion substantially extending toward the connector housing, and a front end part of the swing preventing portion in a mounting direction can fit to at least one swing prevention receiving portion provided to substantially face the swing preventing portion in the mounting direction in the connector housing in a convex-concave manner when the terminal unit is mounted into the accommodation recess. Accordingly, when the terminal unit is mounted into the accommodation recess, the swing preventing portion and the swing prevention receiving portion are fit in a convex-concave manner. Since the swing of the terminal unit is restricted in the direction intersecting the mounting direction in this way, a situation where the terminal holding member is deformed as the cable is swung can be restricted more reliably.

According to the invention, when the terminal unit is mounted into the accommodation recess, the displacement restricting member provided on either one of the connector housing and the terminal holding member is locked to the other. Thus, the terminal unit is held in a state where a displacement is restricted. Accordingly, even if an external force acts on the twisted pair cable in a direction intersecting with a wiring direction, a displacement of the terminal unit is restricted. Thus, the deformation of the terminal holding member can be effectively avoided against the above external force.

These and other features of the invention will become more apparent upon reading the following detailed description and accompanying drawings. Even though embodiments are described separately, single features thereof may be combined to additional embodiments.

DETAILED DESCRIPTION

Next, first to seventh specific embodiments of the invention are described with reference to the drawings.

First Embodiment

Figure 1:
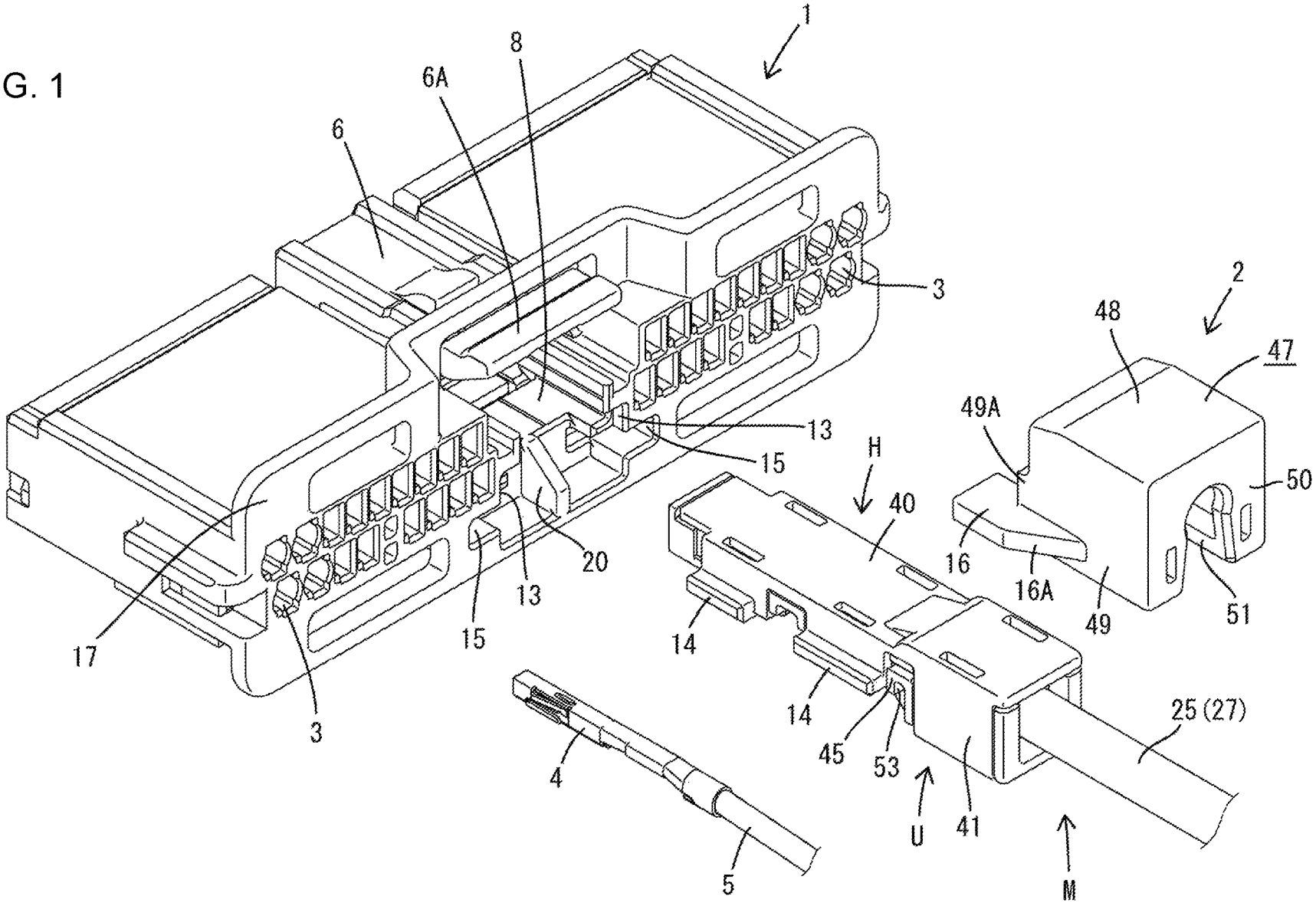
FIG. 1 is an exploded perspective view showing a connector housing, a terminal module and the like in a first embodiment.

FIGS. 1 to 13 show the first embodiment of the present invention. As shown in FIG. 1, a connector of the first embodiment includes a connector housing 1, a terminal unit U and a displacement restricting member 2. Note that, in the following description, the definition of "upper and lower" sides and "front and rear" sides are based on FIG. 1, upper and lower sides in FIG. 1 are referred to as "upper" and "lower" sides, an oblique left-upper side in FIG. 1 is referred to as a "front" side and an oblique right-lower side is referred to as a "rear" side.

<Connector Housing: Mainly See FIGS. 1 to 4>

The connector housing 1 is made of synthetic resin and has a flat shape having a width larger than a height. Protruding walls 17 protrude up or down from both upper and lower surfaces of the connector housing 1 on the rear end surface of the connector housing 1. These protruding walls 17 are flush with the rear end surface of the connector housing 1.

Terminal accommodation chambers 3 are formed inside the connector housing 1. As shown in FIG. 1, the terminal accommodation chambers 3 are arranged separately on both widthwise sides. A first terminal fitting 4 is inserted into each terminal accommodation chamber 3 from behind the connector housing 1. Each first terminal fitting 4 is connected to an end part of a first wire 5 having no noise countermeasure taken therefor. The inserted first terminal fitting 4 is retained by being locked by a locking lance 54 (see FIG. 13) formed in each terminal accommodation chamber 3.

A deflectable lock arm 6 is formed in a widthwise central part of an upper surface side of the connector housing 1. The lock arm 6 is in the form of a plate having a plate thickness direction aligned vertically. The lock arm 6 is cantilevered rearward from a front end part serving as a deflection supporting point. A space below the lock arm 6 (or between the lock arm 6 and the connector housing 1) serves as a deflection space 7 when connectors are unlocked.

Figure 3:
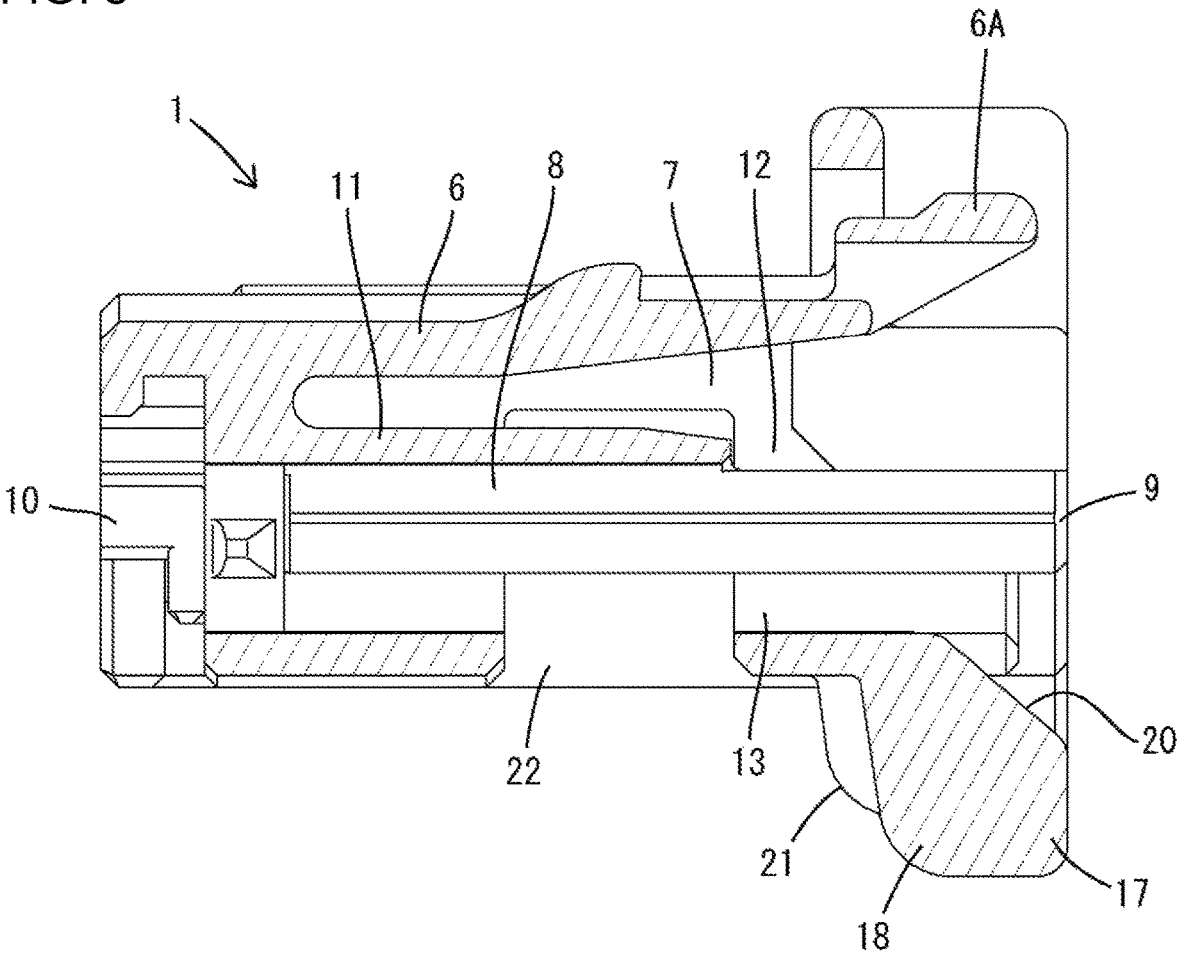
FIG. 3 is a section along A-A of FIG. 2.
Figure 11:
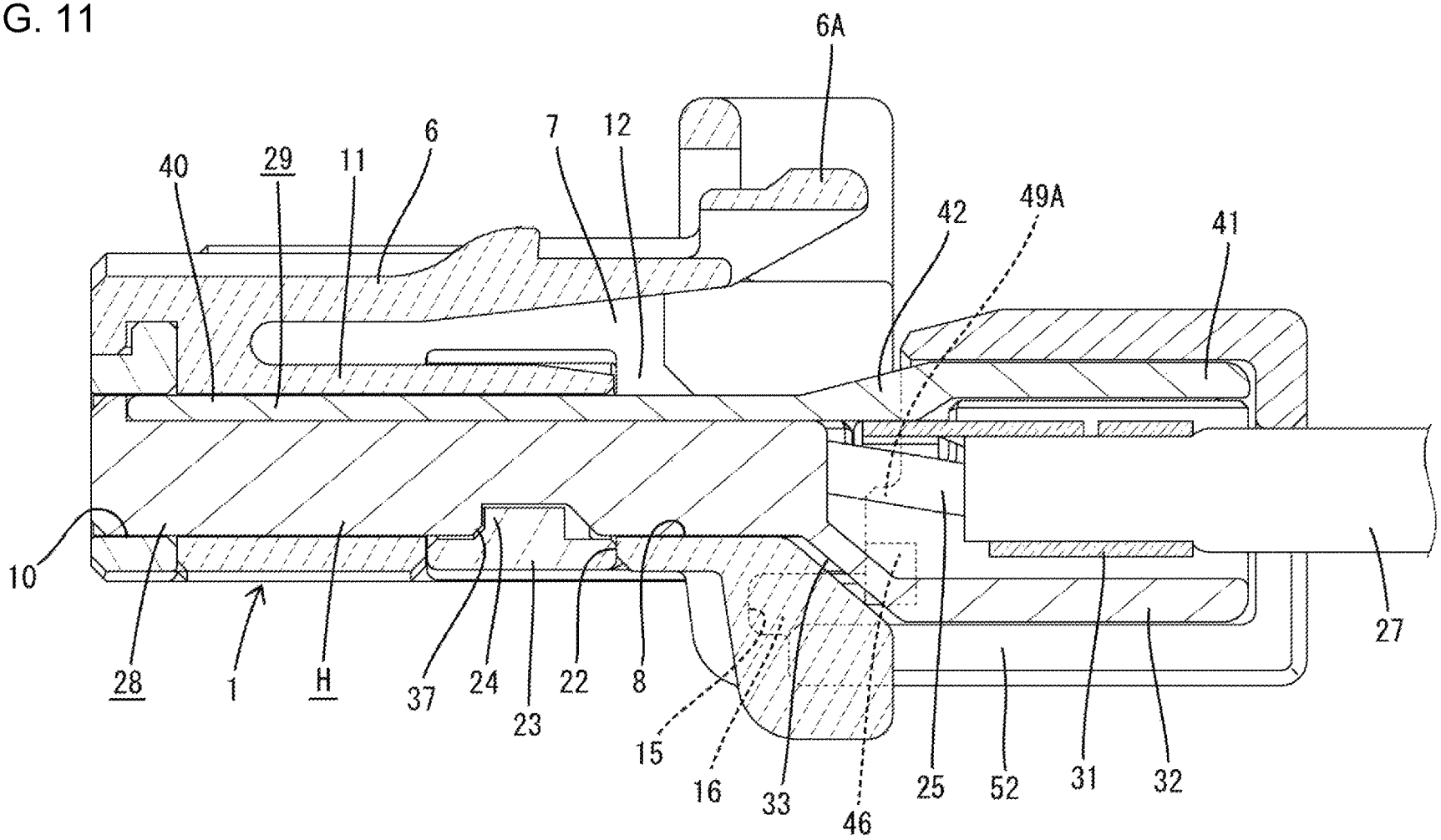
FIG. 11 is a section along D-D of FIG. 10.

An accommodation recess 8 for accommodating a front side of the terminal unit U is disposed in a widthwise central part of the connector housing 1 and below the lock arm 6. As shown in FIGS. 3 and 11, the accommodation recess 8 is long and narrow in a front-rear direction (inserting direction of the first terminal fittings 4) and is open in both front and rear surfaces of the connector housing 1. An insertion opening 9 is on a rear end of the accommodation recess 8 and can receive the front of the terminal unit U and a lower part of a front end of the displacement restricting member 2 are inserted. As shown in FIG. 3, a front end part of the accommodation recess 8 is open as a fitting opening 10 in the front end surface of the connector housing 1. When the terminal unit U is mounted into the accommodation recess 8, the front end surface of a terminal holding member H is located in the fitting opening 10, as shown in FIG. 11.

As shown in FIGS. 3 and 11, an area on a front end of the upper surface of the accommodation recess 8 is covered by an upper wall 11 constituting the upper surface of the connector housing 1. A formation range of the upper wall 11 in the front-rear direction is an area that does not interfere with the lock arm 6 even if the lock arm 6 is deflected and deformed. On the other hand, an area on a rear end of the upper surface of the accommodation recess 8 is open upward over the entire width to form an opening 12 that communicates with the deflection space 7 for the lock arm 6. A formation area of this opening 12 in the front-rear direction is a range from the rear end of the upper wall 11 to the rear end of the accommodation recess 8 (rear end of the connector housing 1). An area where this opening 12 is formed includes an area closest to a rear end side of the lock arm 6 when the lock arm 6 is deflected and deformed.

Figure 2:
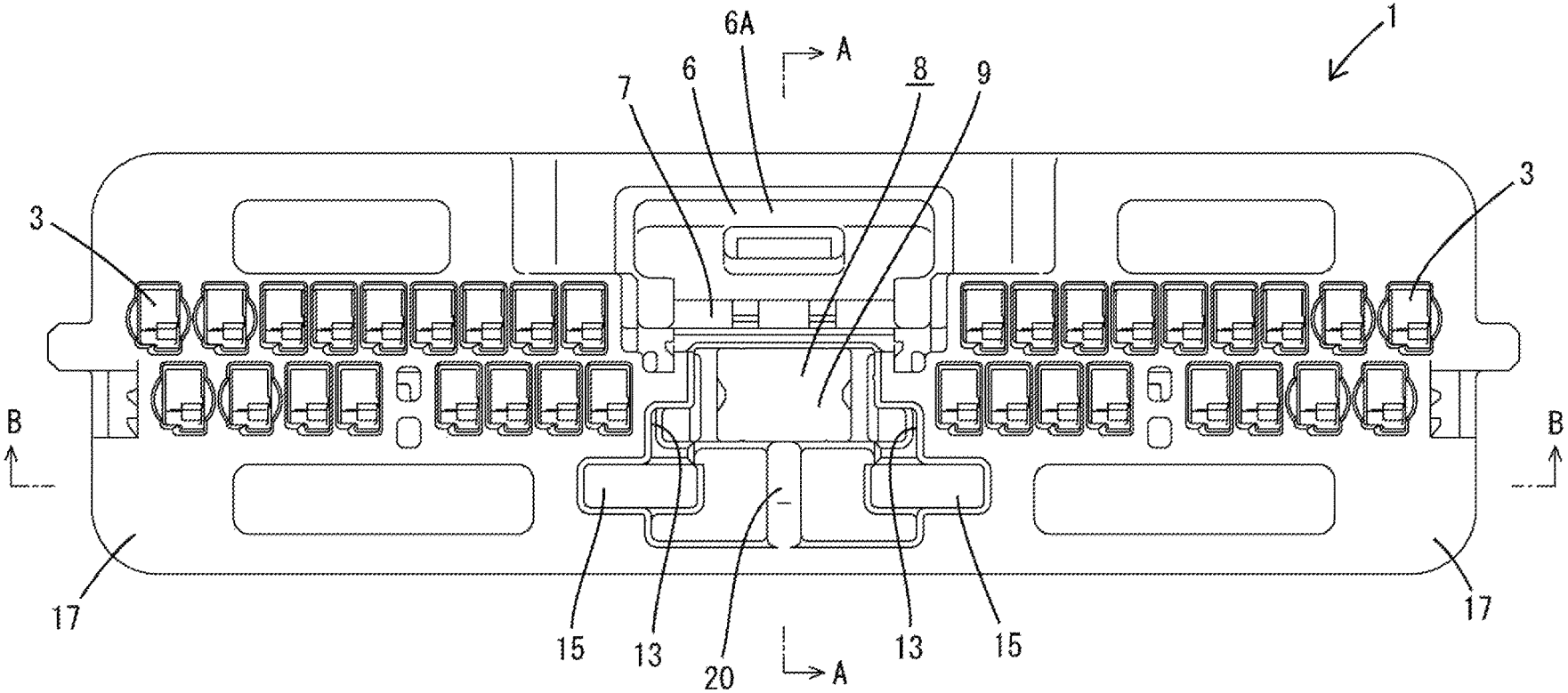
FIG. 2 is a front view of the connector housing.

As shown in FIG. 2, left and right guide grooves 13 are formed in both left and right inner side surfaces of the accommodation recess to open rearward and inward in a width direction. The guide grooves 13 are for guiding guide ribs 14 of the terminal holding member H and extend in the front-rear direction (along a mounting direction of the terminal unit U into the connector housing 1).

As shown in FIG. 2, left and right receiving portions 15 protrude laterally out at positions below the insertion opening 9 of the accommodation recess 8 in the rear end surface of the connector housing 1. The receiving portions 15 position the terminal unit U by having positioning portions 16 of the displacement restricting member 2 inserted therein.

A center projection 18 projects in a widthwise central part of the lower surface of the connector housing 1 and can be connected to front surfaces of the protruding walls 17. A lower part of a front end part of the displacement restricting member 2 including flange edges 19 is accommodated in the center projecting portion 18. A center rib 20 is provided vertically in a widthwise central part in the center projecting portion 18. As shown in FIG. 1, the center rib 20 is a flat plate connected to a front wall in the center projection 18 and is formed to gradually reduce a height toward a rear side.

Figure 4:
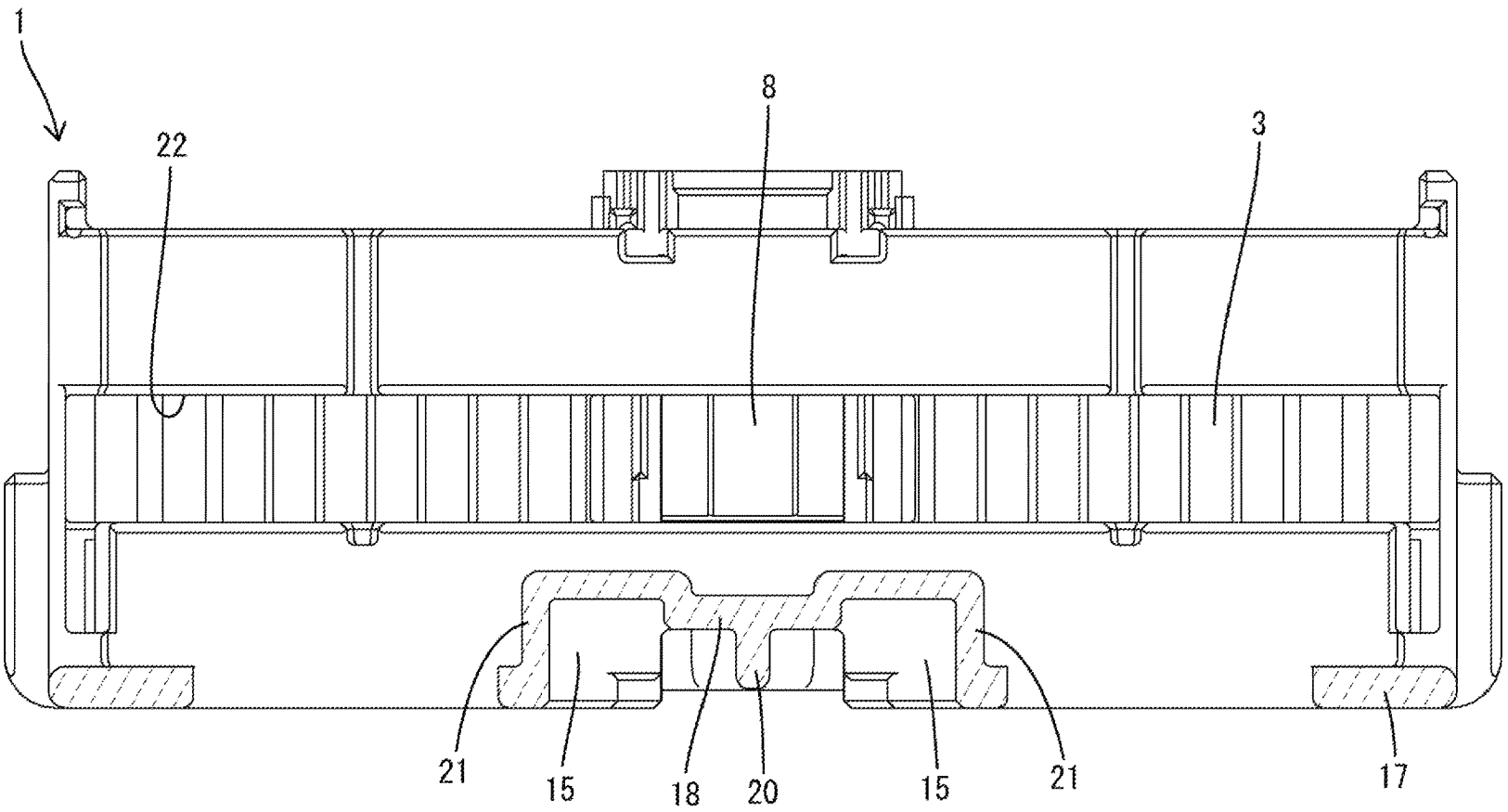
FIG. 4 is a section along B-B of FIG. 2.
Figure 5:
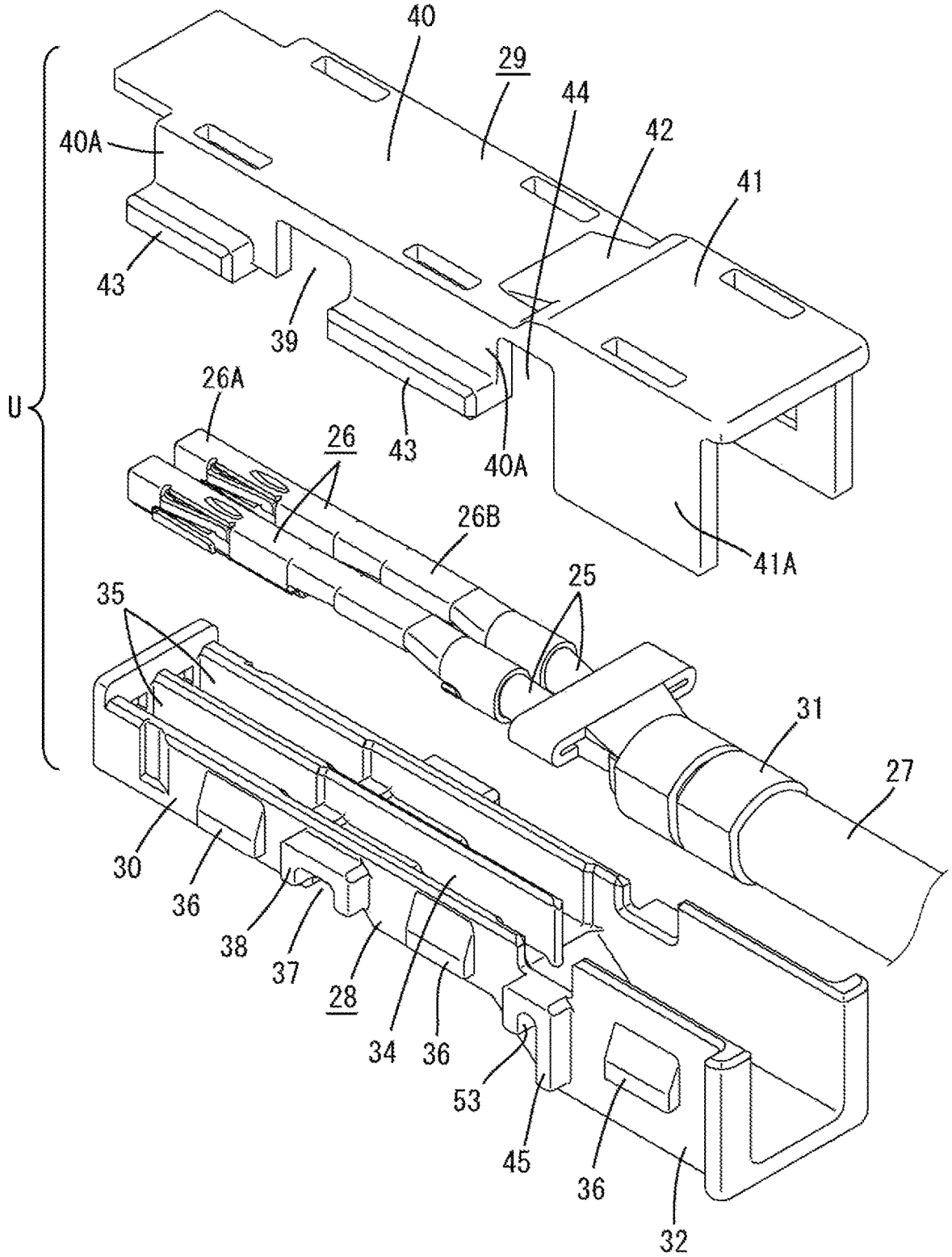
FIG. 5 is an exploded perspective view of a terminal unit.
Figure 13:
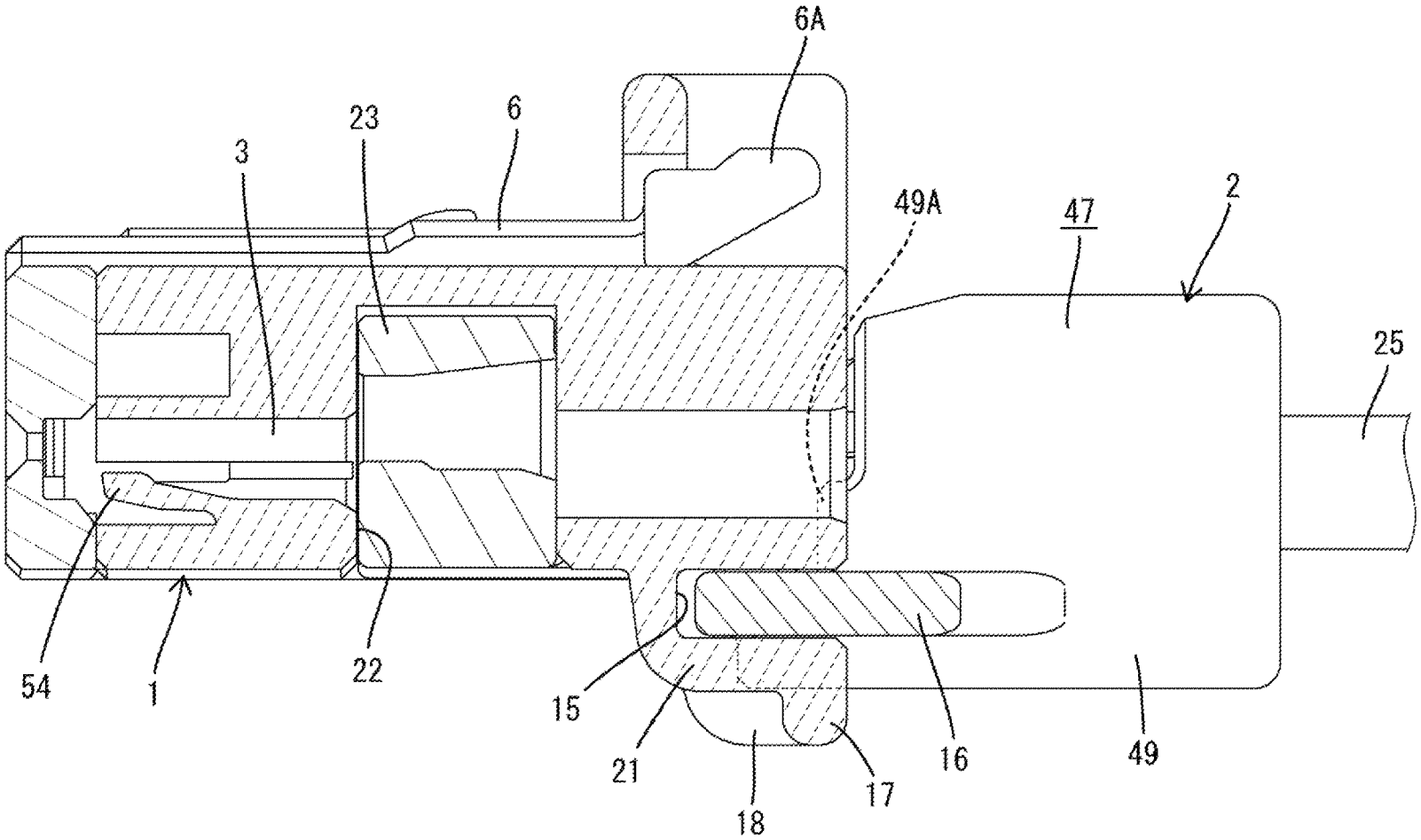
FIG. 13 is a section along F-F of FIG. 10.
Figure 14:
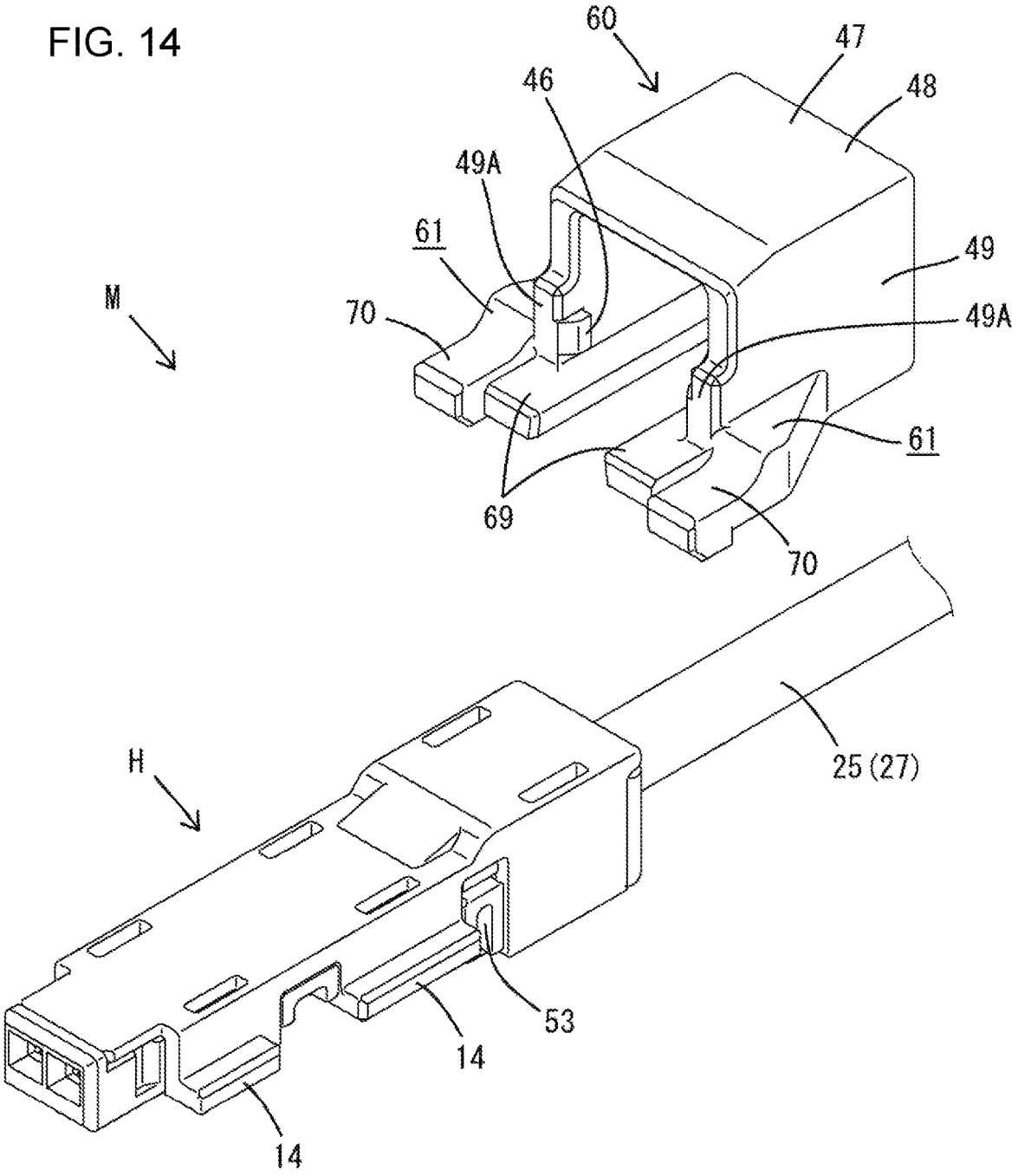
FIG. 14 is an exploded perspective view of a terminal module in a second embodiment.

Left and right side projecting portions 21 project at opposite sides of the above center projection 18 in the width direction on the lower surface of the connector housing 1 (see FIGS. 4, 13 and the like). As shown in FIG. 13, the side projections 21 have a lower projection height than the center projection 18. The insides of the side projections 21 and that of the center projection 18 communicate with each other.

The receiving portions 15 are formed respectively in the side projections 21. As shown in FIG. 2, the receiving portion 15 is a groove having a rectangular cross-section longer in the lateral direction than in the vertical direction.

The receiving portion 15 is open in the rear end surface of the connector housing 1. As shown in FIGS. 4 and 13, the receiving portion 15 has a closed front end. The receiving portion 15 is open inward in the width direction and rearward, and other surfaces, i.e. the front end surface, upper and lower surfaces and a widthwise outer side, are surrounded by walls of the center projection 18 and the side projection 21. As shown in FIG. 1 and the like, the center rib 20 is in the widthwise central part in the center projection 18. The center rib 20 is connected between the rear end of the lower surface of the accommodation recess 8 and a lower surface in the center projection 18, and laterally divides a space in the center projecting portion 18. The rear end edge of the center rib 20 is inclined down except at a lower end part.

As shown in FIGS. 3 and 4, a retainer insertion hole 22 is open along the width direction in a substantially central part of the lower surface of the connector housing 1 in the front-rear direction. The retainer insertion hole 22 is formed substantially over the entire width range of the connector housing 1.

The retainer insertion hole 22 communicates with each terminal accommodation chamber 3 and the accommodation recess 8. A retainer 23 to be inserted into the retainer insertion hole 22 is mounted at a full locking position and a partial locking position where an insertion depth is shallower than at the full locking position. When the retainer 23 is at the partial locking position, locking function portions formed in the retainer 23 and shown in FIG. 11 are waiting at positions retracted from the respective terminal accommodation chambers 3 and the accommodation recess 8.

Thus, the first terminal fittings 4 and the terminal unit U can be freely inserted into and withdrawn from the respective terminal accommodation chambers 3 and the accommodation recess 8. However, when the retainer 23 is further pushed from the partial locking position to reach the full locking position, the locking function portions 24 enter the respective terminal accommodation chambers 3 and the accommodation recess 8 to lock the respective first terminal fittings 4 and the terminal holding member H of the terminal unit U and hold these in a retained state.

<Terminal Unit U: Mainly See FIG. 5>

Next, the terminal unit U is described. The terminal unit U is composed of a second wires 25, second terminal fittings 26 connected to an end part of the second wires 25 and the terminal holding member H for accommodating the second terminal fittings 26. The terminal unit U is inserted into the accommodation recess 8 from behind the connector housing 1.

Each second wire 25 is configured such that two wires (twisted pair cable) are collectively surrounded by a sheath 27. Each second wire 25 is used as a communication wire (signal wire) and constitutes the twisted pair cable having a noise reduction function by spirally twisting the two wires.

Each second terminal fitting 26 is long and narrow in the front-rear direction and is longer than the first terminal fitting 4. A front side of the second terminal fitting 26 is a rectangular tubular terminal body 26A, and a barrel 26B is formed in a rear end part of the second terminal fitting 26. Each second wire 25 is exposed a predetermined length from an end of the sheath 27 and connected to the terminal body 26A by crimping the barrel 26B of the second terminal fitting 26 to a core exposed by stripping an insulation coating of this exposed part.

The terminal holding member H is configured by vertically uniting and assembling a lower case 28 and an upper case 29 both made of synthetic resin.

The lower case 28 has a bottom surface and both side surfaces and is open upward and rearward. A front side of the lower case 28 serves as a terminal accommodating portion 30 for accommodating the second terminal fittings 26, and a side thereof behind the terminal accommodating portion 30 serves as a sheath accommodating portion 32 for accommodating a crimping portion 31 crimped to the sheath 27 of the second wire 25. As shown in FIG. 11, the sheath accommodating portion 32 has a higher height than the terminal accommodating portion 30 and is connected to the lower surface of the terminal accommodating portion 30 via an inclined surface 33.

An intermediate wall 34 rises along a length direction in a widthwise central part of a bottom surface in the terminal accommodating portion 30. The intermediate wall 34 laterally divides the inside of the terminal accommodating portion 30, and each divided section serves as a terminal accommodation groove 35. The second terminal fittings 26 are accommodated into the respective terminal accommodation grooves 35 from above. Although not shown in detail, the respective second terminal fittings 26 are accommodated while being locked to a bottom surface side of the lower case 28 and retained not to come out rearward in the lower case 28.

Three pairs of lock protrusions 36 are provided on both left and right side surfaces of the lower case 28. Two pairs of the lock protrusions 36 are provided on both left and right outer side surfaces of the terminal accommodating portion 30 while being spaced apart in the front-rear direction, and one pair of the lock protrusions 36 is provided on both left and right outer side surfaces of the sheath accommodating portion 32.

A groove 37 is formed by recessing over the entire width on an outer side of the bottom surface in the terminal accommodating portion 30 and between both front and rear lock protrusions 36. This groove 37 faces along an opening surface of the retainer insertion hole 22 when the terminal unit U is mounted into the accommodation recess 8 of the connector housing 1 (see FIG. 11). When the retainer 23 reaches the full locking position in this way, the retainer 23 can be locked to the groove 37 to retain the terminal unit U. Left and right front arches 38 protrude in parts located on both left and right ends of the groove 37 on the left and right outer side surfaces of the terminal accommodating portion 30 and open down and toward both sides in the width direction. The insides of the front arche 38 align with the recessed groove 37 in the width direction.

When the terminal holding member H is united, the front arches 38 are fit into cut windows 39 respectively provided at corresponding positions of the upper case 29 to prevent a displacement of the upper case 29 in the front-rear direction.

Left and right rear arches 45 protrude out in the width direction on both outer side surfaces of the lower case 28 and between the center lock protrusions 36 and the rear lock protrusions 36. The rear arches 45 are formed with latching grooves 53 that open down and are recessed out in the width direction.

The upper case 29 is composed of a terminal cover 40 for covering the terminal accommodating portion 30 of the lower case 28 and a sheath cover 41 for covering the sheath accommodating portion 32. Both the terminal cover 40 and the sheath cover 41 have upper walls. The upper wall of the sheath cover 41 and the upper wall of the terminal cover 40 are connected via an inclined surface 42 inclined up toward a rear side. Side walls extend down from both left and right side edges of the upper walls of both the terminal cover 40 and the sheath cover 41. In this way, the entire upper case 29 is open both forward rearward and downward.

A total of two pairs of side walls 40A of the terminal cover 40 are provided separately on front and rear sides, and two side walls 41A are provided in the sheath cover 41. A total of three pairs of lock recesses (not shown) lockable to the respective lock protrusions 36 are recessed in the inner surfaces of the respective side walls 40A, 41A. These lock protrusions 36 and the unillustrated lock recesses are locked to unite the upper and lower cases 28, 29.

The side walls 40A on the front side of the terminal cover 40 are wider in the front-rear direction than the side walls 40A on the rear side. Guide ribs 43 protrude out on the lower edges of the respective side walls 40A on the front and rear sides. As described above, in mounting the terminal unit U into the connector housing 1, the respective guide ribs 43 are inserted along the guide grooves 13 of the connector housing 1, thereby exhibiting a function of guiding the insertion and/or stabilizing the orientation of the terminal unit U. Note that the guide ribs 43 on the rear side are provided over the entire lower edges of the side walls 40A on the rear side. However, the guide ribs 43 on the front side are formed from front end parts of the lower edges of the side walls on the front side, but formed in a range not reaching the opening edges of the cut windows.

Left and right arch receiving portions 44 are open downward between the side walls 40A on the rear side of the terminal cover 40 and the side walls 41A of the sheath cover 41. These arch receiving portions 44 are fit at corresponding positions of the lower case 28, i.e. fit to the rear arches 45 that protrude on the outer side surfaces between the terminal accommodating portion 30 and the sheath accommodating portion 32. In this way, the united terminal holding member H is held in a state positioned in the front-rear direction in cooperation with the fitting of the front arches 38 and the cut windows 39. Further, the latching grooves 53 formed in the rear arches 45 are locked to latching projections 46 of the displacement restricting member 2 to be described later and position the displacement restricting member 2 in the front-rear direction with respect to the terminal holding member H when the displacement restricting member 2 is mounted on the terminal unit U.

Figure 12:
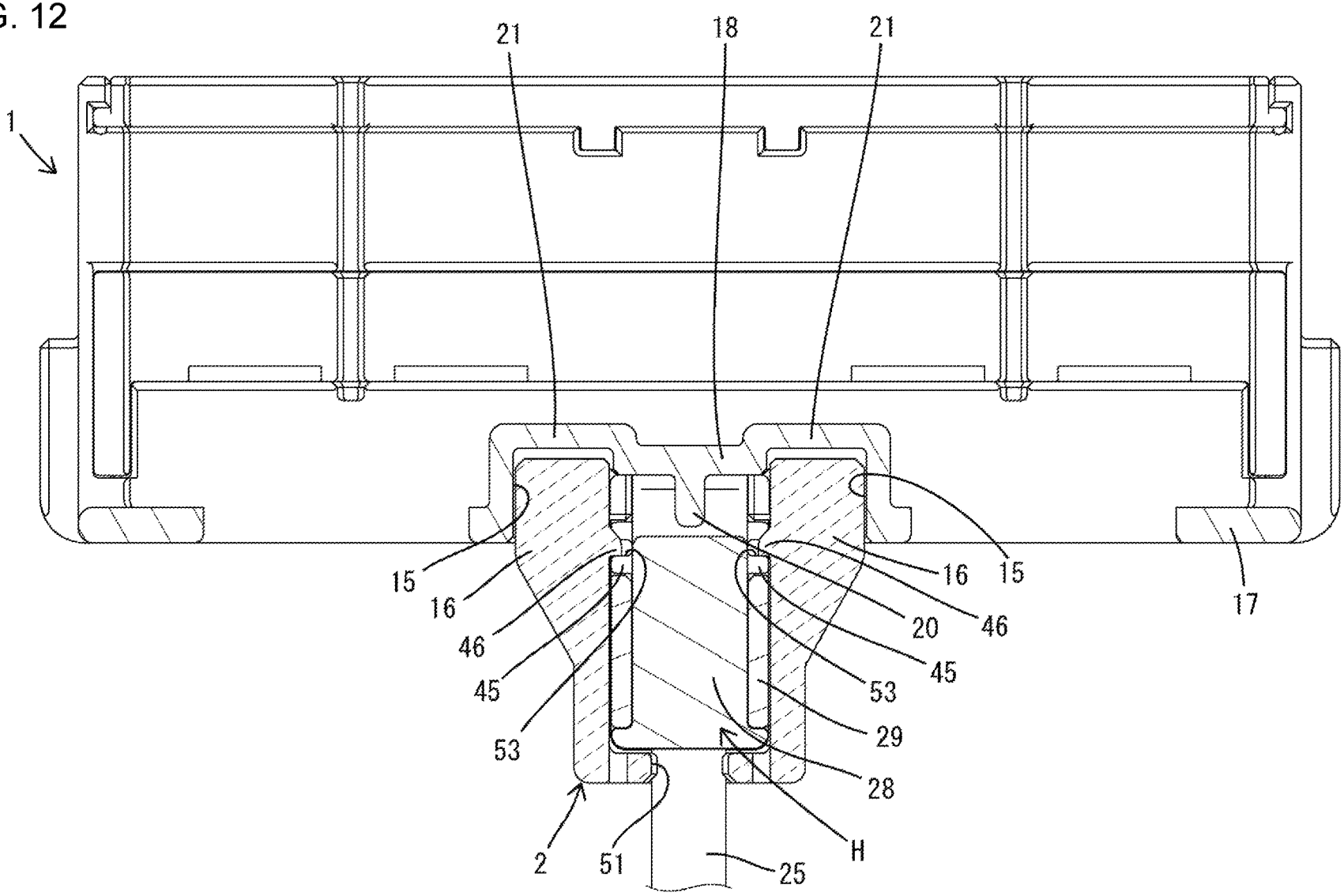
FIG. 12 is a section along E-E of FIG. 10.

When the terminal unit U is mounted into the accommodation recess 8 of the connector housing 1, a rear end part of the terminal unit U projects rearward from the rear end surface of the connector housing 1 over a predetermined range. Specifically, the sheath accommodating portion 32 and the sheath cover 41 of the terminal holding member H project as shown in FIGS. 11 to 13.

<Displacement Restricting Member 2, Terminal Module: Mainly See FIGS. 1, 6 and 8>

The displacement restricting member 2 is made of synthetic resin and is mounted on a part (sheath accommodating portion 31 and sheath cover 41) of the terminal holding member H projecting rearward from the connector housing 1 when the terminal unit U is mounted into the accommodation recess 8. The displacement restricting member 2 constitutes a terminal module M together with the terminal unit U with the displacement restricting member 2 mounted on the terminal unit U.

The displacement restricting member 2 includes a base 47 to be mounted on the terminal holding member H. The base 47 has an upper wall 48, two side walls 49 extending down from left and right edges of the upper wall 48 and a back wall 50. The base 47 is open forward, rearward and down. The side walls 49 can resiliently deform and expand out in the width direction.

A wire insertion groove 51 for allowing the insertion of a sheath of the second wire 25 is open in the back wall 50. An upper end part of the wire insertion hole 51 is substantially circular and serves as a wire holding portion 51A for holding the somewhat press-fit second wire 25. A wire introducing portion 51B is formed below the wire holding portion 51A to communicate with the wire holding portion 51. The wire introducing portion 51B gradually expands toward a lower side, and a lower end is open downward. Lower parts of the front end edges of the left and right side walls 49 project forward in a stepped manner, thereby forming steps 49A. These steps 49A are located substantially on the same lines as the front and rear guide ribs 14 of the terminal holding member H in the front-rear direction with the displacement restricting member 2 mounted on the terminal holding member H, and the upper surfaces thereof are set substantially at the same level as the front and rear guide ribs 14 in a height direction. When the terminal holding member H is mounted into the accommodation recess 8, the upper end surfaces of the steps 49A contact the ceiling surfaces of entrance parts of the guide grooves 13, thereby contributing as latches to prevent an upward movement of the displacement restricting member 2 with respect to the connector housing 1.

The displacement restricting member 2 is mounted on the terminal unit U as follows. The displacement restricting member 2 is positioned to straddle the second wire 25 from above behind the terminal unit U. In this case, the second wire 25 is inserted through a lower opening of the wire introducing portion 51B in the wire insertion groove 51 and directly press-fit and held in the wire holding portion 51A. The displacement restricting member 2 then is displaced forward along the second wire 25 to mount the displacement restricting member 2 on the terminal holding member H.

Figure 8:
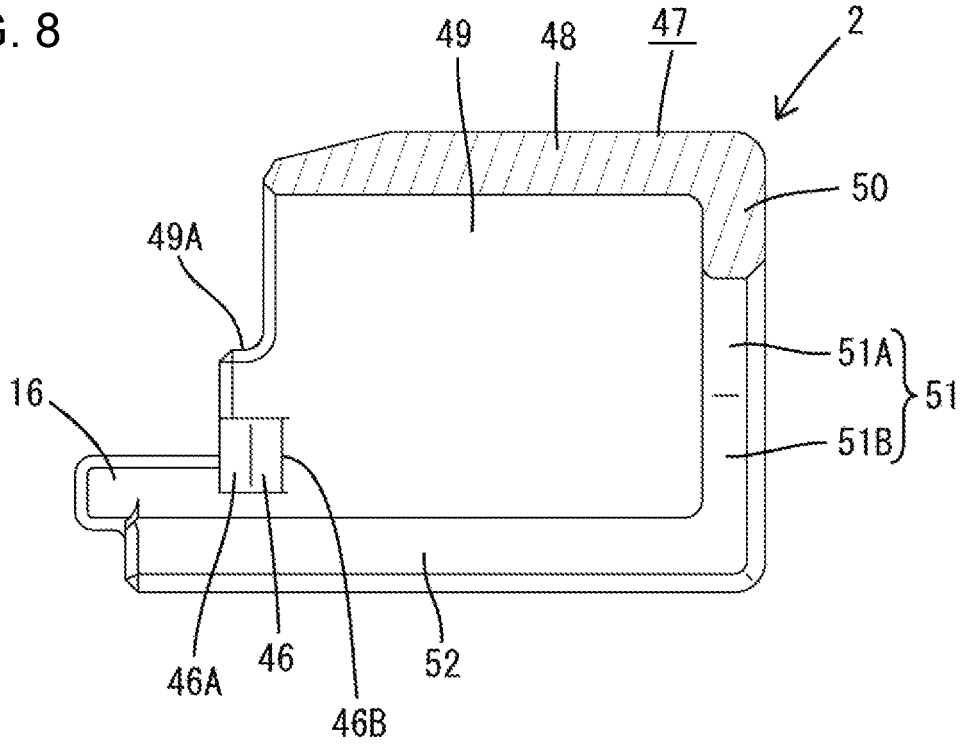
FIG. 8 is a section along C-C of FIG. 7.
Figure 9:
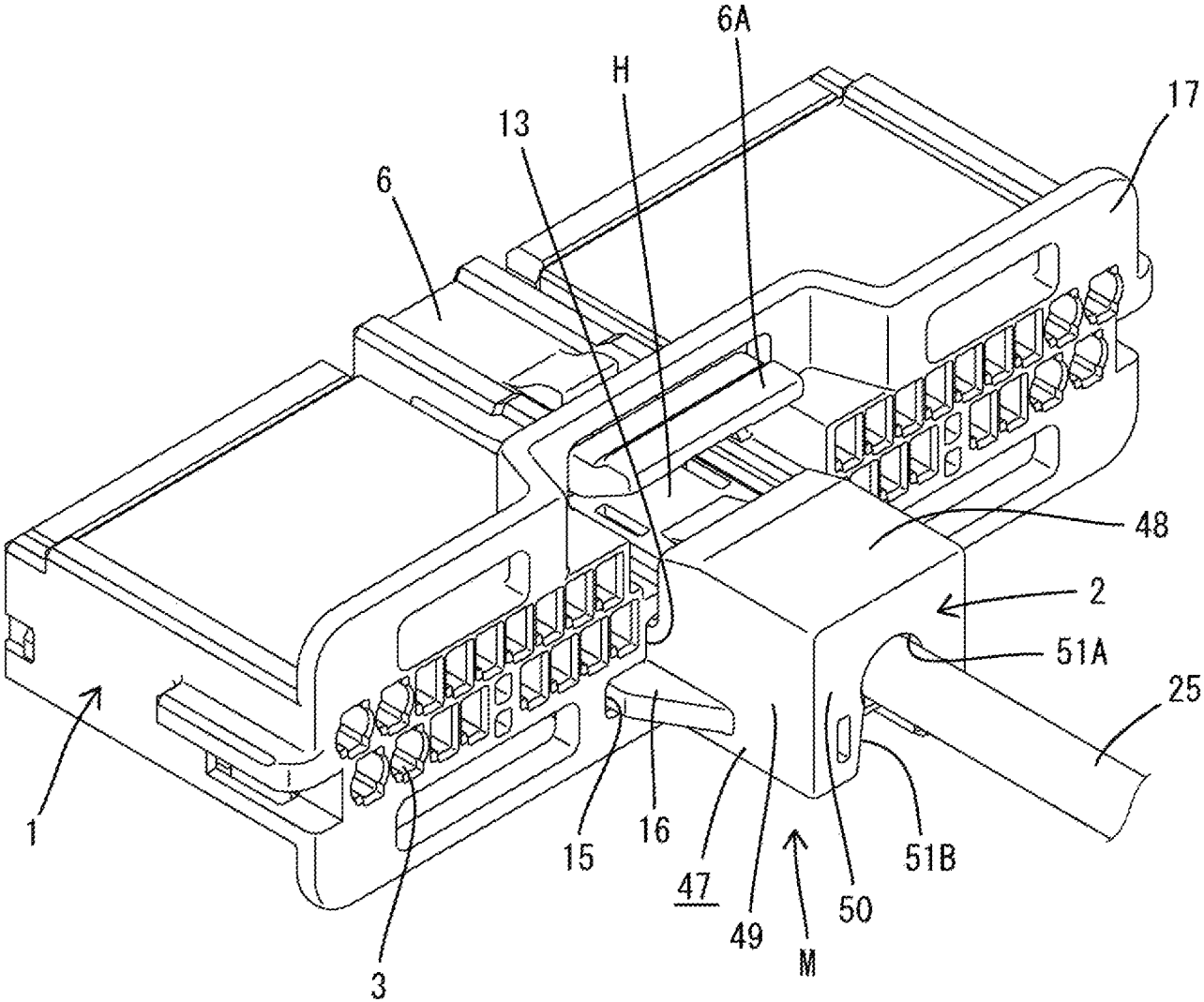
FIG. 9 is a perspective view showing an entire connector in a state where the terminal module is mounted in the connector housing.
Figure 10:
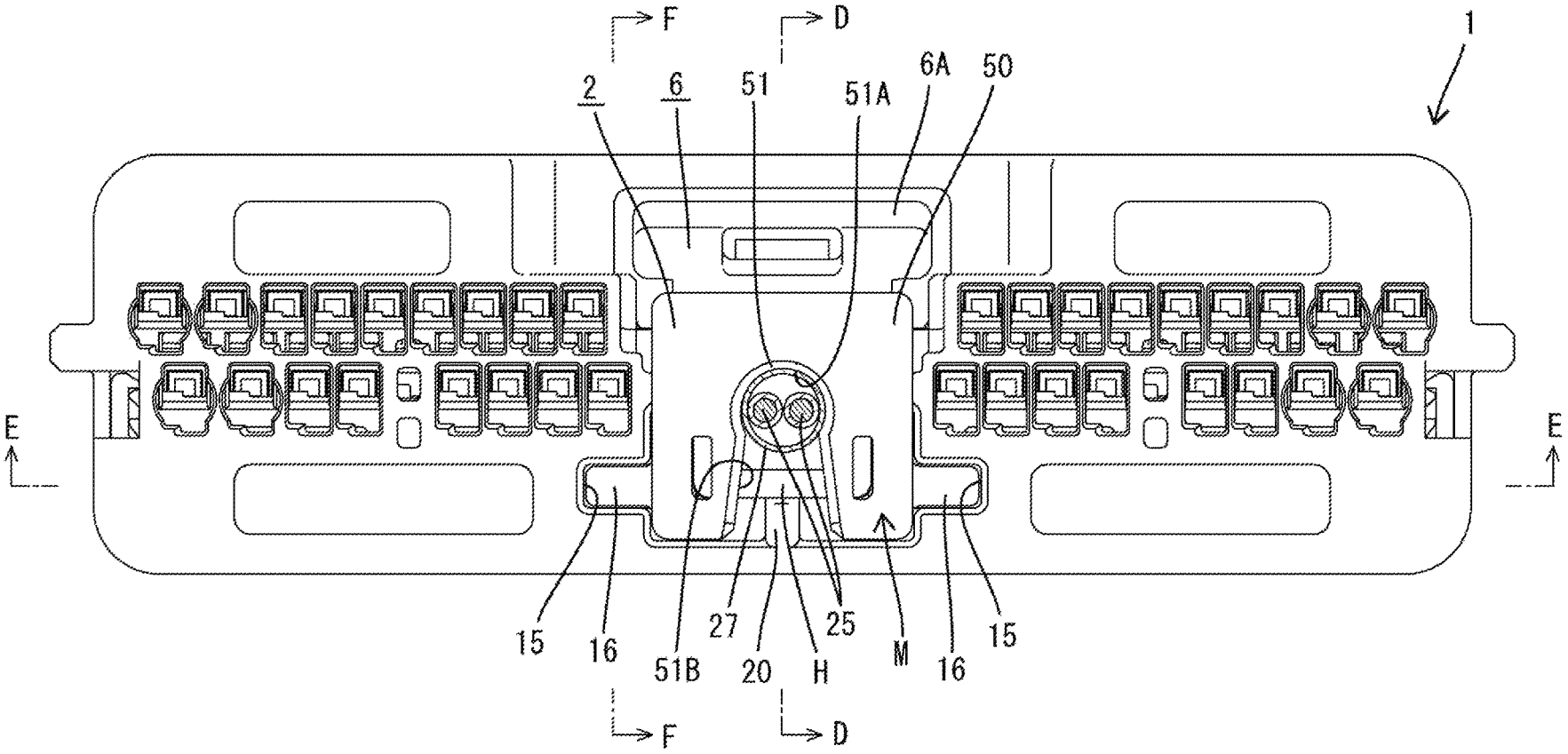
FIG. 10 is a front view of the entire connector showing the state of FIG. 9.

Left and right flanges 52 protrude inward in the width direction on the lower edges of the inner surfaces of the side surface walls 49 in the base 47. As shown in FIG. 8, the flange edges 52 extend over the entire ranges from the rear edges to the front edges of the side walls 49 and, in addition, extend farther forward from the front ends of the side walls 49.

Left and right latching projections 46 project inward at positions slightly above the flanges 52 on the front ends of the inner surfaces of the side walls 49. The front surfaces of the latching projections 46 are formed into expanded guiding inclined surfaces 46A for the side walls 49 and are inclined to gradually increase an inward projecting amount in the width direction, and the rear end surfaces thereof form vertical latching surfaces 46B facing rearward.

In mounting the displacement restricting member 2 on the terminal holding member H, the displacement restricting member 2 is displaced forward while the side walls 49 are expanded outward in the width direction. At this time, the latching projections 46 are displaced forward while sliding in contact with the outer side surface of the sheath cover 41. When the latching projections 46 pass through the sheath cover 41, the side walls 49 resiliently return. Associated with this, the latching projections 46 are fit into the latching grooves 53 to be locked to the latching surfaces 46B, and, in addition, the front end surfaces of the steps 49A contact the rear end surfaces of the rear guide ribs 43 of the upper case 29 so that the displacement restricting member 2 is mounted while being positioned in the front-rear direction with respect to the terminal holding member H.

Left and right positioning portions 16 are provided on front parts of the outer surfaces of the side walls 49 near lower edge parts. The positioning portions 16 function to restrict the deformation of the terminal unit U even if the second wire 25 is swung.

Figure 7:
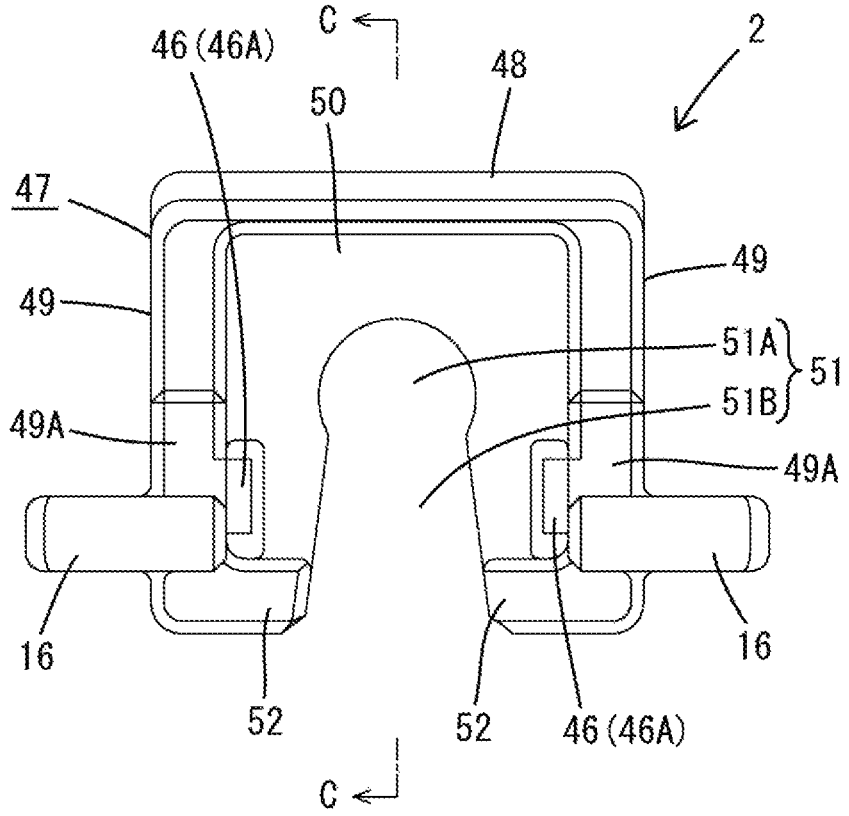
FIG. 7 is a back view of the displacement restricting member.

The positioning portions 16 protrude horizontally out in the width direction from the side walls 49. The positioning portions 16 are in the form of flat plates. As shown in FIGS. 7 and 8, the positioning portions 16 are provided at height positions higher than the flanges 52 to correspond to substantially halves of the latching projections 46. The rear ends of the positioning portions 16 are located substantially in middle parts of the side walls 49 in the front-rear direction and the positioning portions 16 extend horizontally forward from the rear ends. The front ends of the positioning portions 16 are forward of the side walls 49 and farther forward than the front ends of the flanges. Chamfers 16A are formed on rear end parts of the positioning portions 16 and form inclined surfaces to gradually reduce a width toward a rear side when viewed from above. Front end parts of the positioning portions 16 go around to the front end surfaces of the side walls 49 and are continuous with the front surfaces of the steps 49A, and connected also to parts of the upper surfaces of front end parts of the flanges 52.

As the terminal unit U is mounted into the accommodation recess 8, the positioning portions 16 of the displacement restricting member 2 are press-fit and inserted into the receiving portions 15. At this time, an area of the displacement restricting member 2 to be inserted into the connector housing 1 is an area substantially in front of parts with the chamfers 16A as shown in FIG. 12. A side behind this area projects rearward from the connector housing 1 and is exposed to outside.

With the positioning portions 16 inserted in the receiving portions 15, outer side edges (excluding the chamfers 16A) of the positioning portions 16 in the width direction are held in close contact with both side surfaces in the receiving portions 15 as shown in FIG. 12. In this way, the terminal module M is positioned in the width direction (lateral direction). That is, a thickness of the positioning portions 16 is slightly larger than an inner height of the receiving portions 15 in the connector housing 1. Thus, as shown in FIG. 13, both upper and lower surfaces of the positioning portions 16 are pressed into contact with both upper and lower surfaces in the receiving portions 15. In this way, the terminal module M is positioned in the vertical direction. Thus, the positioning portions 16 are press-fit and inserted in the receiving portions 15, and frictional forces generated in the receiving portions 15 act as retaining forces on the displacement restricting member 2.

Next, an assembling procedure of the connector of the first embodiment is described. In the connector housing 1, the retainer 23 is held at the partial locking position. In that state, each first terminal fitting 4 connected to the first wire 5 is inserted into the terminal accommodation chamber 3 from behind and temporarily held retained by being locked by the locking lance 54. After or prior to this operation, the terminal module M is mounted in the accommodation recess 8 and the receiving portions 15.

In the assembling of the terminal module U M, the second terminal fittings 26 connected to the second wire 25 are accommodated into the terminal accommodation grooves 35 of the lower case 28 in the terminal holding member H from above. Thereafter, the upper case 29 is put on the lower case 28 from above and the respective lock protrusions 36 and the corresponding unillustrated lock recesses are locked. Then, the upper and lower cases 28, 29 are held united. In this way, the assembling of the terminal unit U having the second terminal fittings 26 retained and accommodated is completed.

Subsequently, the displacement restricting member 2 is mounted on the terminal unit U. More particularly, the displacement restricting member 2 is caused to wait in a state straddling the second wire 25 behind the terminal unit U. At this time, the second wire 25 is held in the wire holding portion 51A of the wire insertion groove 51 of the displacement restricting member 2. In the above state, the displacement restricting member 2 is moved forward along the second wire 25, and the base 47 of the displacement restricting member 2 is fit outside the sheath cover 41 of the terminal holding member H. At this time, the sid walls 49 of the displacement restricting member 2 are expanded and deformed outward in the width direction and the latching projections 46 move forward while sliding in contact with the outer surface of the sheath cover 41. The displacement restricting member 2 moves forward until the latching projections 46 pass through the sheath cover 41. The side walls 49 then resiliently return so that the latching projections 46 are fit in and locked to the latching grooves 53. In this way, the displacement restricting member 2 is held positioned in the front-rear direction with respect to the terminal holding member H. Further, at this time, the ceiling surface in the displacement restricting member 2 is held in close contact with the upper surface wall 48 of the sheath cover 41 and the inner surfaces of the side walls 49 are held in close contact with the outer side surfaces of the side walls 49 of the sheath cover 41. That is, the displacement restricting member 2 is mounted to straddle the rear part (sheath cover 41) of the terminal holding member H to complete assembly of the terminal module M having the displacement restricting member 2 mounted on the terminal unit U.

Subsequently, the terminal module M is mounted into the connector housing 1. The front part of the terminal holding member H is fit in an entrance of the accommodation recess 8. During this time, the respective guide ribs 14 of the terminal holding member H are inserted and guided along the guide grooves 13 of the connector housing 1 so that the terminal module M is inserted smoothly into the connector housing 1.

Slightly before the terminal module M reaches a proper insertion position, the front parts of the positioning portions 16 of the displacement restricting member 2 reach the entrances of the receiving portions 15 of the connector housing 1. Further, while the terminal module M is inserted more deeply and until the terminal unit U reaches a proper insertion position, substantially front halves of the positioning portions 16 are press-fit into the receiving portions 15 while being guided by the receiving portions 15.

When the terminal module M reaches the proper insertion position, the front parts of the positioning portions 16 contact the front end surfaces in the receiving portions 15 to restrict any further insertion. Thus, the terminal module M is positioned at the proper insertion position. If the retainer 23 is displaced from the partial locking position to the full locking position in this state, the locking function portions 24 of the retainer 23 lock the respective first terminal fittings 4. Thus, the respective first terminal fittings 4 are retained doubly in cooperation with the locking lances 54. Further, since the retainer 23 having reached the full locking position is locked into the groove 37 of the terminal holding member H, as shown in FIG. 11, a situation where the terminal module M comes out rearward from the connector housing 1 also is restricted.

When the terminal module M is mounted into the accommodation recess 8 and the receiving portions 15 of the connector housing 1, the sheath accommodating portion 32 and the sheath cover 41 of the terminal holding member H project rearward from the connector housing 1. Thus, there conventionally has been concern about the terminal holding member H such as the detachment of the upper case 29 and the deformation of the projecting part of the terminal holding member M if the second wire 25 is swung (pulled) strongly in a direction intersecting a wiring direction as described above.

In the first embodiment, as a countermeasure, the base 47 is mounted on the projecting part of the terminal holding member H from the connector housing 1 and the positioning portions 16 extending forward from the base 47 are inserted into the receiving portions 15 of the connector housing 1. At this time, the outer side edges of the positioning portions 16 in the width direction are pressed into contact with the side wall surfaces in the receiving portions 15, as shown in FIG. 12. Thus, a displacement of the terminal module M in the width direction is restricted. Further, as shown in FIG. 13, the upper and lower surfaces of the positioning portions 16 are pressed into contact with the ceiling surfaces and the lower surfaces in the receiving portions 15 while being sandwiched between these surfaces. Thus, a vertical displacement of the terminal module M also is restricted. In addition, the contact of the upper surfaces of the steps 49A of the base 47 with the ceiling surfaces of the entrance parts of the guide grooves 13 also prevents the swing of the second wire 25, thereby contributing to restricting the deformation of the terminal holding member H.

Even if the second wire 25 is pulled strongly up, the positioning portions 16 of the displacement restricting member 2 can withstand a pull-up force. Thus, the detachment of the upper case 28 and upward deformation of the terminal holding member H reliably is avoided. Further, even if the second wire 25 is swung in any of direction, such a swing similarly can be withstood. Thus, the deformation of the terminal holding member H in all directions is avoided.

The first embodiment can also exhibit the following functions and effects.

The displacement restricting member 2 can be mounted easily by being fit to the terminal holding member H. Further, the terminal module M can be configured, utilizing an existing structure of the terminal holding member H.

In the first embodiment, a deflection space 7 below an unlocking portion 6A on the rear end of the lock arm 6 communicates with an upper surface of the accommodation recess 8 (see FIGS. 3 and 11). Specifically, if this opening part is omitted and a ceiling wall of the connector housing 1 is formed in this part instead of providing the displacement restricting member 2, it is thought to be effective in avoiding the deformation of the terminal holding member H. However, an effect of realizing a height reduction of the connector housing 1 and eventually the connector by as much as a thickness of the ceiling wall can be exhibited in the first embodiment by allowing communication between the accommodation recess 8 and the deflection space 7 without providing the connector housing 1 with the ceiling wall as described above.

Further, displacements of the positioning portions 16 in the width direction are restricted in the receiving portions 15. Thus, the side walls 49 of the base 47 in the displacement restricting member 2 cannot open. This prevents a locking state of the latching projections 46 and the latching grooves 53 from being inadvertently released.

Second Embodiment

FIGS. 14 to 25 show the second embodiment of the invention. In the second embodiment, a displacement restricting member is formed with locks and the locks are locked to a connector housing to prevent the displacement restricting member and eventually a terminal unit U from being withdrawn from the connector housing. Note that components and members common to the first embodiment are denoted by the same reference signs in the figures and are not described.

<Connector Housing 62: Mainly See FIGS. 15 to 17>

First, a connector housing 62 is described. Since a basic structure is similar to that of the first embodiment, different components are mainly described in detail.

Figure 17:
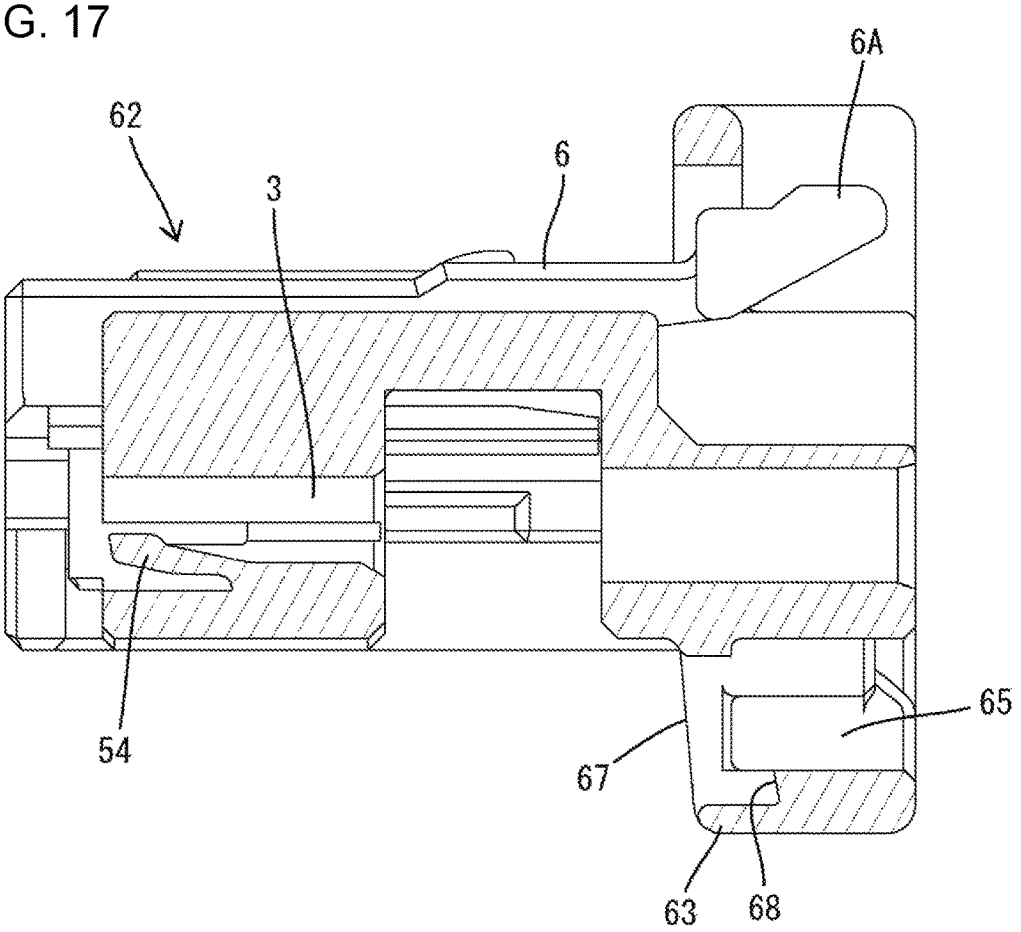
FIG. 17 is a section along H-H of FIG. 15.
Figure 18:
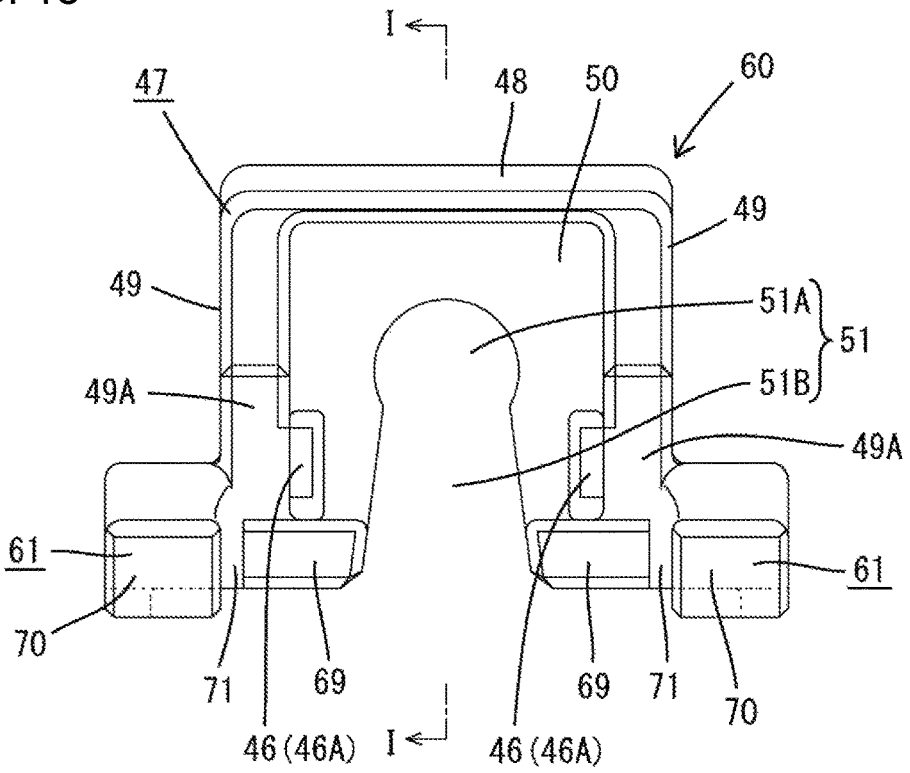
FIG. 18 is a back view of a displacement restricting member.
Figure 19:
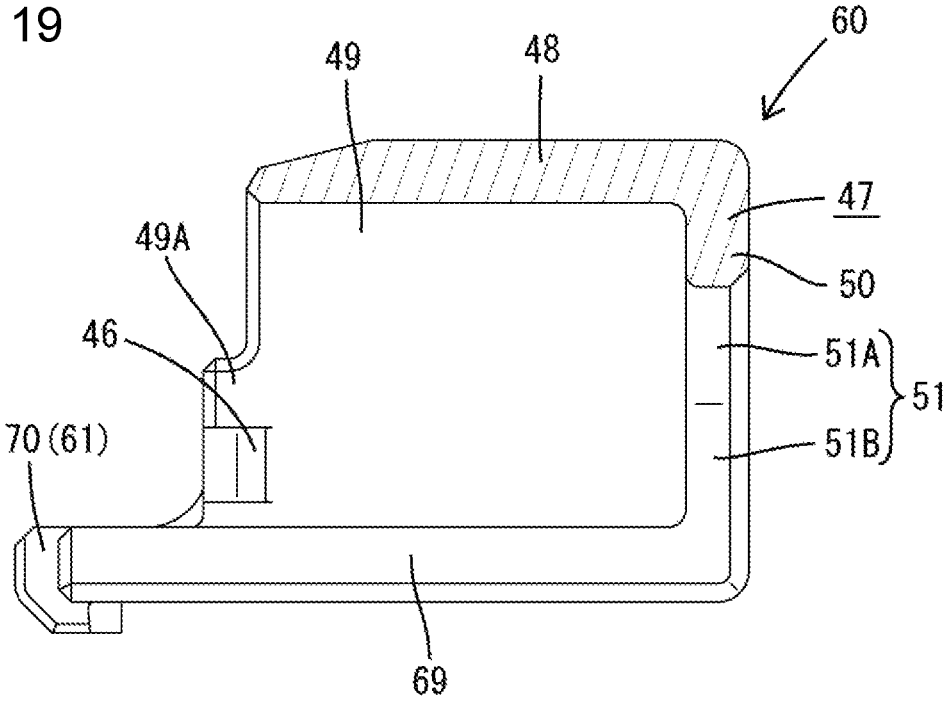
FIG. 19 is a section along I-I of FIG. 18.
Figure 20:
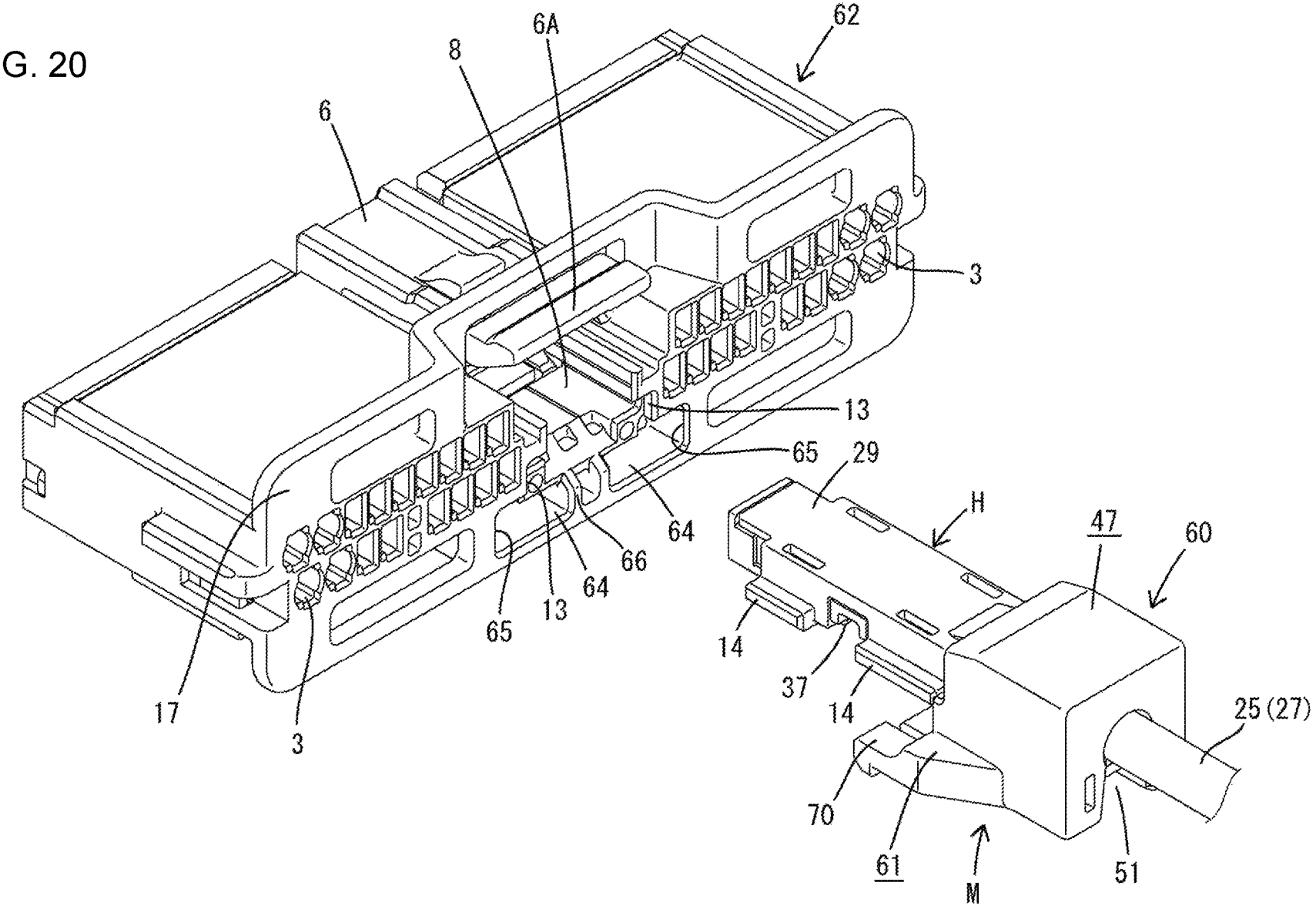
FIG. 20 is an exploded perspective view showing the terminal module and the connector housing.
Figure 21:
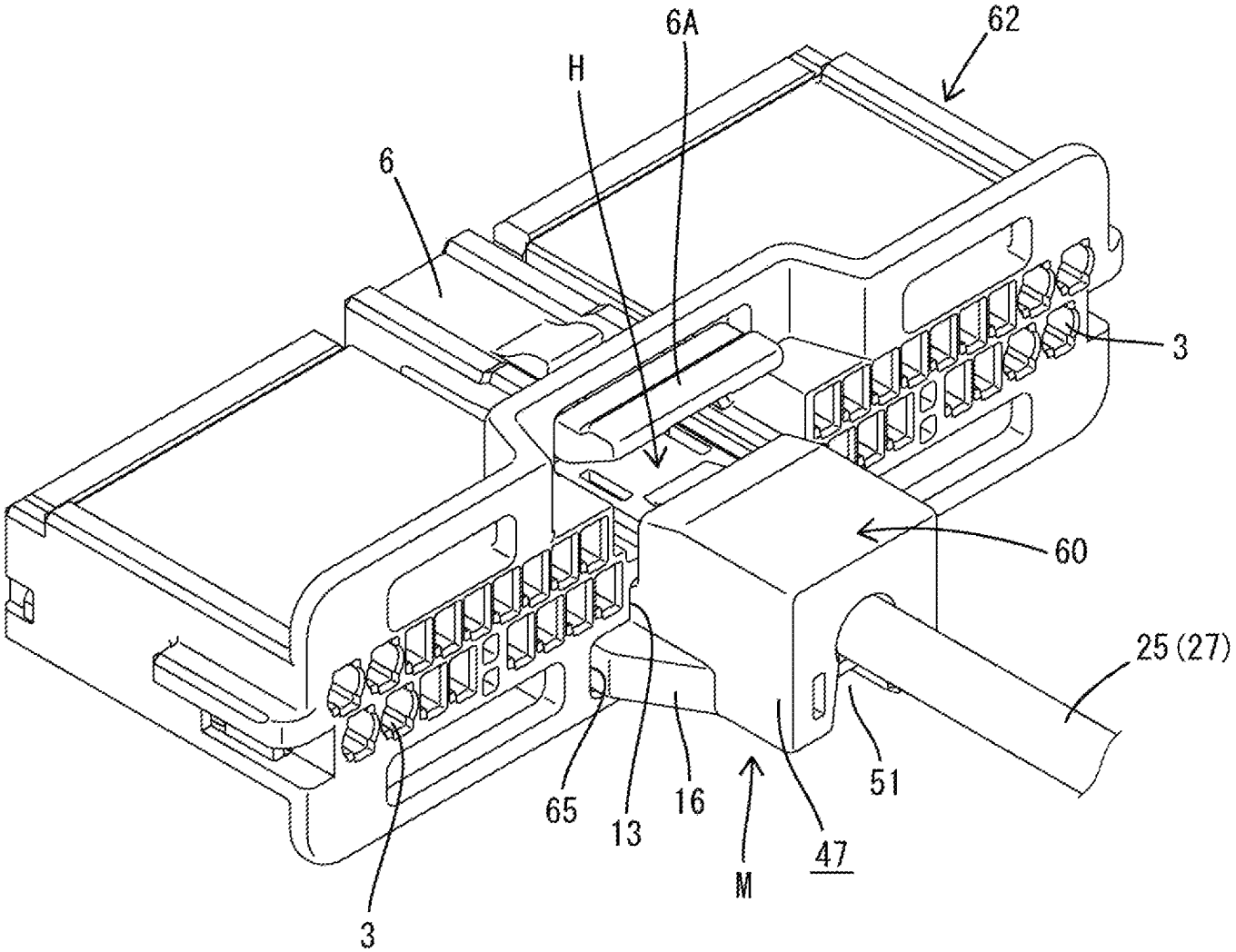
FIG. 21 is a perspective view showing an entire connector in a state where the terminal module is mounted in the connector housing.
Figure 22:
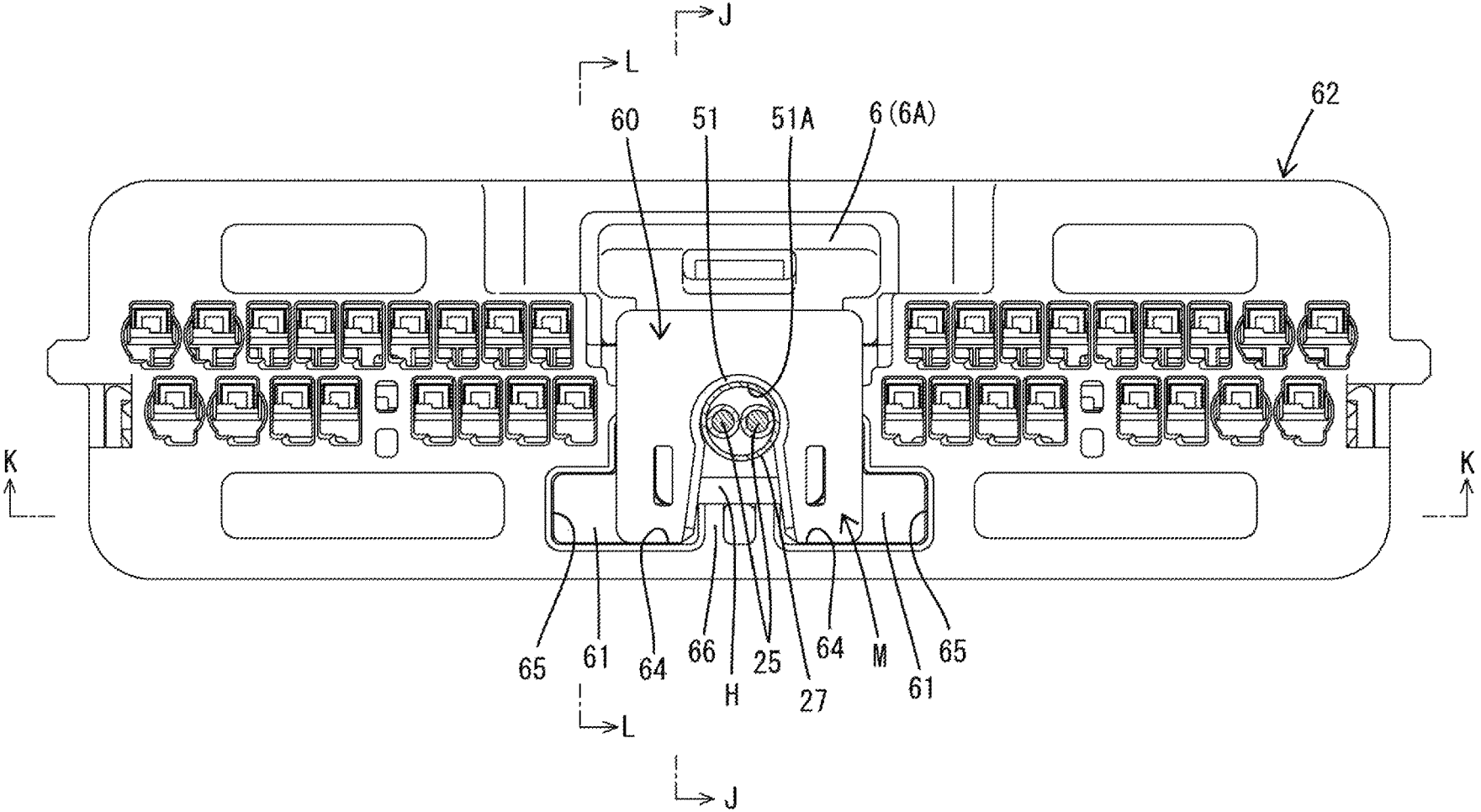
FIG. 22 is a front view of the entire connector showing the state of FIG. 21.
Figure 23:
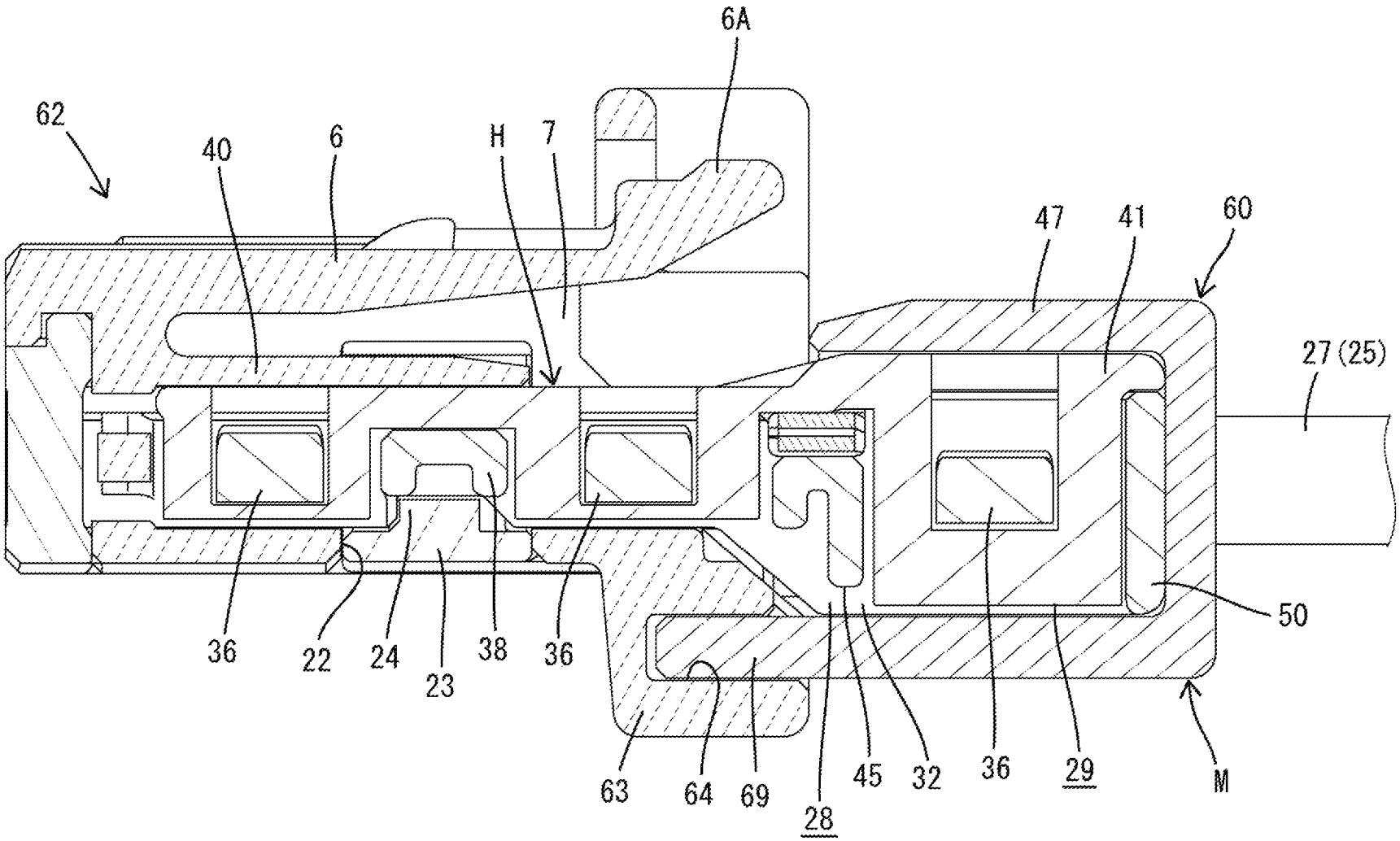
FIG. 23 is a section along J-J of FIG. 22.
Figure 25:
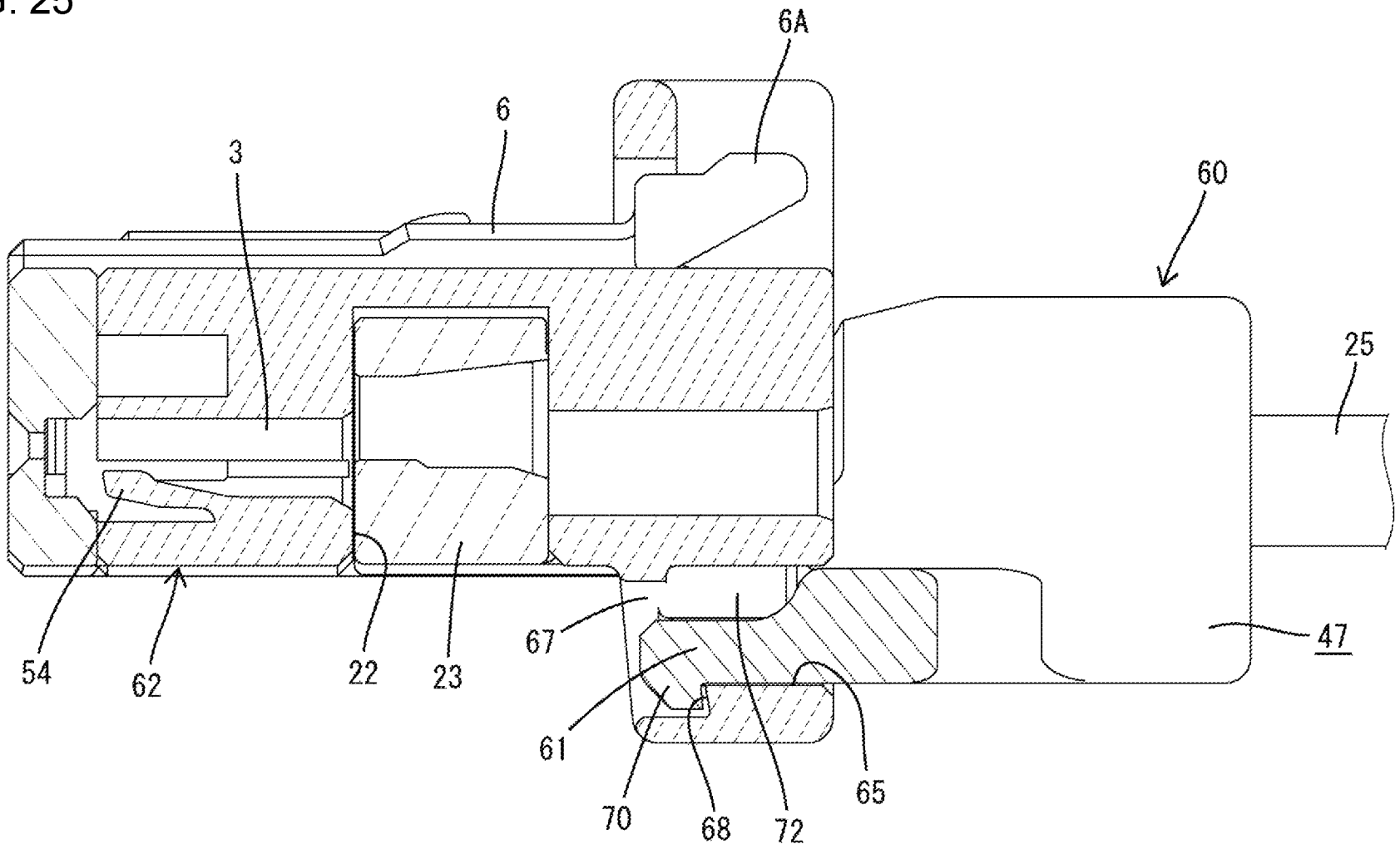
FIG. 25 is a section along L-L of FIG. 22.
Figure 26:
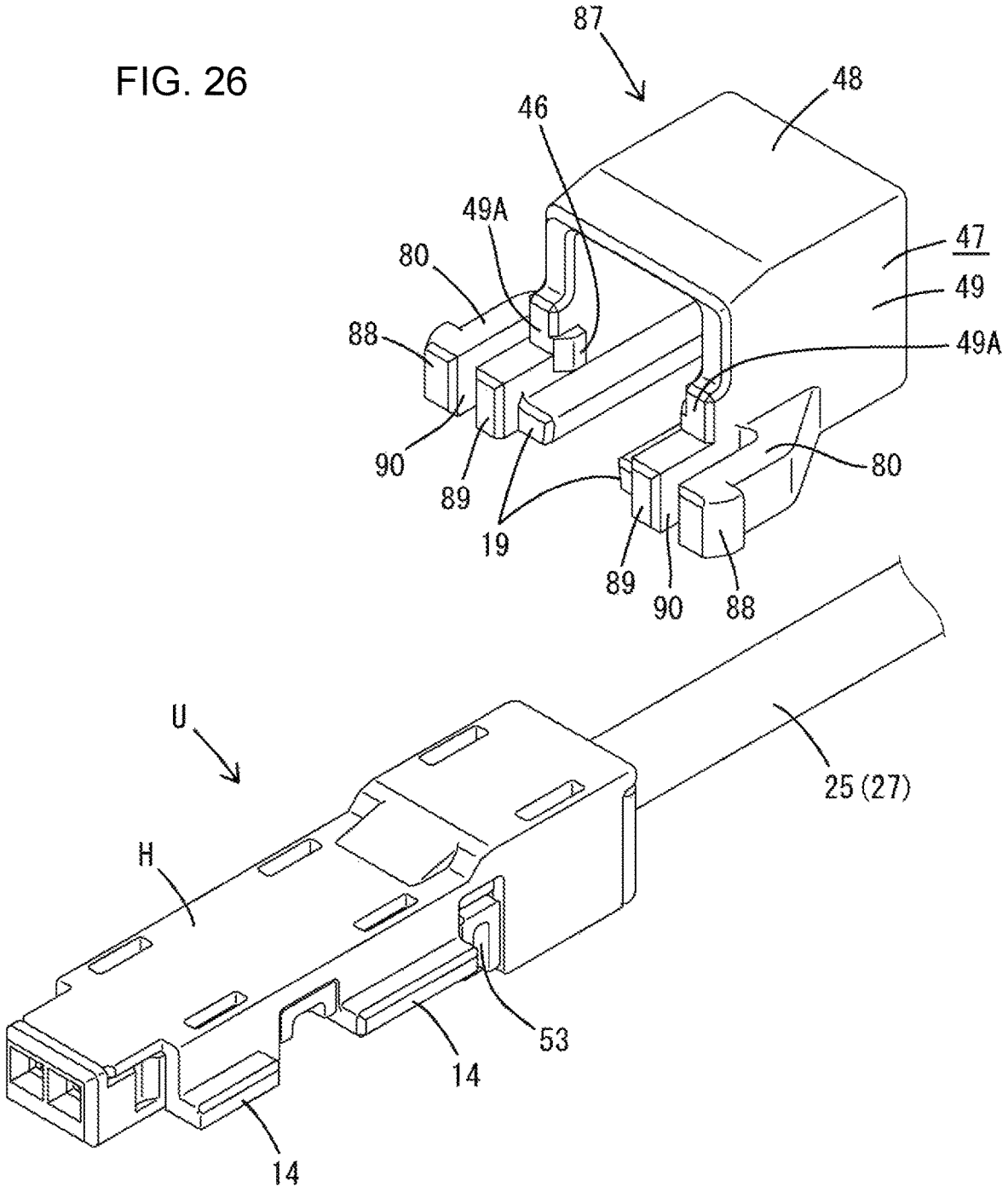
FIG. 26 is an exploded perspective view of a terminal module in a third embodiment.
Figure 27:
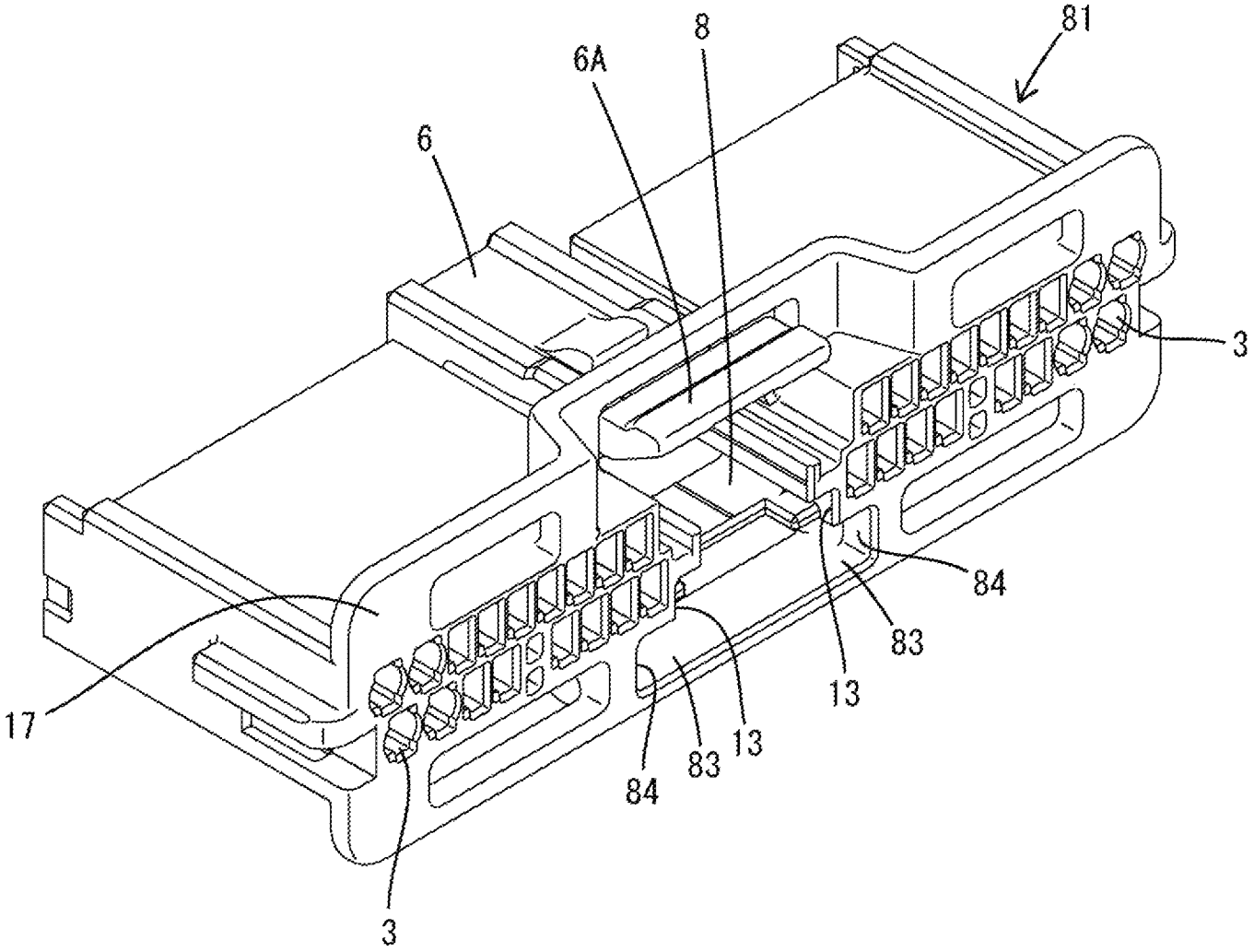
FIG. 27 is a perspective view of a connector housing.

As shown in FIGS. 17, 23 and 25, a projecting portion 63 projects in a widthwise central part of a rear end part of the lower surface of the connector housing 62. This projecting portion 63 is composed of the center projecting portion 18 and the side projecting portions 21 at both sides of the center projecting portion 18. The projecting portions 18, 21 have different downward projection heights, in the first embodiment. However, the projecting portion 63 of the second embodiment has the same downward projection height over the entire surface.

Figure 15:
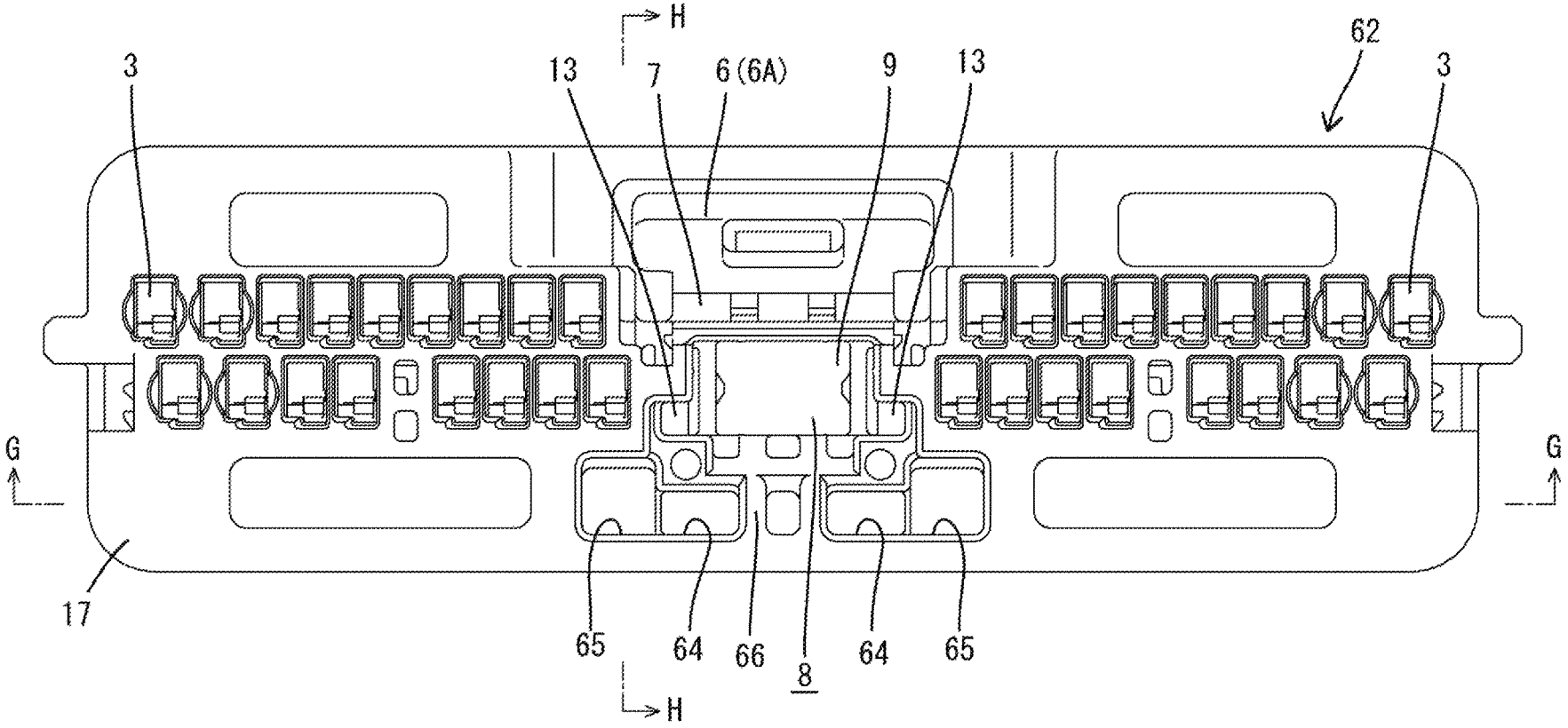
FIG. 15 is a front view of a connector housing.

As shown in FIG. 15, left and right receiving portions 64 and left and right lock receiving portions 65 are provided inside the projecting portion 63, and these are located adjacent to or below an insertion opening 9 of an accommodation recess 8. Both the receiving portions 64 and the lock receiving portions 65 are open rearward while communicating with each other in a width direction. The inside of the projecting portion 63 is partitioned into two left and right chambers by a partition wall 66 (hollow wall open rearward) formed in a widthwise central part, and each chamber is composed of one receiving portion 64 and one lock receiving portion 65 laterally separated.

Figure 16:
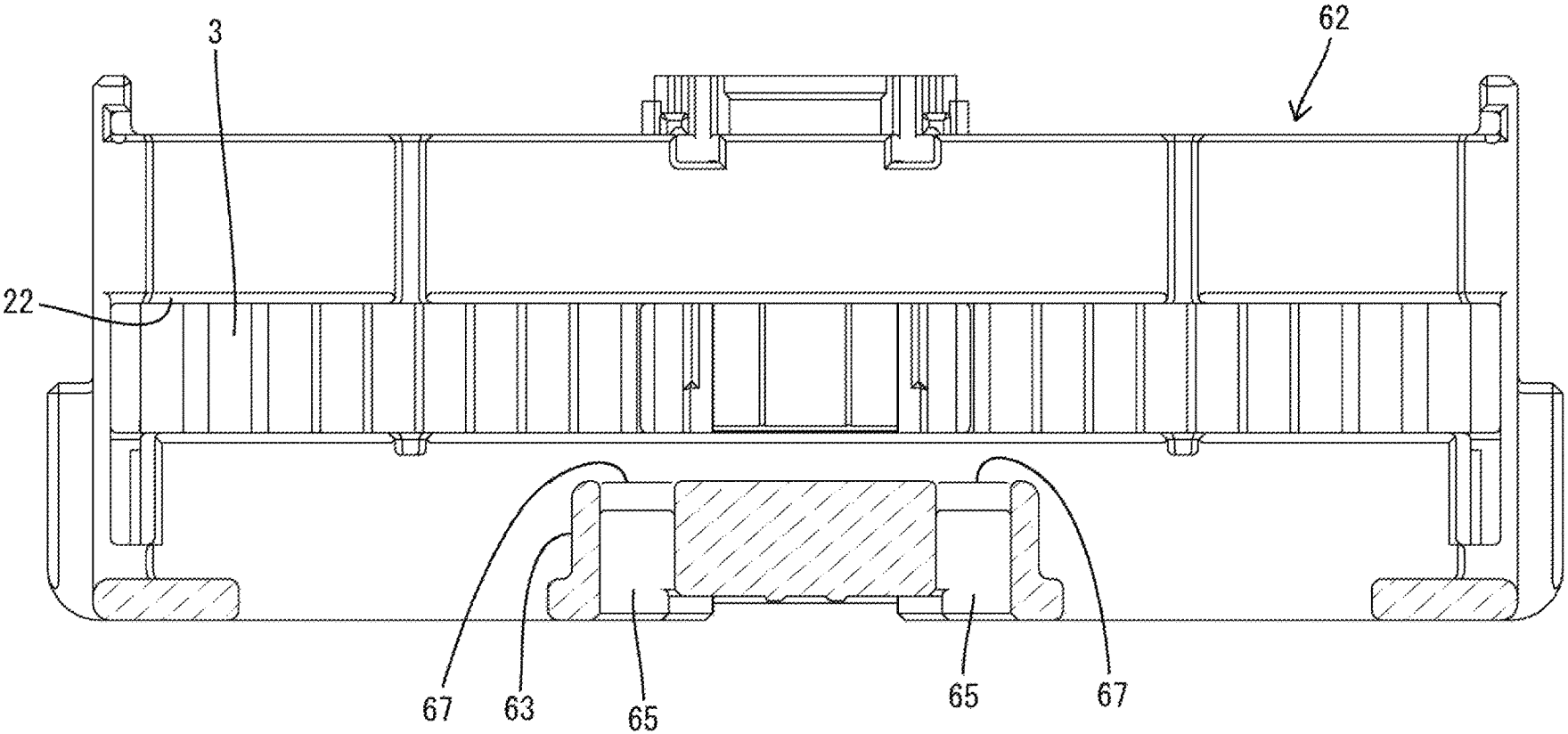
FIG. 16 is a section along G-G of FIG. 15.

As shown in FIG. 15, the receiving portions 64 are located inwardly of the lock receiving portions 65 in the width direction. Bottom surfaces in the receiving portions 64 and those in the lock receiving portions 65 are at the same height. However, ceilings in the receiving portions 64 are lower than ceilings in the lock receiving portions 65. As shown in FIG. 23, the receiving portions 64 have closed front ends. On the other hand, as shown in FIGS. 16, 17 and 25, front ends in the lock receiving portions 65 are open forward and serve as releasing openings 67. As shown in FIG. 17, a front end part of the bottom surface in the lock receiving portion 65 is lowered to form a locking step edge 68.

<Terminal Module M: Mainly See FIGS. 14, 18 and 19>

The terminal unit U has the same configuration as in the first embodiment and is not described. A displacement restricting member 60 includes the same or similar components as the first embodiment. Thus, only differences are described.

The displacement restricting member 60 of the second embodiment is configured so that parts where the flanges 19 are formed in the first embodiment function as positioning portions 69. Specifically, left and right positioning portions 69 in the form of plates protrude inward in the width direction along the lower end edges of the inner side surfaces of a base 47, and front ends thereof extend forward from the base 47.

Figure 24:
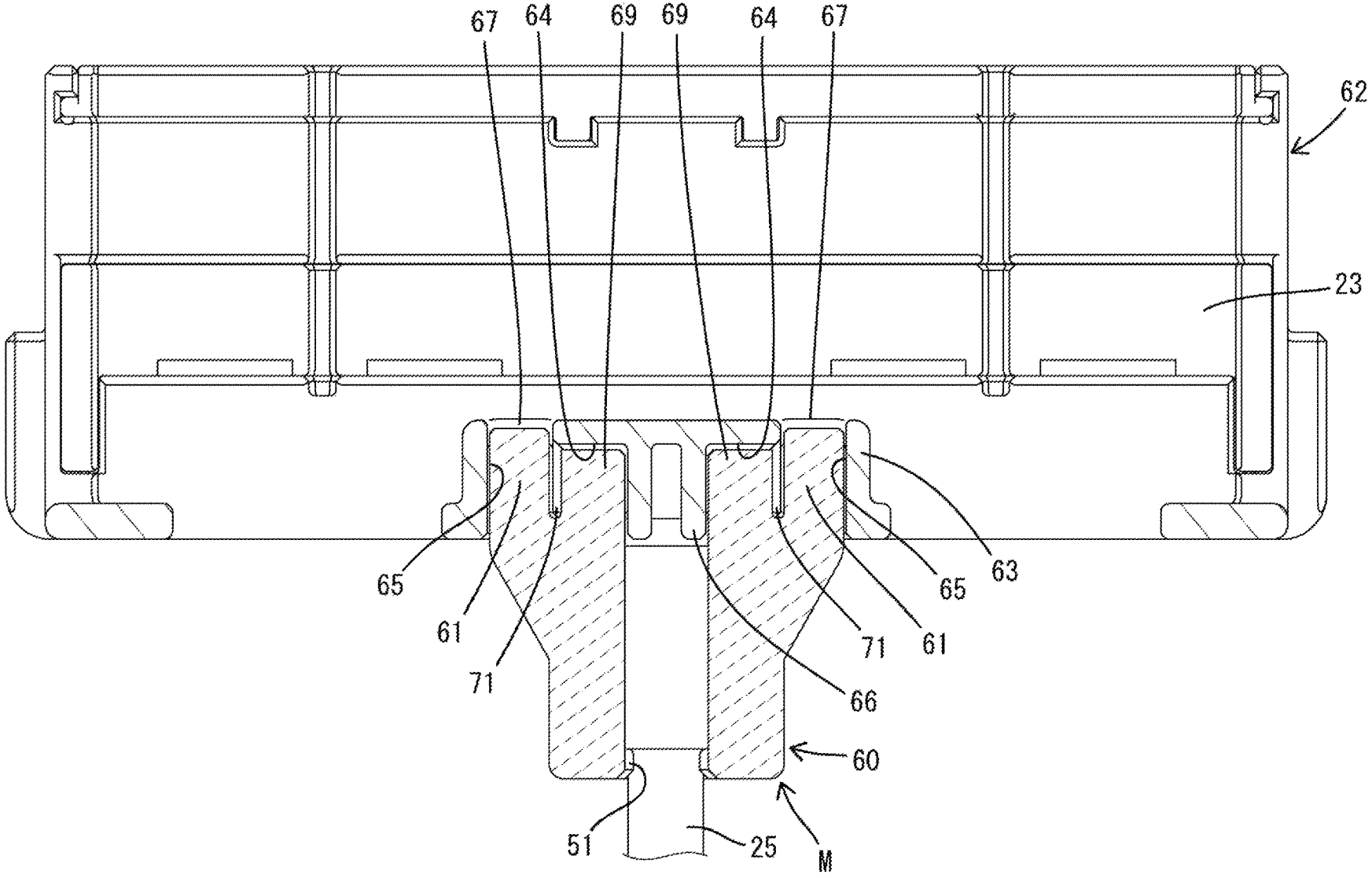
FIG. 24 is a section along K-K of FIG. 22.

On the other hand, the parts formed as the positioning portions 16 in the first embodiment are configured to function as locks 61 in the second embodiment. Specifically, left and right locks 61 protrude outward in the width direction on the lower end edges of the outer side surfaces of the base 47. Front end parts of the locks 61 extend farther forward than the front end of the base 47. The lower surfaces (excluding claws 70) of the locks 61 are substantially flush with the lower surfaces of the positioning portions 69. A thickness of the positioning portions 69 is slightly larger than an inner height of the lock receiving portions 64. When the terminal unit U is mounted into the accommodation recess 8, both upper and lower surfaces of the positioning portions 69 are held in close contact with and sandwiched between the ceiling surfaces and the bottom surfaces in the receiving portions 64. Simultaneously, as shown in FIG. 24, the inner side edges of the locks 69 in the width direction closely contact the outer side surfaces of the partition wall 66.

A thickness of a part of the lock 61 projecting forward from the base 47 is smaller than that of a part behind this part. In a part of the base 47 where the locks 61 and the positioning portions 69 extend forward, slits 71 are formed to extend rearward from front end sides between the locks 61 and the positioning portions 69 (see FIG. 18). In this way, parts of the locks 61 extending forward from the base 47 constitute cantilevers and are vertically deflectable. The claws 70 are formed on the front ends of the parts constituting the cantilevers. Note that the claws 70 project farther down from the lower surfaces of the locks 61 and those of the positioning portions 69.

A thickness of the locks 61 is smaller than an inner height of the lock receiving portions 65 of the connector housing 62. When the terminal unit U is mounted in the accommodation recess 8, spaces above the locks 61 out of the inner spaces of the lock receiving portions 65 serve as deflection spaces 72 for the locks 61. Accordingly, in mounting this terminal unit U, the locks 61 are deflected and deformed toward the deflection spaces 72 and the claws 70 slide forward in contact with the bottom surfaces in the lock receiving portions 65. When the terminal unit U reaches a proper mounting position, the locks 61 resiliently return and the claws 70 are locked to the locking step edges 68 of the lock receiving portions 65.

The displacement restricting member 60 is mounted on the terminal unit U substantially in the same procedure as in the first embodiment to assemble the terminal module M. Also in an operation of mounting the terminal module M into the connector housing 62, a terminal holding member H is inserted into the accommodation recess 8 of the connector housing 62 from behind as in the first embodiment. Until the terminal module M reaches a proper position, the positioning portions 69 move forward in the receiving portions 64 and, simultaneously, the locks 61 move forward in the lock receiving portions 65. During this time, the claws 70 slide forward in contact with the bottom surfaces in the lock receiving portions 65 while the locks 61 are deflected and deformed up in the lock receiving portions 65. The locks 61 resiliently return when the terminal module M reaches the proper position in the connector housing 62, and the claws 70 are locked to the locking steps 68 of the lock receiving portions 65, as shown in FIG. 25. Simultaneously, the front ends of the positioning portions 69 butt against the front surfaces in the receiving portions 64 (see FIGS. 23 and 24), and any further insertion of the displacement restricting member 60 is restricted as in the first embodiment.

The positioning portions 69 of the displacement restricting member 60 closely contact the upper and lower surfaces in the receiving portions 64 while being sandwiched by these surfaces. Thus, an upper case 29 will not detach even if a second wire 25 is swung strongly in a vertical direction. Further, the inner side edges of the positioning portions 60 in the width direction are held in close contact with the outer side surfaces of the partition wall 66, and the outer side edges of the lock portions 61 in the width direction are held in close contact with the side surfaces in the lock receiving portions 65. Thus, the part of the terminal holding member H projecting from the connector housing 62 will not deform even if the second wire 25 is swung strongly in a lateral direction.

In the second embodiment, the claws 70 of the locks 61 are locked to the locking steps 68 in the lock receiving portions 65 with the terminal module M mounted at the proper position in the connector housing 62. In this way, the displacement restricting member 60 and the terminal module M are retained reliably in the connector housing 62. In the first embodiment, the displacement restricting member 2 is retained in the connector housing 1 by press-fitting the positioning portions 61 into the receiving portions 15. Thus, if it is attempted to strengthen a retaining force, it may become difficult to insert the displacement restricting member 2 into the connector housing 1. However, in the second embodiment, the displacement restricting member 60 is retained in the connector housing 62 by resilient locking of the locks 61. Accordingly, the displacement restricting member 60 are retained even if press-fit forces of the positioning portions 69 into the receiving portions 64 are not increased. Thus, insertion forces of the displacement restricting member 60 and eventually the terminal module M into the connector housing 62 can be reduced and the inserting operation can be performed smoothly.

To withdraw the terminal module M from the connector housing 62, a retainer 23 at a full locking position is returned to a partial locking position to release locking between the terminal holding member H and a recessed groove 37. An unillustrated tool then is inserted through the releasing openings 67 at the front ends of the lock receiving portions 65, to deform or forcibly unlock the claws 70 of the locks 61. Then, the terminal module M can be withdrawn easily from the connector housing 62.

Note that the other configuration not described is the same as in the first embodiment and, hence, can exhibit the same functions and effects as in the first embodiment.

Third Embodiment

FIGS. 26 to 33 show the third embodiment of the present invention. Although the lock portions 61 are deflected in the vertical direction in the second embodiment, locks 80 are deflected and deformed inward in a width direction in the third embodiment.

<Connector Housing 81: Mainly See FIGS. 27 to 29>

A connector housing 81 of the third embodiment also has a basic structure similar to those of the first and second embodiments. A projecting portion 82 formed similarly to that of the second embodiment is formed to project in a widthwise central part of a rear end part of the lower surface of the connector housing 81.

Figure 28:
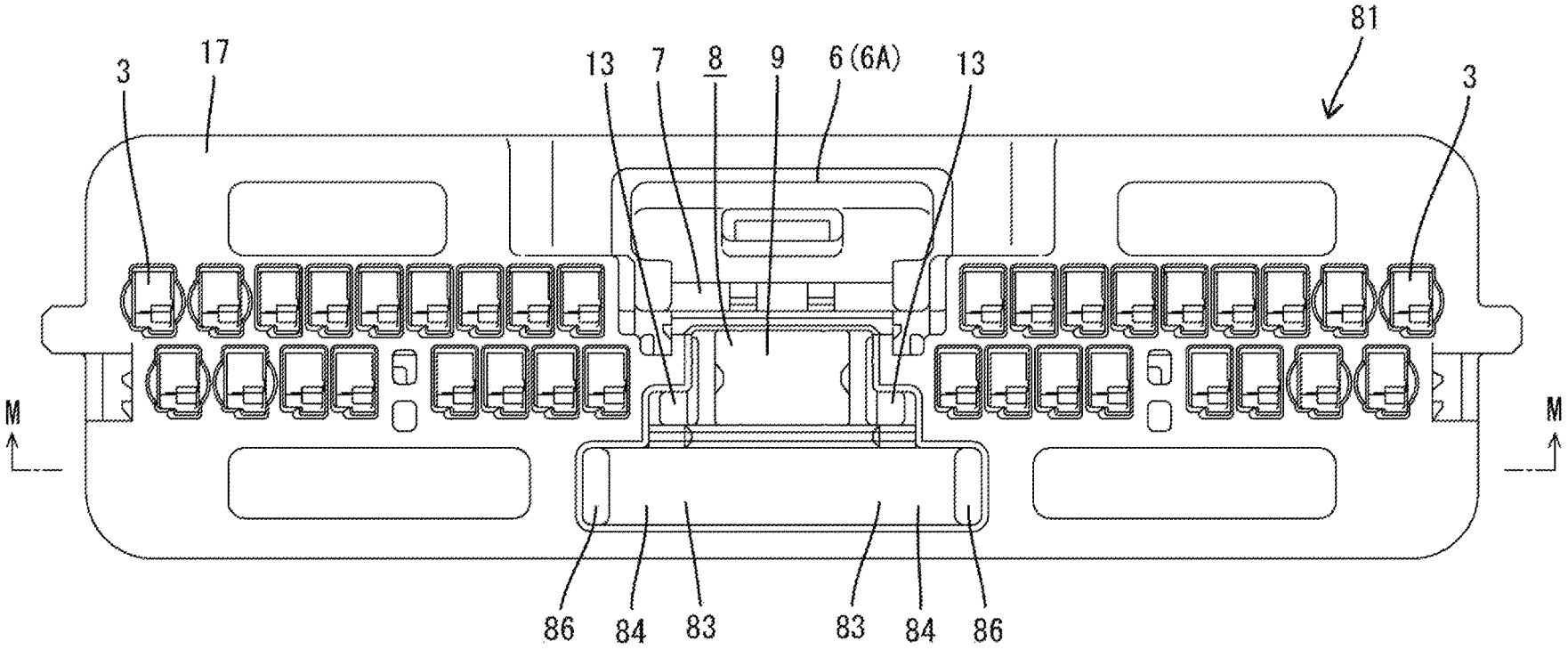
FIG. 28 is a front view of the connector housing.

Receiving portions 83 and lock receiving portions 84 are formed in the projecting portion 82. As shown in FIG. 28, rear end openings of the receiving portions 83 and the lock receiving portions 84 are open below an insertion opening 9 of an accommodation recess 8 in the rear surface of the connector housing 81. As shown in FIG. 28, two space areas serving as the lock receiving portions 84 are disposed on outer sides in the width direction and space areas serving as the receiving portions 83 are disposed inwardly of the lock receiving portions 84. These space areas communicate with each other, have the same height as a whole, and constitute a continuous space continuous in the width direction without being partitioned.

Figure 29:
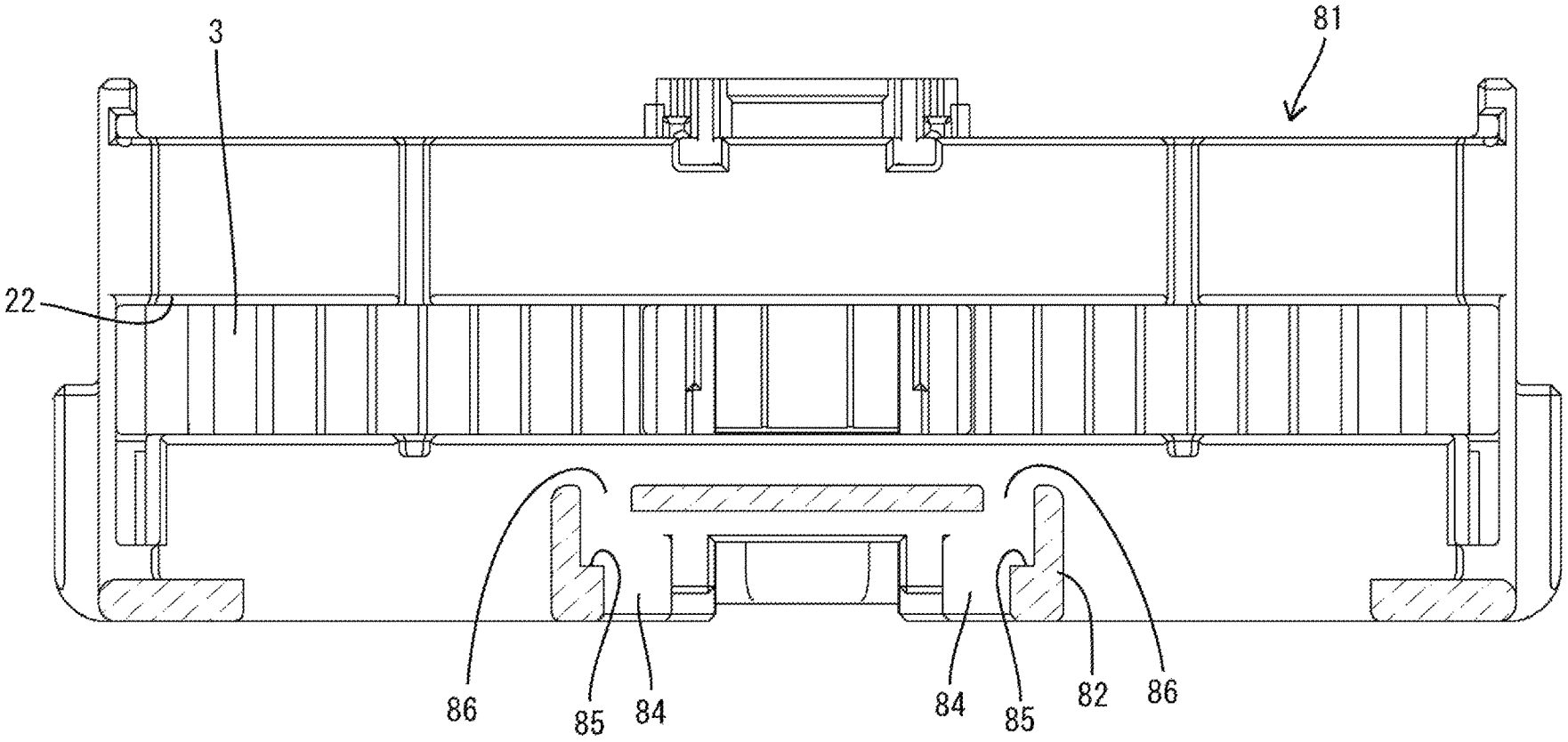
FIG. 29 is a section along M-M of FIG. 28.
Figure 30:
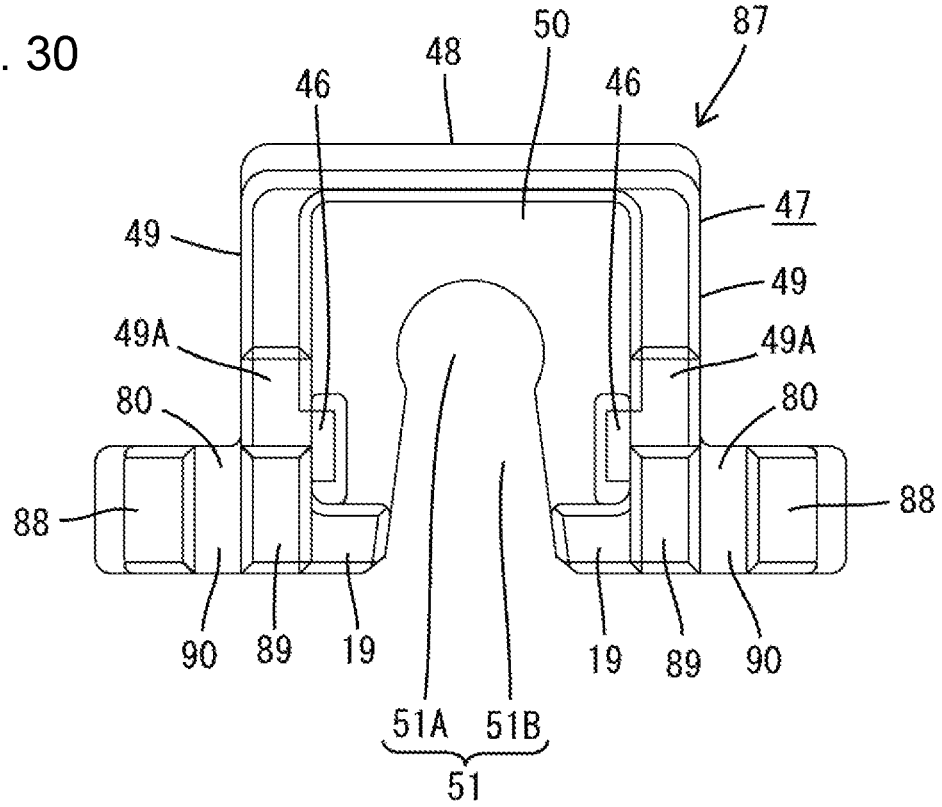
FIG. 30 is a back view of a displacement restricting member.
Figure 31:
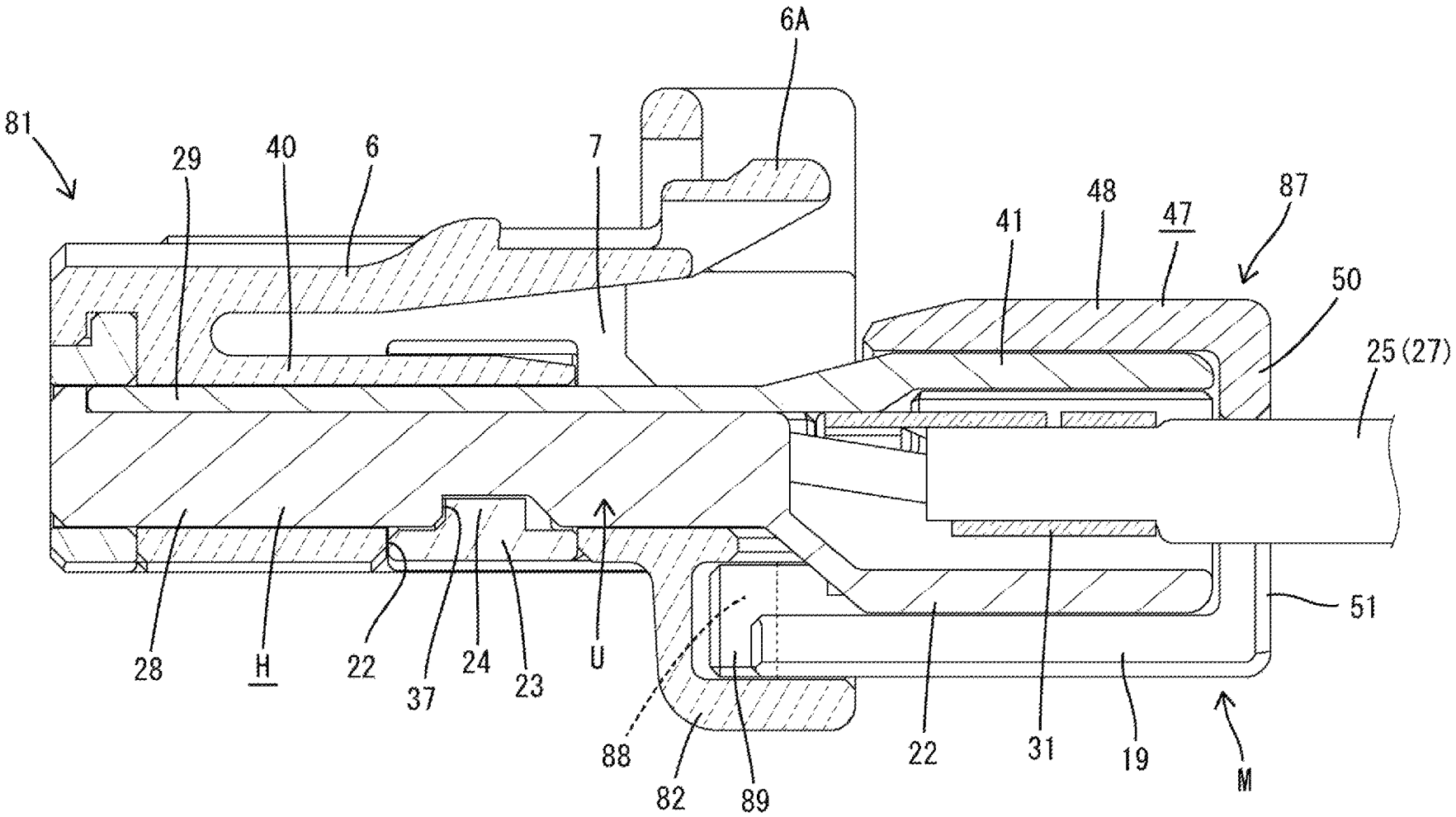
FIG. 31 is a side view in section cut along a central part of a connector in a state where the terminal module is mounted in the connector housing.
Figure 32:
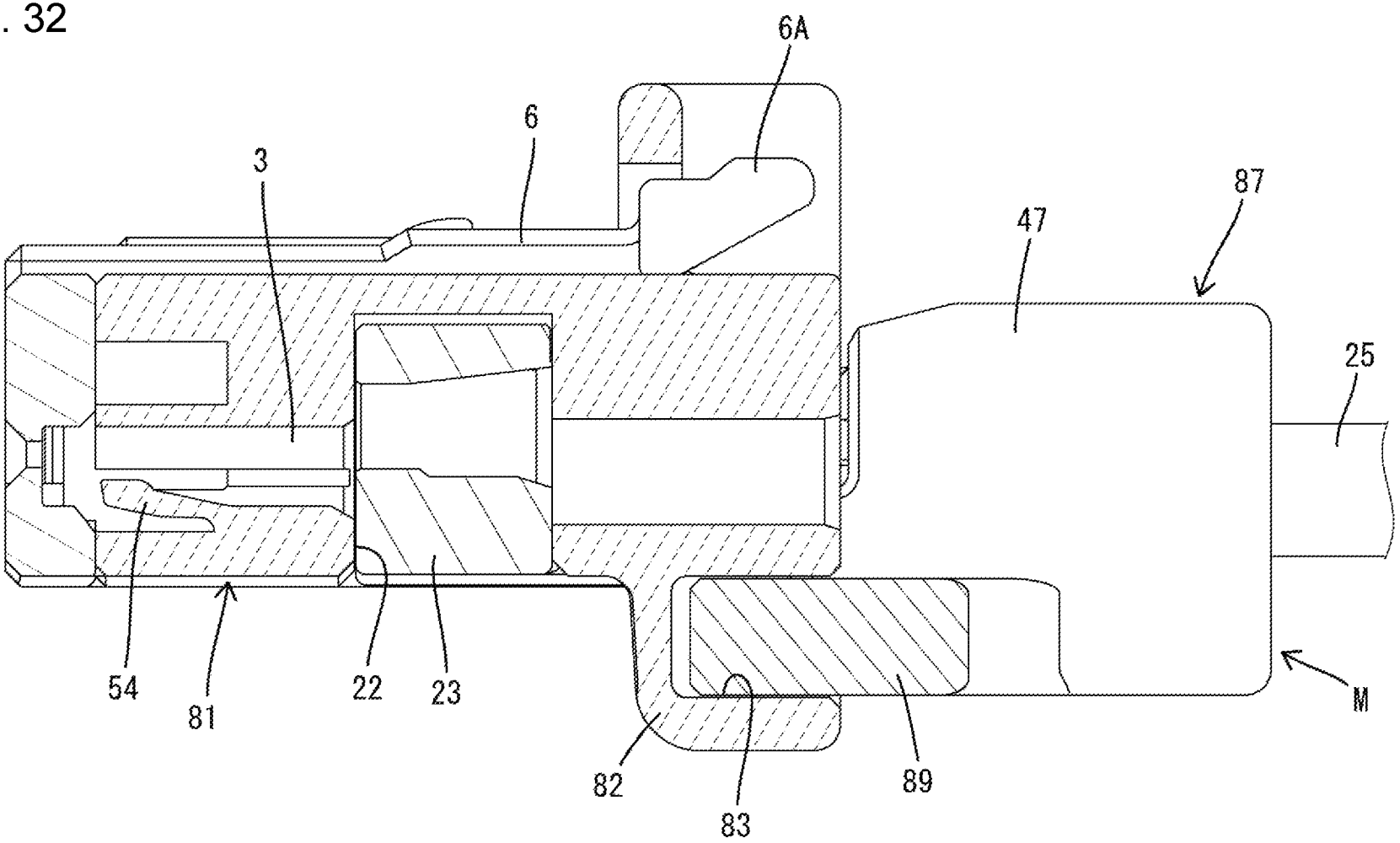
FIG. 32 is a side view in section cut along a lock portion showing the state of FIG. 31.

As shown in FIG. 29, left and right locking steps 85 are formed on both side surfaces in the projecting portion 82, i.e. both side surfaces corresponding to the areas serving as the lock receiving portions 84. Left and right releasing openings 86 are open in parts facing the locking steps 85, out of a front surface in the projecting portion 82. When a terminal module M is mounted at a proper position in the accommodation recess 8 of the connector housing 81, locks 80 of a displacement restricting member 87 are locked to the locking steps 85 (see FIG. 33).

<Terminal Module: Mainly See FIGS. 26 and 30>

A terminal unit U has substantially the same configuration as the first and second embodiments and is not described. Only components different from those of the first and second embodiments are described for the displacement restricting member 87.

In the displacement restricting member 87, left and right positioning portions 89 extend forward on lower end parts (parts below steps 49A) of the front edge of a base 47. The positioning portions 89 have the same width as front side edges of side walls 49, and inner side surfaces thereof in the width direction are connected to front end parts of widthwise outer side surfaces of flanges 19. The front ends of the positioning portions 89 are located forward of those of the flanges 19. The lower surfaces of the positioning portions 89 are flush with those of the flanges 19. A height of the positioning portions 89 is substantially equal to that of the locks 80, but larger than that of the flanges 19. That is, the upper surfaces of the positioning portions 89 are higher than those of the flanges 19. The height of the positioning portions 89 is substantially equal to an inner height of the projecting portion 82 of the connector housing 81. Accordingly, with the terminal module M mounted in the accommodation recess 8, the positioning portions 89 are inserted into the areas serving as the receiving portions 83 in the projecting portion 82 and sandwiched by both upper and lower surfaces in the projecting portion 82 while being held substantially in close contact with these surfaces. Thus, the mounted terminal module M is inserted with clearances defined between the upper surfaces of the flanges 19 and a ceiling surface in the projecting portion 82.

Left and right locks 80 are provided at positions near front end parts on both outer side surfaces of the base 47. The locks 80 have rear end parts serving as coupling end parts to the base 47 and are cantilevered horizontally forward from the coupling end parts and having front end parts as free ends. The positions of the front ends of the locks 80 are aligned with those of the front ends of the positioning portions 89.

Claws 88 protrude out in the width direction on the tips of the locks 80. Clearances 90 are defined between the locks 80 and the adjacent positioning portions 89. Thus, the locks 80 can deflect and displace toward deflection spaces inward of the locks 80 in the width direction. The claws 88 slide in contact with both side surfaces in the projecting portion 82 while the lock portions 80 are deflected and deformed inward in the width direction until the terminal module M is mounted properly into the connector housing 81. When the terminal module M reaches the proper position, the locks 80 resiliently return and the claws 88 are locked to the locking steps 85.

The lower surfaces of the locks 80 are flush with those of the flanges 19 and the positioning portions 89. In this embodiment, a thickness of the locks 80 is equal to that of the positioning portions 89, i.e. set substantially equal to the inner height of the projecting portion 82, but may be smaller than the inner height of the projecting portion 82. This is because, by setting so, clearances are defined between the locks 80 and the upper surface in the projecting portion 82 and the locks 80 can be expected to be deflected and deformed smoothly when the locks 80 are deflected and deformed.

An assembling procedure of the terminal module M of the third embodiment is as in the first and second embodiments.

Figure 33:
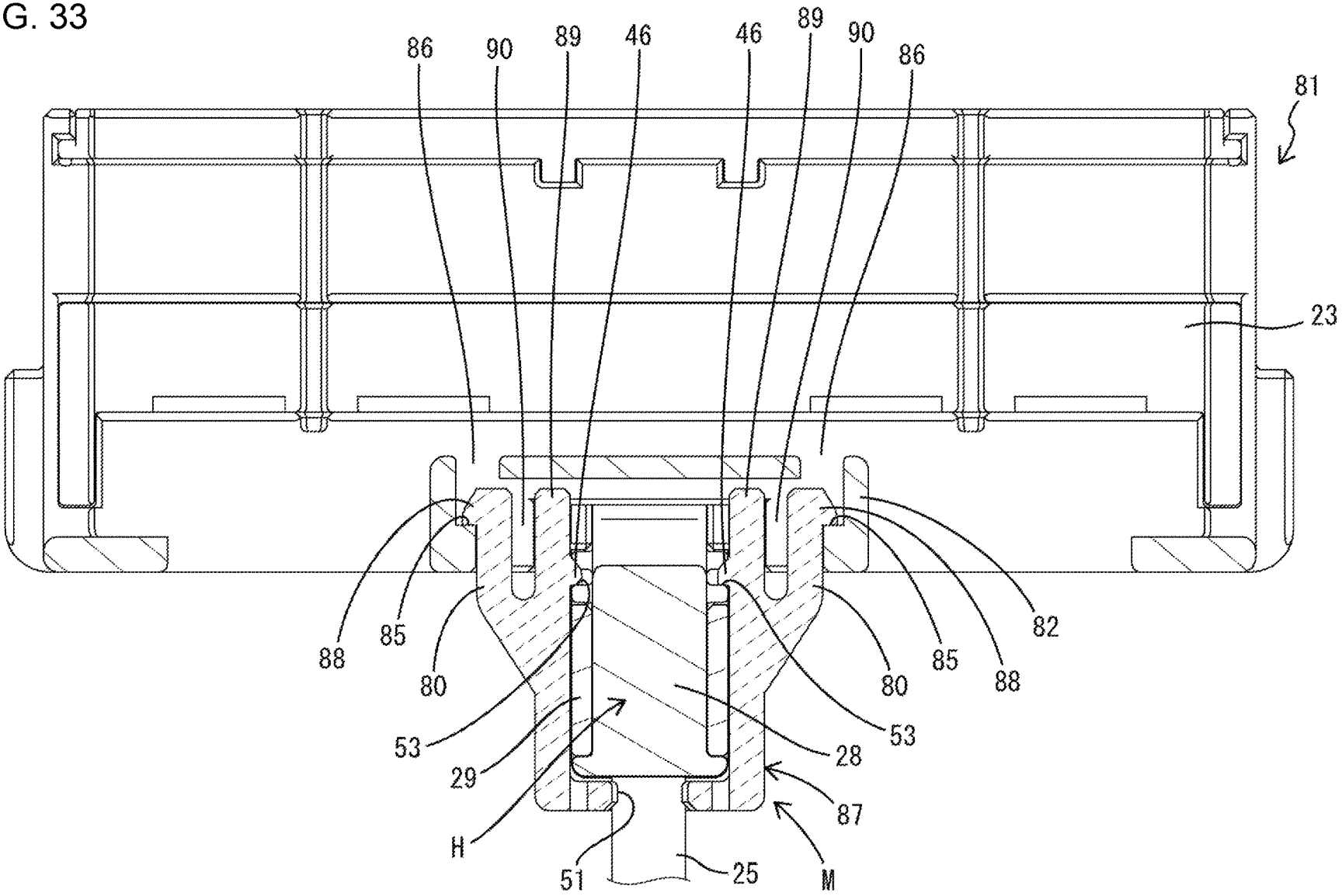
FIG. 33 is a plan view in section showing a state where the lock portions are locked with the terminal module mounted in the connector housing.

In the third embodiment, the following functions and effects are exhibited in addition to those of the first and second embodiments. In mounting the terminal module M into the connector housing 81, the positioning portions 89 move forward while both upper and lower surfaces thereof pass through the areas serving as the receiving portions 83 in the projecting portion 82 and slide in contact with both upper and lower surfaces in these areas until the terminal module M inserted into the accommodation recess 8 reaches the proper position. When the terminal module M reaches the proper position, the front ends of the positioning portions 89 proximately face the front surface in the projecting portion 82, as shown in FIG. 33.

Further, until the terminal module M reaches the proper position, the claws 88 of the locks 80 move forward in the areas serving as the lock receiving portions 84 in the projecting portion 82. During that time, the locks 80 are deflected and deformed into the deflection spaces inward thereof in the width direction while the claws 88 slide in contact with the side surfaces in the projecting portion 82. When the terminal module M reaches the proper position, the locks 80 resiliently return and the claws 88 are locked to the locking steps 85, as shown in FIG. 33.

The positioning portions 89 of the displacement restricting member 87 also are sandwiched by the both upper and lower surfaces in the receiving portions 83 in the third embodiment. Thus, even if a second wire 25 is swung strongly in a vertical direction, an upper case 29 will not detach and a terminal holding member H will not deform.

The claws 88 of the locks 80 of the third embodiment are locked to the locking steps 85 in the lock receiving portions 84 with the terminal module M mounted at the proper position in the connector housing 81. Thus, functions and effects similar to those of the second embodiment, such as reliable retention of the displacement restricting member 87 and the terminal module M in the connector housing 81 are exhibited.

The terminal module M can be withdrawn from the connector housing 81 in the same procedure as in the second embodiment.

Fourth Embodiment

FIGS. 34 to 39 show the fourth embodiment. Although the locks 80 of the displacement restricting member 87 resiliently return outward in the width direction to be locked to the locking steps in the third embodiment, locks 101 resiliently return inward in a width direction for locking in the fourth embodiment.

<Connector Housing 102: Mainly See FIGS. 35 and 36>

A connector housing 102 of the fourth embodiment also has a basic structure similar to those of the first to third embodiments. A projecting portion 103 formed similarly to those of the second and embodiments project in a widthwise central part of a rear end part of the lower surface of the connector housing 102.

Receiving portions 104 and lock receiving portions 105 are formed in the projecting portion 103 to communicate with each other. Both of these are formed to be open rearward and the insides thereof have both upper and lower surfaces and both widthwise surfaces respectively surrounded by wall surfaces. A vertical locking partition wall 106 is between a bottom surface and a ceiling surface in a widthwise central part inside the projecting portion 103 to partition the inside of the projecting portion 103 into left and right sections.

Figure 36:
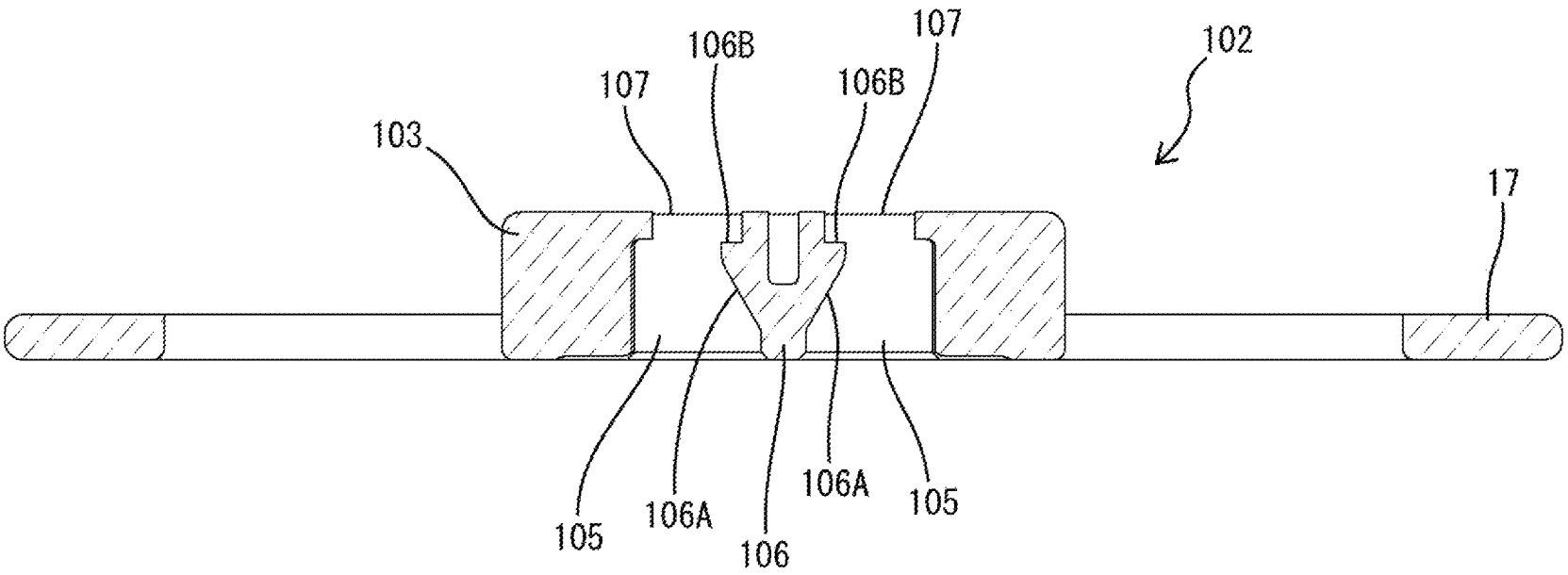
FIG. 36 is a section along N-N of FIG. 35.

As shown in FIG. 36, both outer side surfaces of the locking partition wall 106 in the width direction gradually increase a width toward a back side and serve as guiding inclined surfaces 106A. Final end parts of the guiding inclined surfaces 106A are cut inward in the width direction to form left and right locking steps 106B.

Two of the lock receiving portions 105 are provided below the receiving portions 104 across the locking partition wall 106 in the width direction. Left and right releasing openings 107 are open in lower parts of the front end surface of the projecting portion 103 across the locking partition wall 106.

Figure 35:
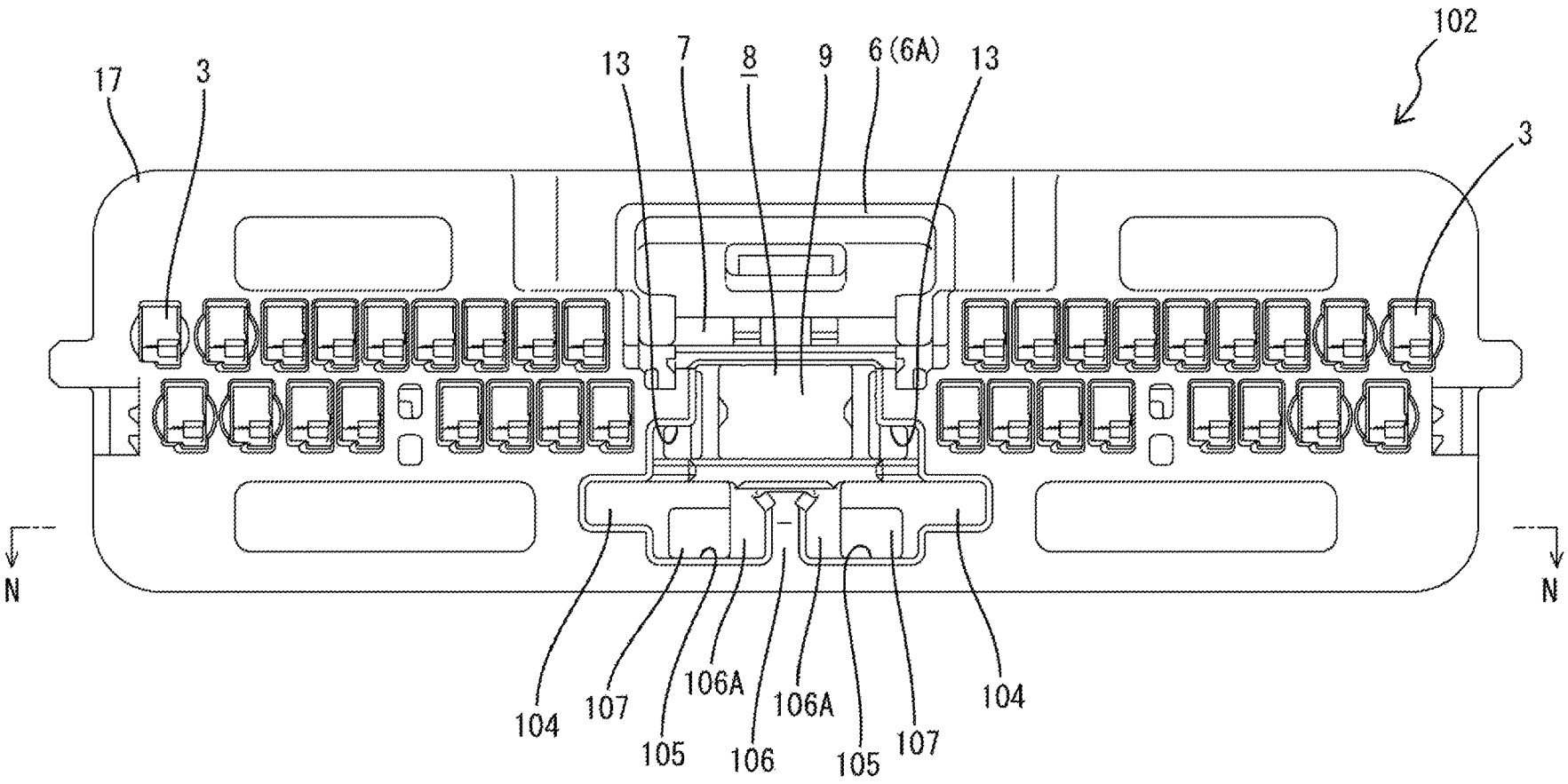
FIG. 35 is a front view of a connector housing.

As shown in FIG. 35, the receiving portions 104 protrude out in the width direction above the lock receiving portions 105. Each receiving portion 104 is surrounded on three sides by upper and lower surfaces and a widthwise outer side surface.

<Terminal Module M: Mainly See FIGS. 34 and 37>

A terminal unit U has the same configuration as in the other embodiments. A displacement restricting member 100 is described. Flanges 19 are formed to protrude inward in the width direction along lower edges on inner sides of both left and right side surface walls 49 constituting a base 47.

Figure 34:
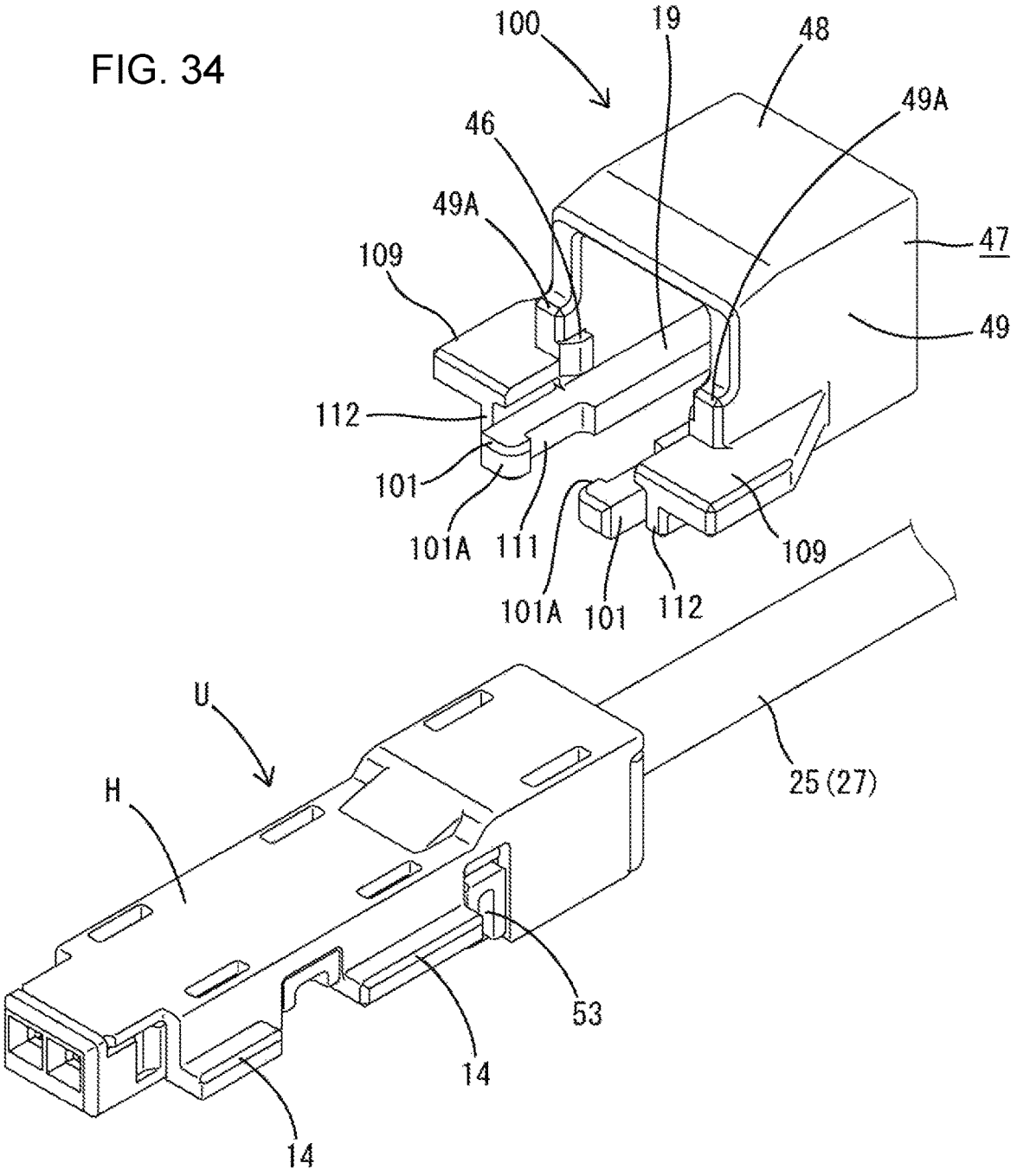
FIG. 34 is an exploded perspective view of a terminal module in a fourth embodiment.

Both locks 101 are configured by parts of the flanges 19 projecting forward from the base 47. Clearances 110 are defined between the locks 101 and positioning portions 109 (upright walls 112). The locks 101 are cantilevers with free front ends. As shown in FIG. 34, inner surfaces of the locks 101 in the width direction are cut over a predetermined length range to form thinned portions 111. In this way, claws 108 are formed on tip parts of the locks 101 and the locks 101 are deflectable and displaceable toward the clearances 110 as deflection spaces, i.e. outward in the width direction. Arcuate guiding surfaces 101A are on front ends of the claws 108 for guiding the deflection of the locks 101.

Figure 38:
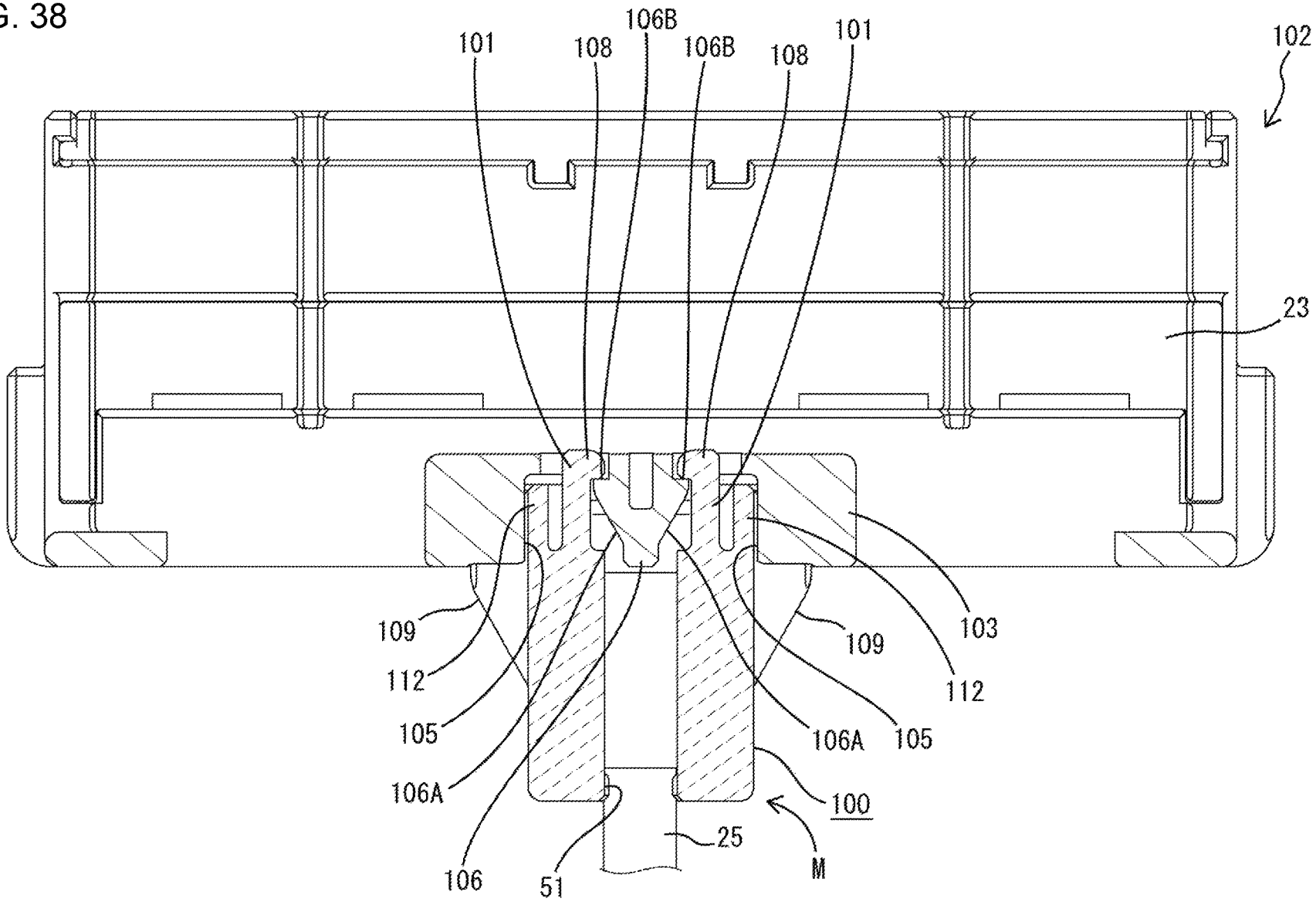
FIG. 38 is a plan view in section showing a locking state of lock portions in a connector with the terminal module mounted in the connector housing.
Figure 39:
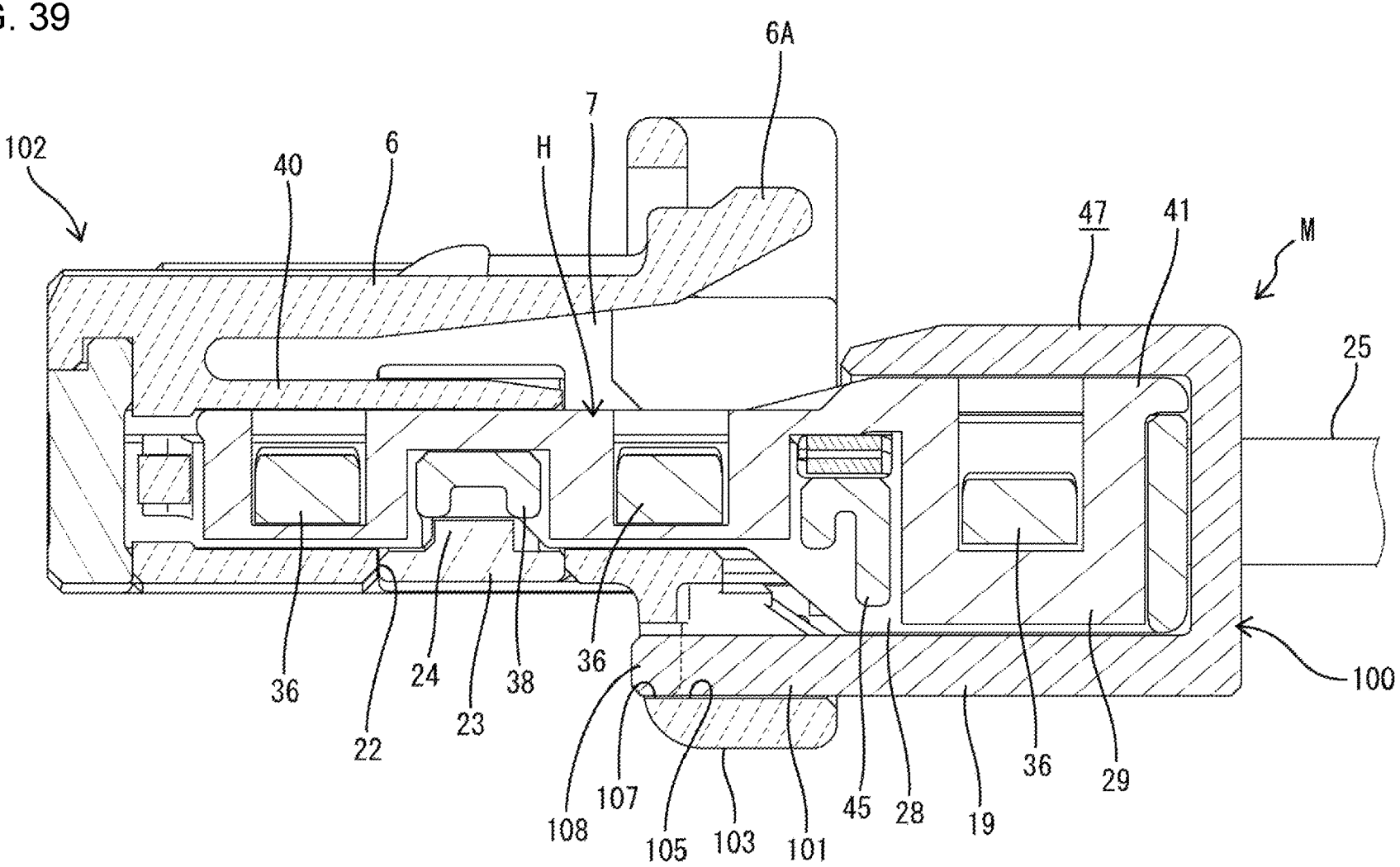
FIG. 39 is a side view in section along the lock portion in the state of FIG. 38.
Figure 40:
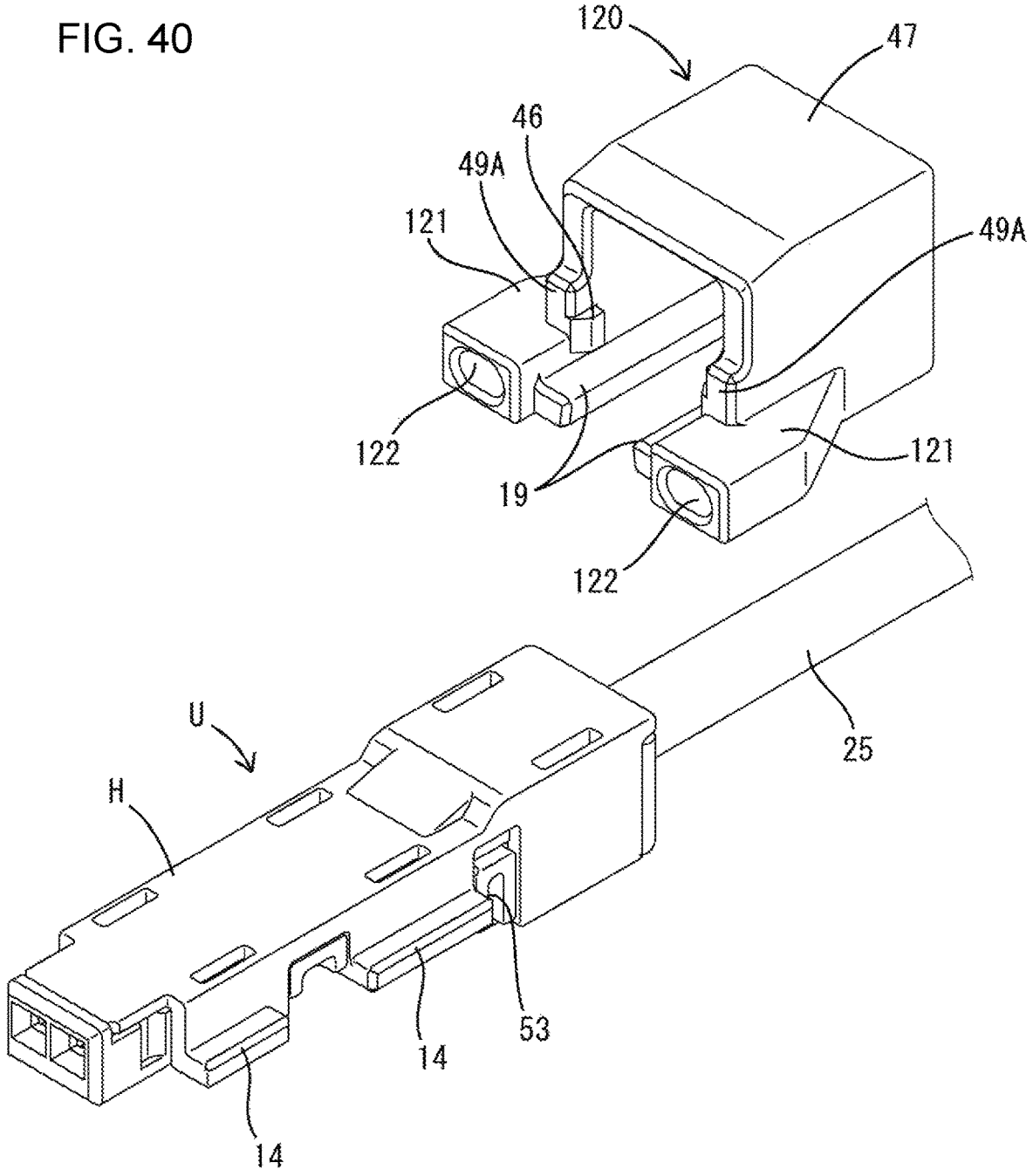
FIG. 40 is an exploded perspective view of a terminal module in a fifth embodiment.
Figure 41:
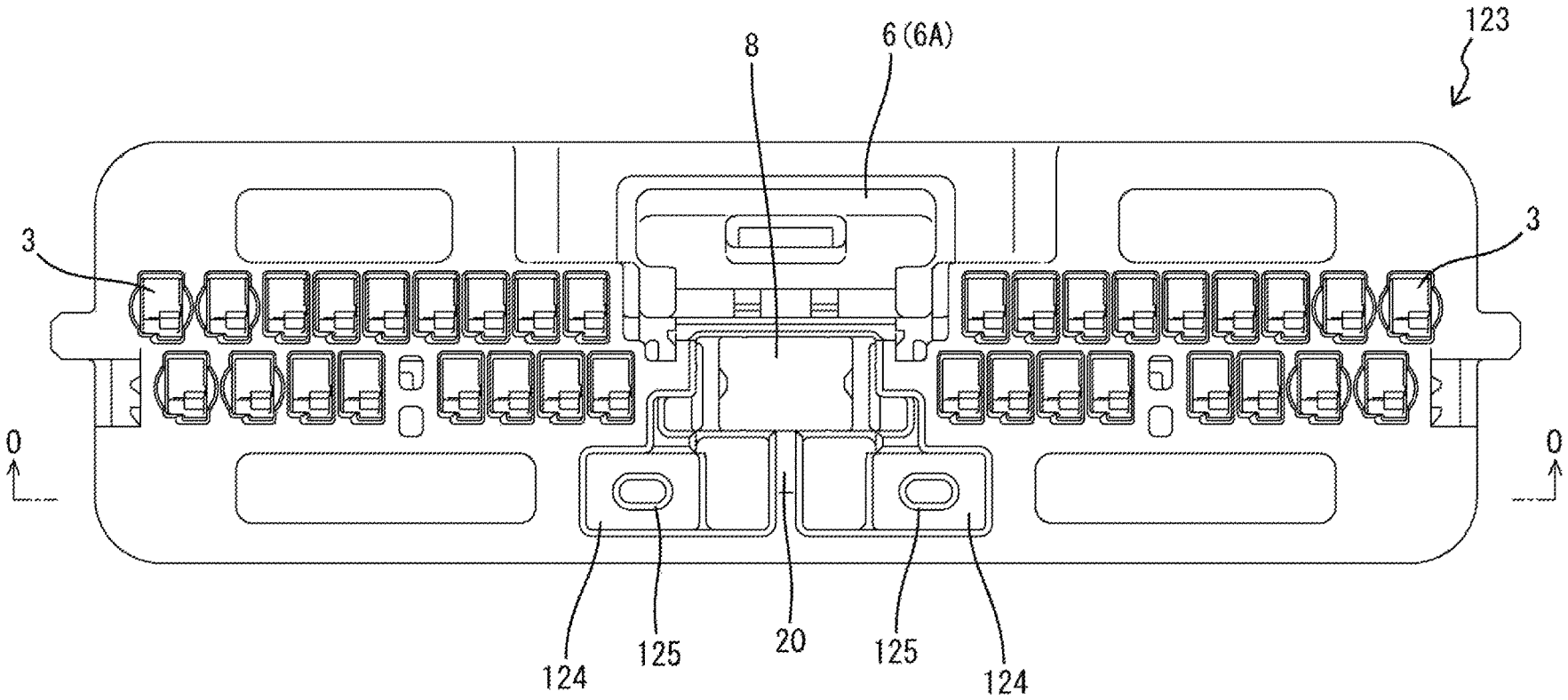
FIG. 41 is a front view of a connector housing.
Figure 42:
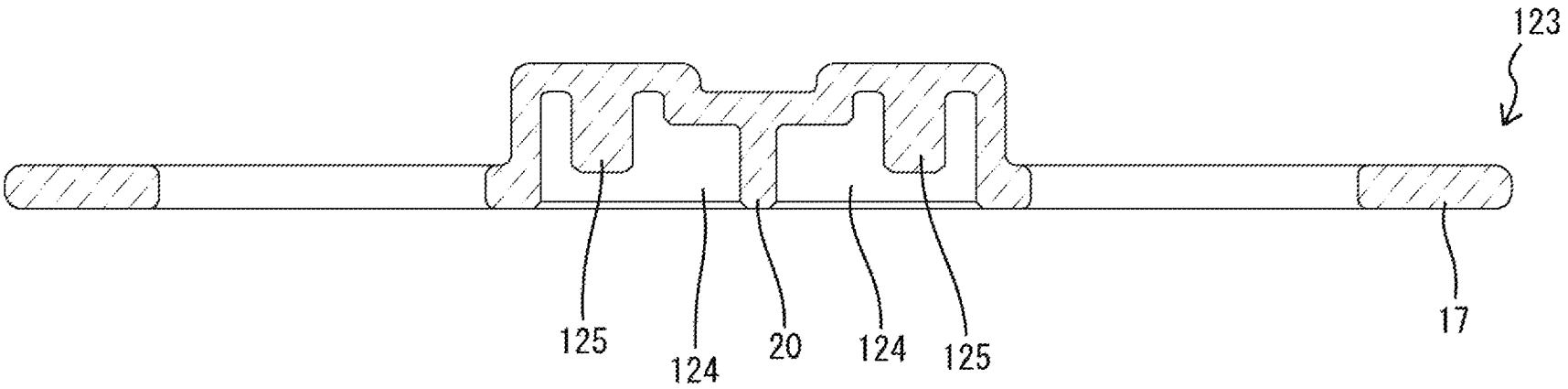
FIG. 42 is a section along O-O of FIG. 41.
Figure 43:
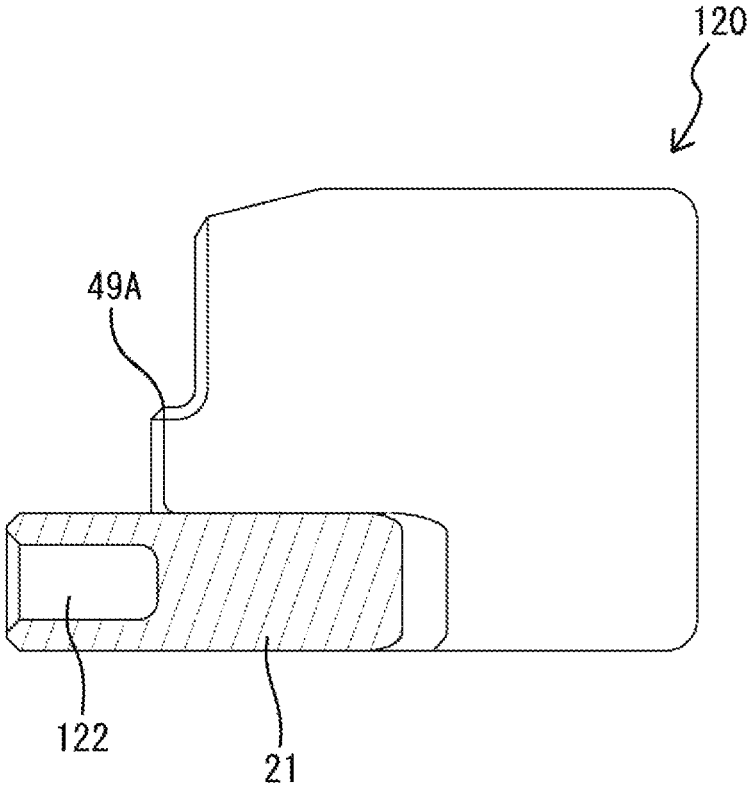
FIG. 43 is a side view in section cut along a swing preventing portion in a displacement restricting member.

Until a terminal module M is mounted at a proper position in an accommodation recess 8, the guiding surfaces 101A of the claws 108 slide in contact with the guiding inclined surfaces 106A of the locking partition wall 106. Thus, the locks 101 are deflected and deformed outward in the width direction, i.e. in directions away from each other. The locks 101 resiliently return when the terminal module M reaches the proper position and the claws 108 are locked to the locking steps 1066, as shown in FIG. 38, and front parts of the claws 108 enter the releasing openings 107, as shown in FIG. 39.

The shapes of the positioning portions 109 are substantially the same as in the first embodiment. The positioning portions 109 protrude on both outer side surfaces of the base 47 and go around to the front surfaces of both side walls 49 below steps 49A. The upright walls 112 (functioning as the positioning portions 109) are thinner than the side walls 49 and are formed on the lower surfaces of these going-around parts.

Figure 37:
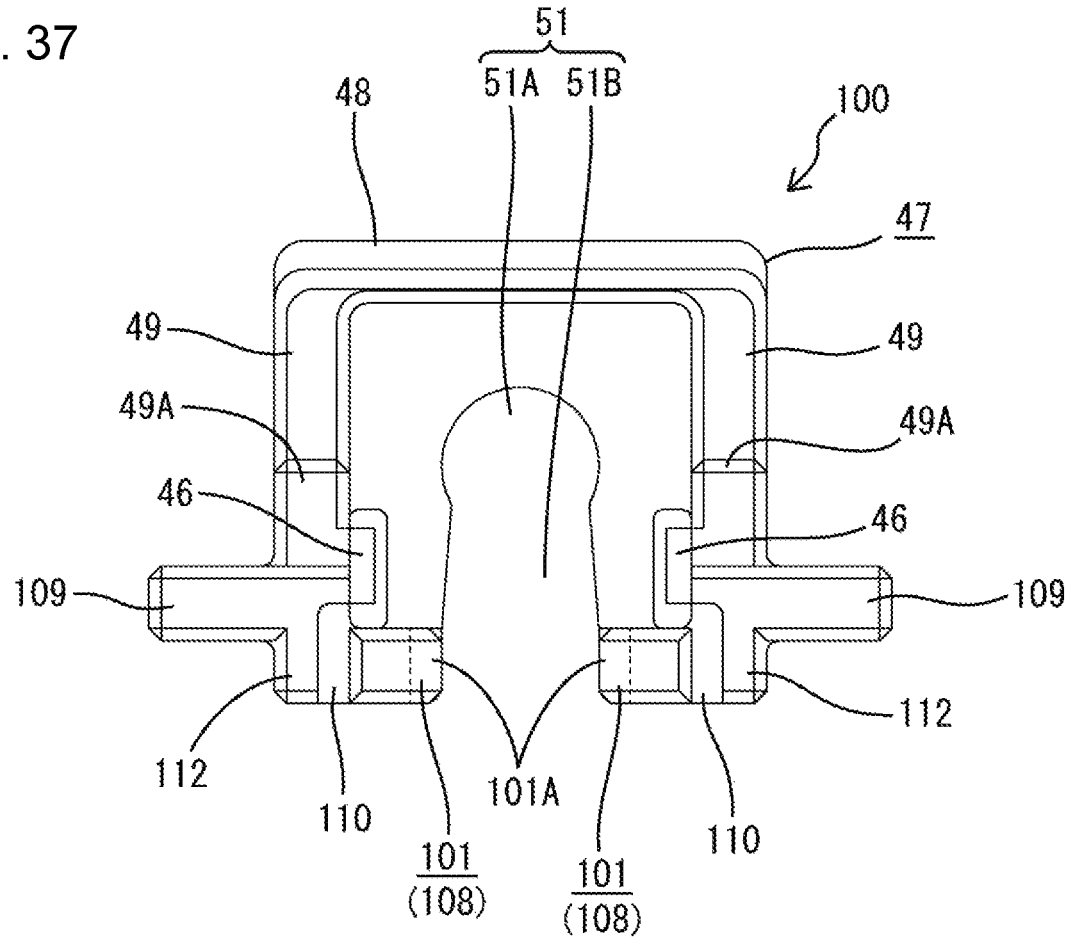
FIG. 37 is a back view of a displacement restricting member.

As shown in FIG. 37, the positioning portions 109 are at positions between latching projections 46 and the locks 101 (flanges 19) in a height direction. The front end positions of the positioning portions 109 retracted rearward from those of the locks 101. A thickness of the positioning portions 109 is substantially equal to an inner height of the receiving portions 104.

As the terminal module M is mounted at the proper position in the accommodation recess 8, the positioning portions 109 are inserted into the receiving portions 104. In this state, although not shown in detail, the positioning portions 109 are held substantially in close contact with both upper and lower surfaces in the receiving portions 104. Also, as shown in FIG. 38, the widthwise outer side surfaces of the upright walls 112 formed continuously with the positioning portions 109 are held substantially in close contact with the widthwise outer side surfaces of the lock receiving portions 105.

In the fourth embodiment configured as described above, the terminal module M itself can be assembled and the terminal module M can be mounted into the connector housing 102 substantially in the same procedures as in the third embodiment.

However, in the fourth embodiment, the claws 108 are guided to be deflected and deformed outward in the width direction by the expanding and guiding action of the guiding inclined surfaces 106A of the locking partition wall 106 in the connector housing 102 in assembling the terminal module M. When the terminal module M is mounted properly, the claws 108 return and are locked to the locking steps 106B. In this way, the retention of the displacement restricting member 100 itself and eventually the retention of the terminal module M itself are strengthened. Note that the terminal module M can be withdrawn in the same or similar procedure as in the third embodiment.

Further, with the positioning portions 109 inserted in the receiving portions 104, the upper and lower surfaces and the widthwise outer side surfaces of the positioning portions 109 are held substantially in close contact with the facing surfaces in the receiving portions 104. Further, in this state, the widthwise side surfaces of the upright walls 112 are held in close contact along the widthwise side surfaces in the lock receiving portions 105. Thus, the detachment of an upper case 29 and deformation of a terminal holding member H can be avoided even if a second wire 25 is swung strongly in the vertical and lateral directions. This also applies to the other embodiments.

Fifth Embodiment

FIGS. 40 to 44 show the fifth embodiment of the invention. Although the fifth embodiment has the same basic structure as the first embodiment, swing prevention is further strengthened by adding a swing preventing function to the configuration of the first embodiment. Points of difference from the first embodiment are described below.

Figure 6:
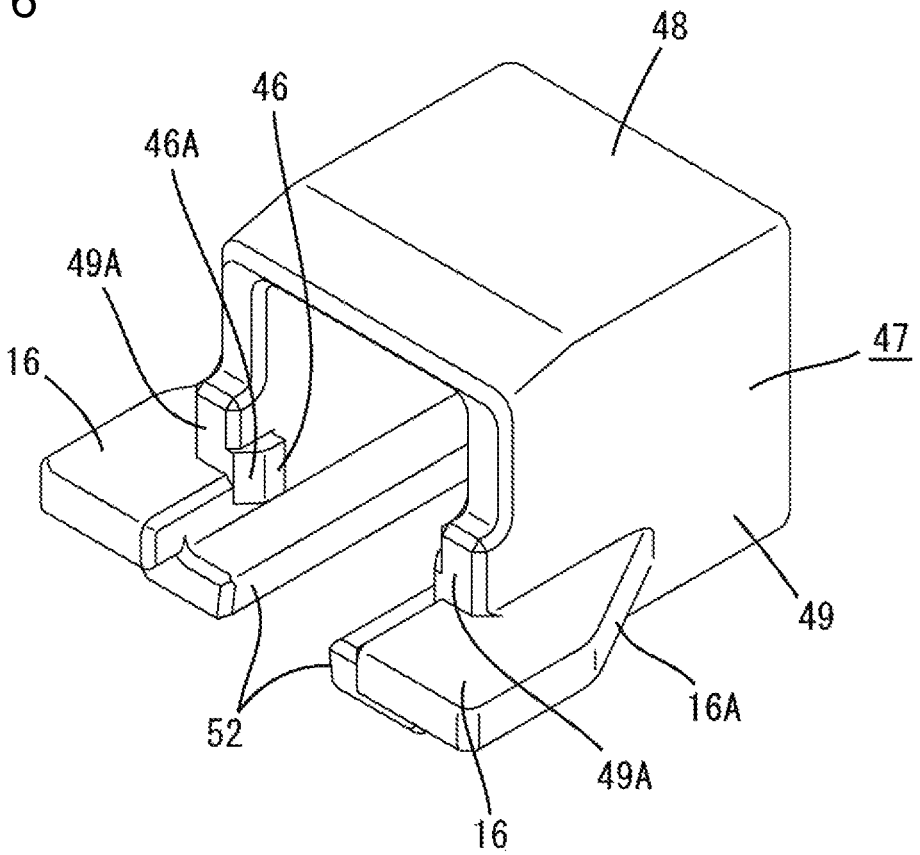
FIG. 6 is a perspective view of a displacement restricting member.

A displacement restricting member 120 of this embodiment is described in comparison to the displacement restricting member 2 of the first embodiment shown in FIG. 6. The displacement restricting member 120 of the fifth embodiment shown in FIG. 40 includes positioning portions 121 thicker than those of the first embodiment. In addition, swing preventing holes 122 serving as swing preventing portions are provided in the front surfaces of the positioning portions 121. These swing preventing holes 122 are round perforated holes open on front end sides and extending rearward to have a predetermined depth.

Figure 44:
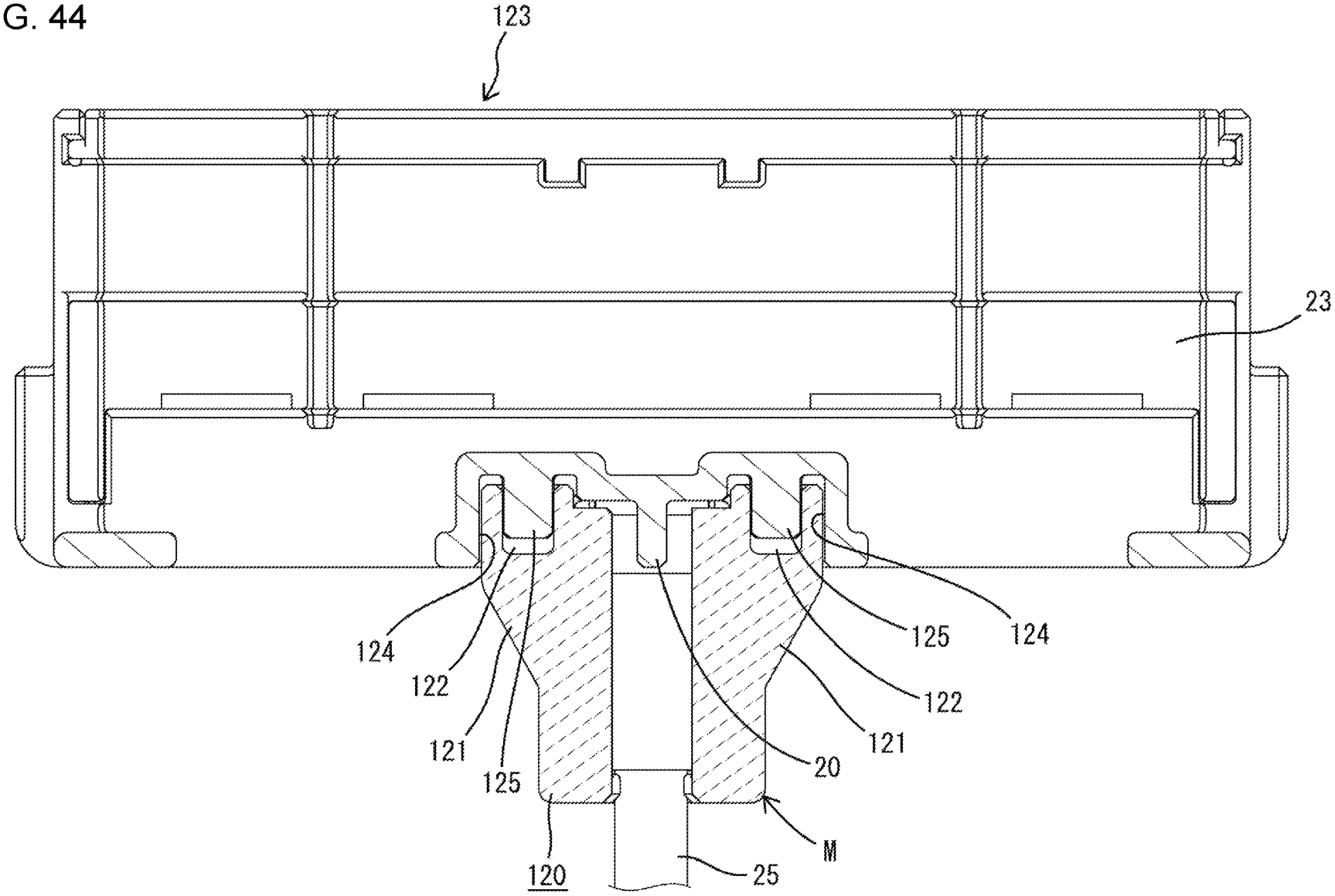
FIG. 44 is a plan view in section showing a state of convex-concave fitting by the swing preventing portions in the connector with the terminal module mounted in the connector housing.
Figure 45:
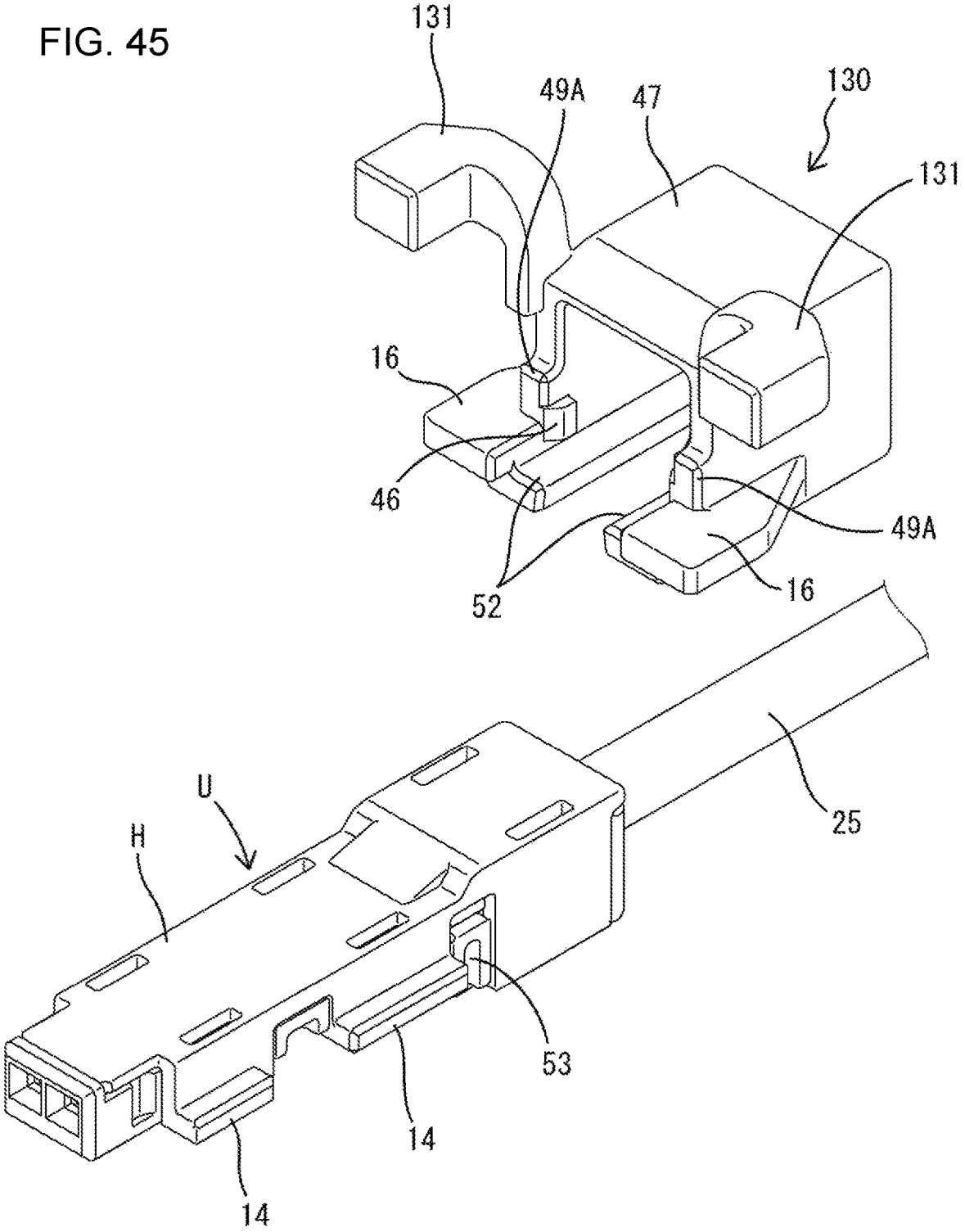
FIG. 45 is an exploded perspective view of a terminal module in a sixth embodiment.
Figure 46:
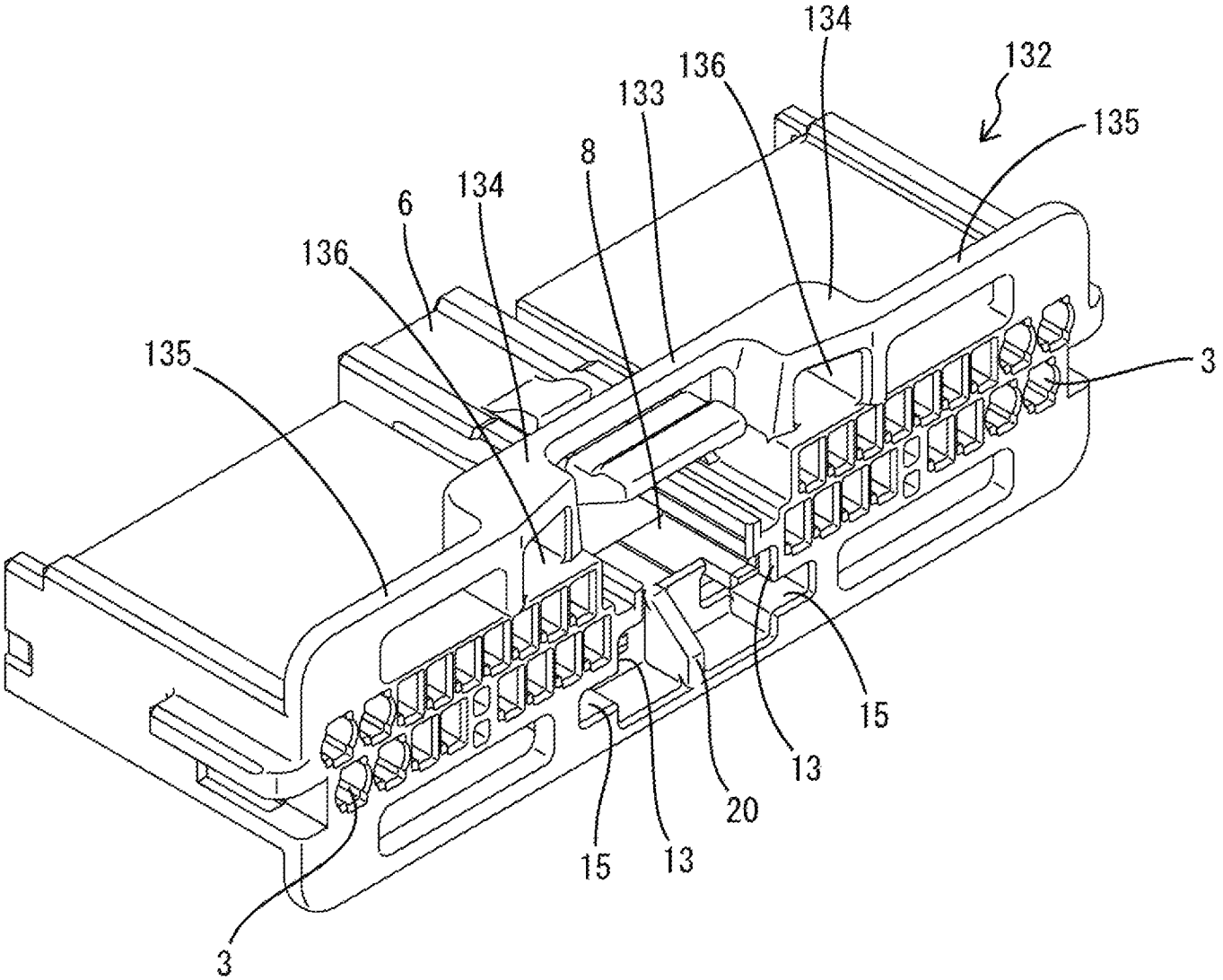
FIG. 46 is a perspective view of a connector housing.
Figure 47:
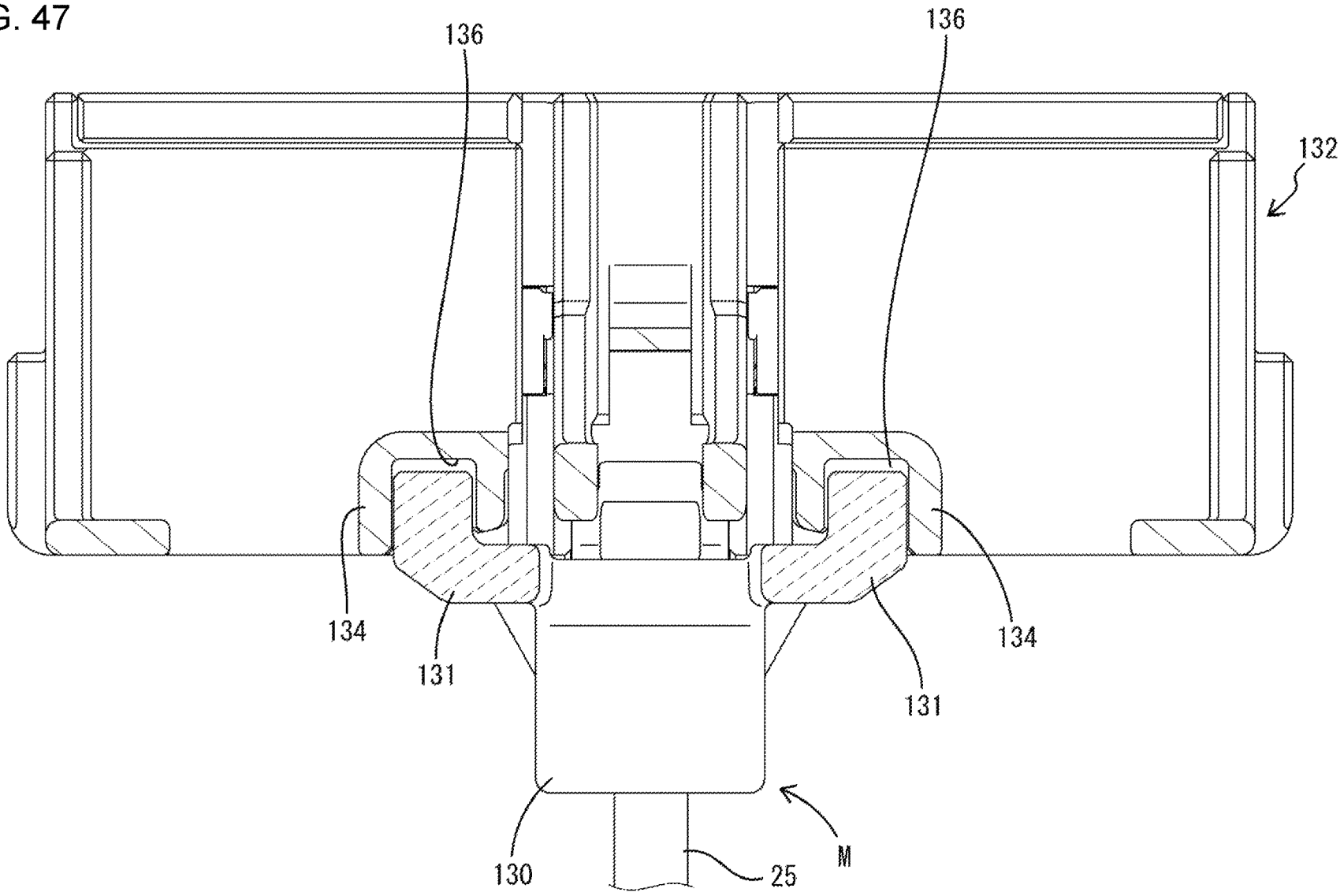
FIG. 47 is a plan view in section showing a state of convex-concave fitting by swing preventing portions in a connector with the terminal module mounted in the connector housing.
Figure 48:
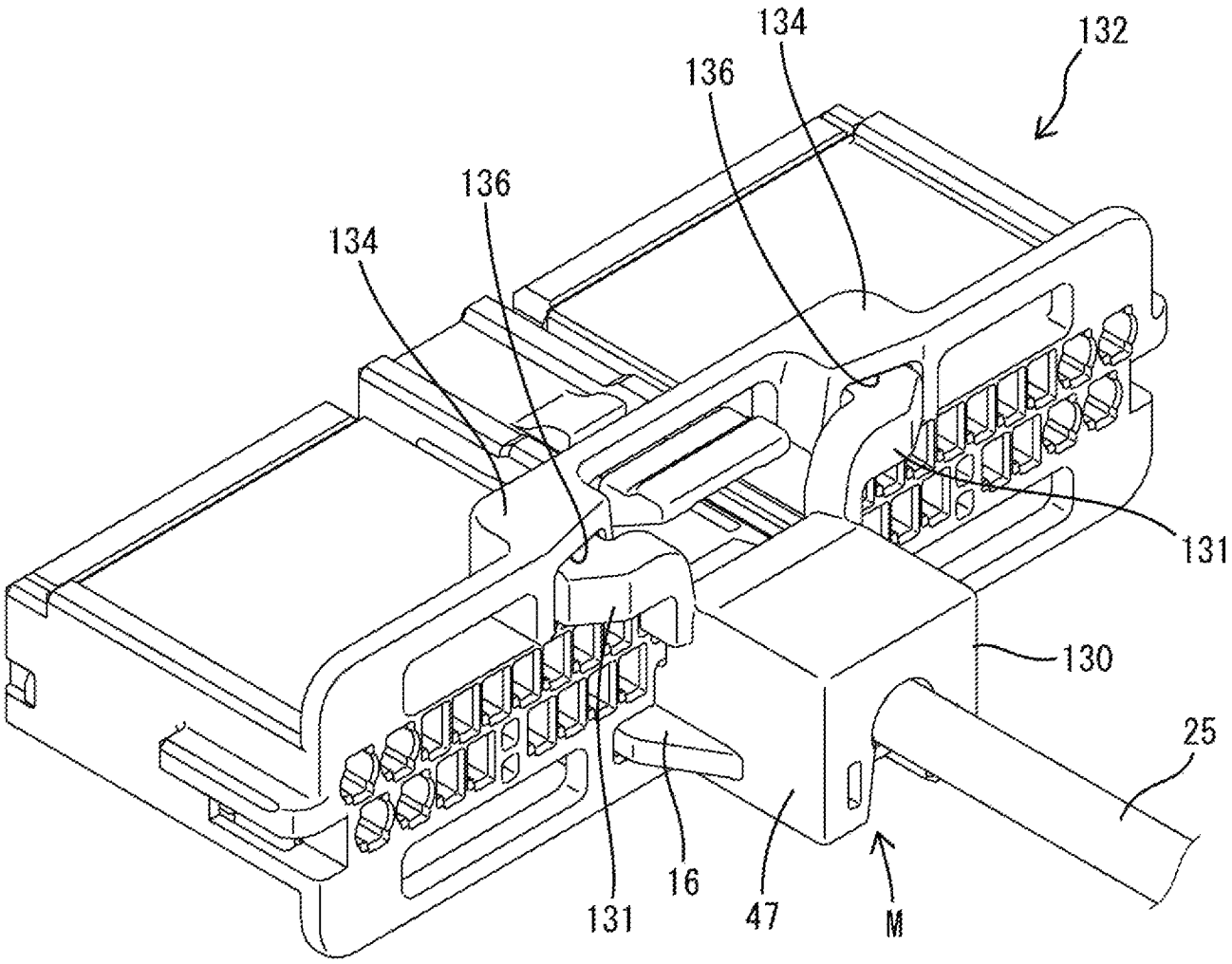
FIG. 48 is a perspective view showing the state of FIG. 47.
Figure 49:
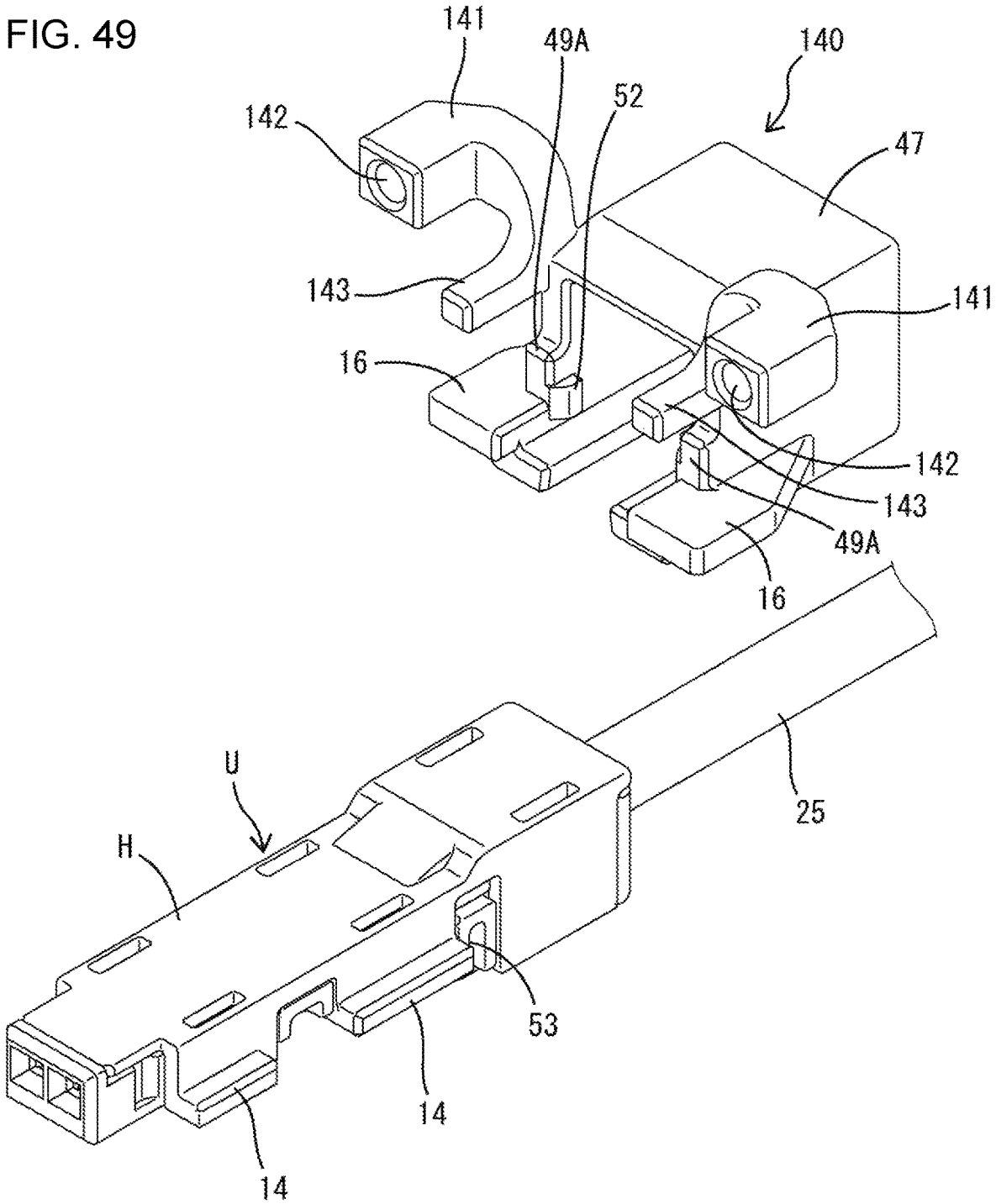
FIG. 49 is an exploded perspective view of a terminal module in a seventh embodiment.

A connector housing 123 also has substantially the same basic configuration as in the first embodiment. The connector housing 123 of this embodiment is described in comparison to the connector housing 1 of the first embodiment shown in FIGS. 2 and 12. In the connector housing 123 of this embodiment shown in FIG. 41, an inner height of receiving portions 124 is larger due to an increase in the thickness of the positioning portions 121. In addition, projecting shafts 125 serving as swing prevention receiving portions project horizontally rearward in central parts of front surfaces in the receiving portions 124. When the terminal module M is mounted at a proper position in the connector housing 123, the projecting shafts 125 are fit into and substantially held in close contact with the swing preventing holes 122, as shown in FIG. 44.

Also in the fifth embodiment configured as described above, the positioning portions 121 are pressed in contact with both upper and lower surfaces and widthwise outer side surfaces in the receiving portions 124 as in the first embodiment. Thus, a sufficient swing preventing force is exhibited for a terminal holding member H. Since the fitting configuration of the projecting shafts 125 and the swing preventing holes 122 is added in this embodiment, the swing preventing force is strengthened and detachment of an upper case 29 or deformation of the terminal holding member H is less likely can be.

The other configuration is the same as in the first embodiment and, hence, can exhibit similar functions and effects.

Sixth Embodiment

FIGS. 45 to 48 show the sixth embodiment of the invention. This embodiment includes modifications of the swing preventing portions and the swing prevention receiving portions in the fifth embodiment.

A basic configuration of a displacement restricting member 130 is the same as the displacement restricting member 2 of the first embodiment, and left and right swing preventing arms 131 serving as swing preventing portions are connected to upper parts of front parts of both left and right side surfaces of a base. The swing preventing arm is bent to protrude outward in a width direction after rising up from the base and extends horizontally forward from the bent end part. A tip (forward extending part) of the swing preventing arm is a rectangular column having a substantially square cross-section.

A connector housing 132 has the same basic configuration as the first embodiment, but the following point is added in the sixth embodiment. A restricting wall 133 for restricting inadvertent unlocking straddles a releasing portion of the lock arm 6 on a rear part of the upper surface of the connector housing 132. The restricting wall 133 is bridge-shaped and left and right swing prevention receiving portions 134 are formed on both widthwise ends thereof. The rear ends of the swing prevention receiving portions 134 are continuous with two pull-out operation walls 135 extending along the rear end of the upper surface of the connector housing 132. Forwardly open round swing restricting holes 136 are inside the swing prevention receiving portions 134. When a terminal module M is mounted into the connector housing 132, the tips of the swing preventing arms 131 are fit into the swing restricting holes 136. At this time, the entire peripheral surfaces of the tip parts of the swing preventing arms 131 are in close contact with walls of the swing restricting holes 136.

In the sixth embodiment, the swing preventing arms 131 are fit into the swing restricting holes 136 while being held in close contact with the swing restricting holes 136 over the entire periphery in addition to positioning portions 16 positioned and fit in receiving portions 15 as in the first embodiment. Thus, a swing preventing function for the terminal module M is strengthened, and deformation of a terminal holding member H and the like due to the swing of a second wire 25 can be avoided more reliably.

Since the configuration of the sixth embodiment other than that described above is common to the first embodiment, functions and effects by a common structure are the same as in the first embodiment.

Seventh Embodiment

FIGS. 49 to 52 show the seventh embodiment of the invention. The seventh embodiment is a modification of the sixth embodiment and a second swing preventing mechanism and reinforcing structures for swing preventing arms as first swing preventing portions are added.

A basic configuration of a displacement restricting member 140 is the same as in the sixth embodiment. One change is that swing preventing holes 142 as second swing preventing portions are formed in the front surfaces of tip parts of swing preventing arms 141 as first swing preventing portions. The swing preventing holes 142 are round holes open forward and perforated to a predetermined depth.

Left and right reinforcing arms 143 are provided on the front surfaces of base end parts of the swing preventing arms 141. Base end parts of the reinforcing arms 143 are connected to parts of the front surfaces of the swing preventing arms 141 near outer ends and go around to and are connected to both side surface walls of a base 47. The reinforcing arms 143 project forward in parallel to the tip parts of the swing preventing arms 141. The reinforcing arms 143 are rectangular columns and are thinner than the swing preventing arms 141. Front positions of the reinforcing arms 143 are slightly in front of those of the swing preventing arms 141 and those of positioning portions 16.

Figure 50:
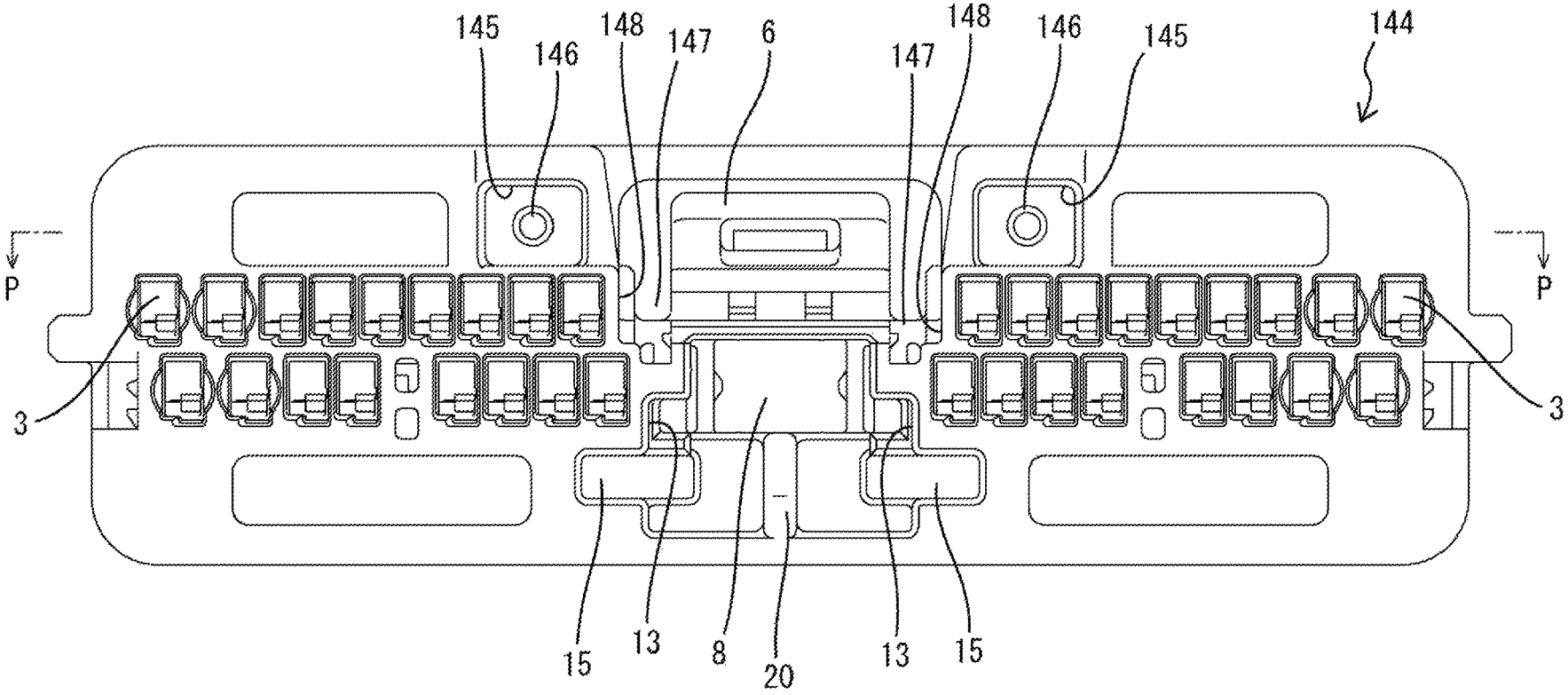
FIG. 50 is a front view of a connector housing.
Figure 51:
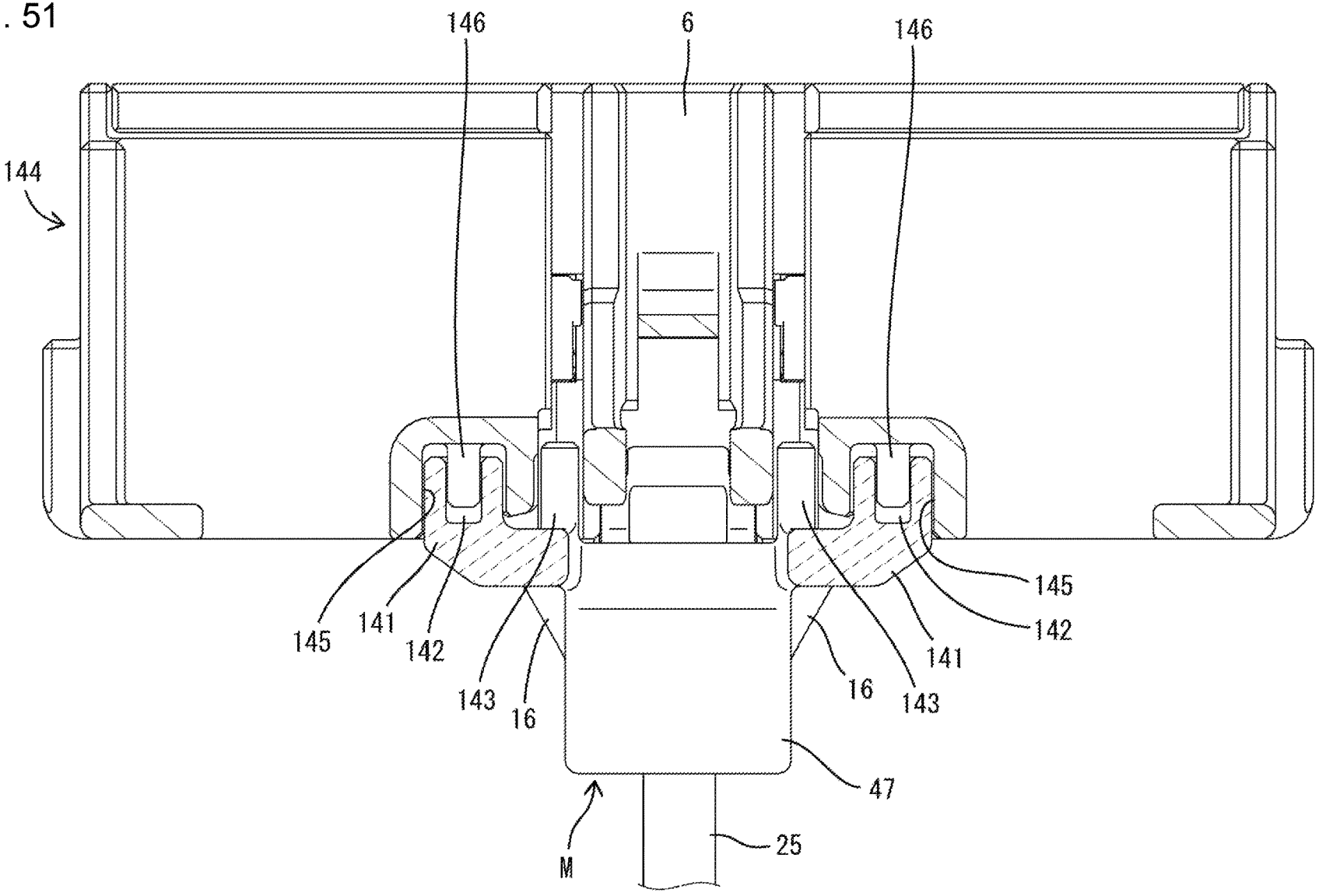
FIG. 51 is a section along P-P of FIG. 50.

As shown in FIGS. 50 and 51, projecting shafts 146 as second swing prevention receiving portions are provided in central parts of front surfaces in swing restricting holes 145 as first swing prevention receiving portions in a connector housing 144. The projecting shafts 146 project horizontally rearward and have a cylindrical shape as a whole. When a terminal module M is properly mounted into the connector housing 144, the tip parts of the swing preventing arms 141 are inserted while being positioned in the swing restricting holes 145, i.e. with the entire peripheral surfaces of the tip parts of the swing preventing arms 141 held in close contact with the inner peripheral surfaces of the swing restricting holes 145, and the projecting shafts 146 are inserted into the swing preventing holes 142 with the entire peripheries thereof held substantially in close contact with the swing restricting holes 142.

Figure 52:
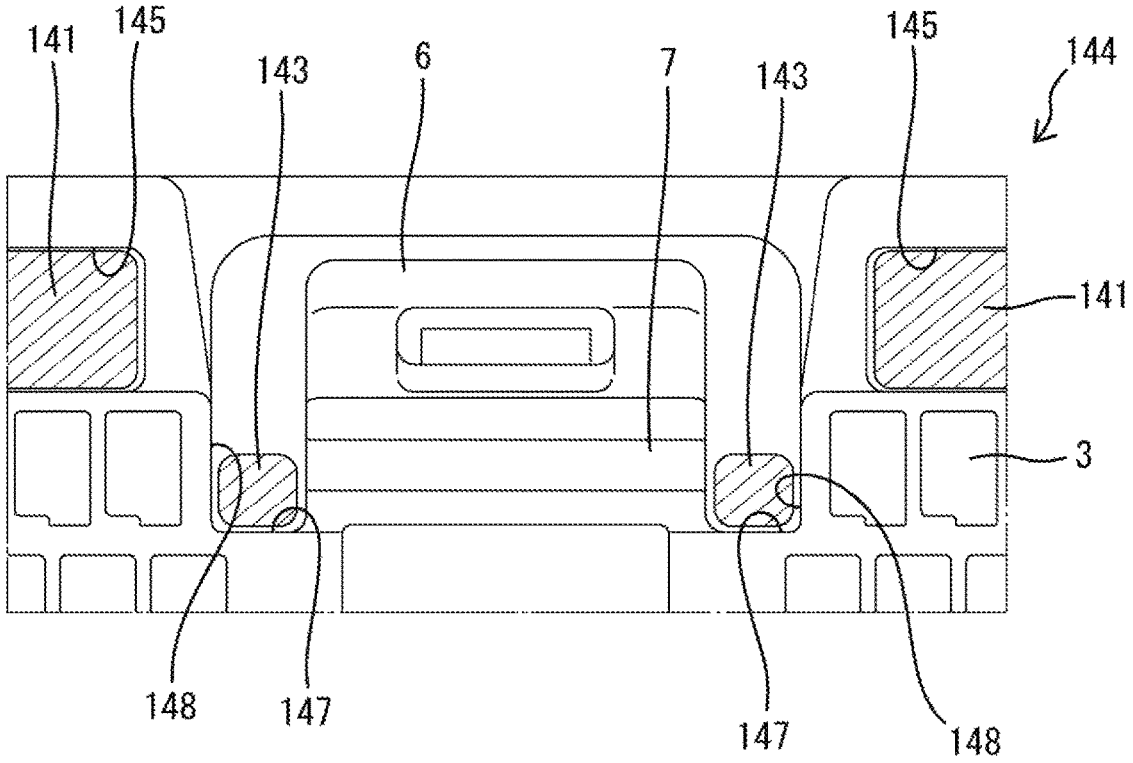
FIG. 52 is an enlarged front view in section schematically showing a locking state of reinforcing arms and rail grooves.

As shown in FIGS. 51 and 52, both widthwise sides of a deflection space 7 located below a lock arm 6 in the connector housing 144 serve as insertion spaces 147 into which the reinforcing arms 143 are to be inserted and communicate with the deflection space 7. Side walls forming terminal accommodation chambers 3 in an upper stage are located on widthwise outer sides of the insertion spaces 147 and serve as a pair of left and right swing preventing walls 148. When the terminal module M is properly mounted into the connector housing 144, the reinforcing arms 143 are inserted into the insertion spaces 147 substantially up to the vicinities of base ends and widthwise outer side surfaces are held substantially in contact along the swing preventing walls 148.

According to the seventh embodiment, when the terminal module M is mounted properly into the connector housing 144, the tips of the swing preventing arms 141 as the first swing preventing portions are fit into the swing restricting holes 145, as the first swing prevention receiving portions, and, in addition, the projecting shafts 146 as the second swing prevention receiving portions are fit into the insertion holes swing preventing holes 142 as the second swing preventing portions. As just described, by adding the second swing preventing mechanism, the swing of a second wire 25 is restricted more than in the sixth embodiment and deformation of a terminal holding member H is less likely.

In the sixth embodiment, there is concern about deformation, fracture and the like of the cantilevered swing preventing arms 131 if the second wire 25 is swung. In the seventh embodiment, the reinforcing arms 143 connected to the base end parts of the swing preventing arms 141 are inserted into the insertion spaces 147 and the widthwise outer side surfaces contact the swing preventing walls 148. Thus, even if the second wire 25 is swung in the width direction, a swing force in the lateral direction can be withstood by contact of the reinforcing arms 143 and the swing preventing walls 148. Thus, the swing is less likely to affect the swing preventing arms 141 and deformation or fracture of the swing preventing arms 141 can be avoided.

The other configuration is the same as or similar to in the sixth embodiment and, hence, similar functions and effects can be exhibited.

The invention is not limited to the above described embodiments. For example, the following embodiments also are included in the scope of the invention.

In any of the above embodiments, the displacement restricting member is mounted on the terminal unit U. However, a displacement restricting member may be provided on a connector housing and locked to a terminal holding member, thereby restricting the deformation of the displacement restricting member and the like.

Although the accommodation recess is below the deflection space for the lock arm in the widthwise central part of the connector housing in the above embodiments, the accommodation recess may be deviated toward one widthwise side.

The base of the displacement restricting member is mounted on the part of the terminal holding member projecting rearward from the connector housing in the above embodiments. However, the displacement restricting member may extend farther forward and be mounted on a part of the terminal holding member in the connector housing.

REFERENCE SIGNS

1, 62, 81, 102, 123, 132, 144 . . . connector housing
2, 60, 87, 100, 120, 130, 140 . . . displacement restricting member
3 . . . terminal accommodation chamber
4 . . . first terminal fitting
5 . . . first wire
6 . . . lock arm
7 . . . deflection space
8 . . . accommodation recess
15, 64, 83, 104, 124 . . . receiving portion
16, 69, 89, 121 . . . positioning portion
25 . . . second wire
26 . . . second terminal fitting
28 . . . first/lower case (body)
29 . . . second/upper case (cover)
47 . . . base
49 . . . side surface wall
61, 80, 101 . . . lock
68, 85, 106B . . . locking step edge (lock receiving portion)
70, 88, 108 . . . claw
122 . . . swing preventing hole (swing preventing portion)
125, 146 . . . projecting shaft (swing prevention receiving portion)
131, 141 . . . swing preventing arm (swing preventing portion)
142 . . . swing preventing hole (second swing preventing portion)
145 . . . swing restricting hole (first swing prevention receiving portion)
146 . . . projecting shaft (second swing prevention receiving portion)
H . . . terminal holding member
M . . . terminal module
U . . . terminal unit

What is claimed is:

1. A connector, comprising:

a connector housing including at least one terminal accommodation chamber and at least one accommodation recess;

a first terminal fitting to be at least partly inserted into the terminal accommodation chamber;

at least one second terminal fitting to be connected to a wire;

a terminal holding member being capable of at least partly accommodating the at least one second terminal fitting;

a terminal unit including the second terminal fitting connected to the wire and the terminal holding member at least partly accommodating the at least one second terminal fitting, a rear part of the terminal holding member projecting rearward from the connector housing when the terminal unit is mounted at least partly into the accommodation recess; and a displacement restricting member to be provided at least on either one of the connector housing and the terminal holding member, the displacement restricting member being locked to the other of the connector housing and the terminal holding member to restrict a displacement of the terminal unit when the terminal unit is mounted into the accommodation recess, wherein the displacement restricting member includes at least one swing preventing portion substantially extending toward the connector housing, a front end part of the swing preventing portion in a mounting direction is fittable to at least one swing prevention receiving portion provided to substantially face the swing preventing portion in the mounting direction in the connector housing in a convex-concave manner when the terminal unit is mounted into the accommodation recess.

2. The connector of claim 1, wherein the terminal holding member comprises a body portion and a covering portion, the terminal holding member being capable of at least partly accommodating the at least one second terminal fitting with the body portion and the covering portion united.

3. The connector of claim 1, wherein the displacement restricting member includes a base portion to be mounted on a part of the terminal holding member projecting from the connector housing and a positioning portion provided on the base portion and configured to restrict a displacement of the terminal unit, and the positioning portion is positioned and fit into a receiving portion provided in the connector housing when the terminal unit is accommodated at least partly into the accommodation recess with the displacement restricting member mounted.

4. The connector of claim 1, wherein the connector housing is formed with at least one deflectable lock arm, and the accommodation recess is open and communicates with a deflection space for the lock arm.

5. The connector of claim 4, wherein:

the base portion includes a pair of side surface walls deflectable in expanding directions, is so mountable as to at least partly straddle the terminal holding member with the side surface walls at least partly restored after being deflected and deformed with respect to the terminal holding member, and one or more locking projections configured to restrict the detachment of the displacement restricting member from the terminal holding member by locking the terminal holding member are formed on inner surfaces of the side surface wall.

6. The connector of claim 5, wherein at least parts of the side surface walls come into contact with an inner wall of the accommodation recess to prevent the opening of the side surface walls when the terminal unit at least partly is fit into the accommodation recess.

7. The connector of claim 1, wherein the displacement restricting member includes a lock portion configured to retain the terminal unit by locking the connector housing when the terminal unit is mounted at least partly into the accommodation recess.

8. The connector of claim 7, wherein the lock portion includes a claw portion on or near a tip and is formed integrally or unitarily and deflectably in the displacement restricting member, and the claw portion resiliently locks a lock receiving portion (68; 85; 106B) provided in the connector housing as the terminal unit is mounted at least partly into the accommodation recess.

* * * * *